US012264447B2

(12) United States Patent
McIntosh

(10) Patent No.: US 12,264,447 B2
(45) Date of Patent: Apr. 1, 2025

(54) RETAINING WALL SYSTEMS

(71) Applicant: Robert Gordon McIntosh, Abbotsford (CA)

(72) Inventor: Robert Gordon McIntosh, Abbotsford (CA)

(73) Assignee: Robert Gordon McIntosh, Abbotsford (CA)

( * ) Notice: Subject to any disclaimer, the term of this patent is extended or adjusted under 35 U.S.C. 154(b) by 81 days.

(21) Appl. No.: 17/655,327

(22) Filed: Mar. 17, 2022

(65) Prior Publication Data

US 2022/0298740 A1 Sep. 22, 2022

(30) Foreign Application Priority Data

Mar. 17, 2021 (CA) ..... CA 3112520

(51) Int. Cl.
*E02D 29/02* (2006.01)

(52) U.S. Cl.
CPC ..... *E02D 29/0266* (2013.01); *E02D 29/025* (2013.01); *E02D 2200/143* (2013.01); *E02D 2300/002* (2013.01); *E02D 2300/0034* (2013.01); *E02D 2600/40* (2013.01)

(58) Field of Classification Search
CPC ..... E02D 29/025; E02D 29/0266; E02D 2200/143; E02D 2300/002; E02D 2300/0034; E02D 2600/40; E02D 2600/30; E04B 2002/0254; E04B 2/16
See application file for complete search history.

(56) References Cited

U.S. PATENT DOCUMENTS

| | | | |
|---|---|---|---|
| 705,732 | A | 7/1902 | Bone |
| 837,962 | A | 12/1906 | Rice |
| 1,356,319 | A | 10/1920 | Smulski |
| 2,684,589 | A | 7/1954 | Perreton |
| 3,195,312 | A | 7/1965 | Rumsey, Jr. |
| 3,430,397 | A | 3/1969 | Ellis |
| 3,613,382 | A | 10/1971 | Dickinson |
| 3,951,384 | A | 4/1976 | Hildreth, Jr. |
| 3,953,979 | A | 5/1976 | Kurose |
| 4,473,978 | A | 10/1984 | Wood |

(Continued)

FOREIGN PATENT DOCUMENTS

| | | | |
|---|---|---|---|
| AU | 540765 | B2 | 12/1984 |
| CA | 2075580 | A1 | 2/1994 |

(Continued)

OTHER PUBLICATIONS

Lock-Block Ltd. Product Pamphlet, Feb. 1-28, 2023, in 42 pages, Retrieved from the Internet: URL: https://lockblock.com/wp-content/blocklist.pdf [retrieved on Feb. 7, 2023].

(Continued)

*Primary Examiner* — Carib A Oquendo
(74) *Attorney, Agent, or Firm* — Knobbe Martens Olson & Bear LLP

(57) ABSTRACT

A retaining wall system includes at least one wall block, at least one ground-stabilizing base body supporting the at least one wall block, a fastening body under the at least one ground-stabilizing base body, and at least one tension link attached to the at least one wall block and to the fastening body.

40 Claims, 31 Drawing Sheets

(56) References Cited

U.S. PATENT DOCUMENTS 4,512,685 A 4/1985 Hegle
4,592,678 A * 6/1986 McNinch, Jr. ..... E02D 29/025 D25/113
4,655,646 A 4/1987 Babcock et al.
4,668,129 A 5/1987 Babcock et al.
4,703,602 A 11/1987 Pardo
4,726,567 A 2/1988 Greenberg
4,824,293 A 4/1989 Brown et al.
4,884,921 A 12/1989 Smith
4,911,585 A 3/1990 Vidal et al.
4,916,874 A 4/1990 McCoy et al.
4,961,673 A 10/1990 Pagano et al.
4,964,761 A 10/1990 Rossi
4,982,544 A 1/1991 Smith
5,028,172 A 7/1991 Wilson et al.
5,030,035 A 7/1991 Babcock
5,044,833 A 9/1991 Wilfiker
5,066,169 A 11/1991 Gavin et al.
5,131,791 A 7/1992 Kitziller
5,154,542 A 10/1992 Klenert
5,163,261 A 11/1992 O'Neill
5,178,492 A 1/1993 Meheen
5,178,493 A 1/1993 Vidal et al.
5,224,801 A 7/1993 Quaney
5,257,880 A 11/1993 Janopaul
5,406,769 A 4/1995 Vidal et al.
5,444,950 A 8/1995 Kelly et al.
5,468,098 A 11/1995 Babcock
5,481,836 A 1/1996 Miller et al.
5,488,806 A 2/1996 Melnick et al.
5,489,165 A 2/1996 Smith
5,525,014 A 6/1996 Brown
5,567,089 A 10/1996 Akamine
5,611,181 A 3/1997 Shreiner et al.
5,624,211 A 4/1997 Anderson et al.
5,666,775 A 9/1997 Shreiner et al.
5,697,736 A 12/1997 Veazey et al.
5,795,106 A 8/1998 Herd
5,799,456 A 9/1998 Shreiner et al.
5,934,838 A 8/1999 Egan
5,975,809 A 11/1999 Taylor et al.
6,026,618 A * 2/2000 Locke ..... B28D 1/041 403/368
6,035,599 A 3/2000 Sonnentag
6,113,316 A 9/2000 Ash
6,213,689 B1 4/2001 Hirai
6,250,038 B1 6/2001 Akamine
6,430,884 B1 8/2002 Shreiner et al.
6,443,662 B1 9/2002 Scales et al.
6,447,213 B1 9/2002 MacDonald
D467,009 S 12/2002 Agee
6,675,547 B1 1/2004 Golcheh
6,701,687 B1 3/2004 Shillingburg
6,705,057 B2 3/2004 Smyer
6,872,031 B2 3/2005 May
7,025,539 B2 4/2006 Irvine
D555,810 S 11/2007 Strand
7,360,970 B2 4/2008 Woolford et al.
D579,122 S 10/2008 McIntosh
D587,381 S 2/2009 McIntosh
D600,359 S 9/2009 King
7,584,584 B2 9/2009 Fennell
7,959,380 B2 6/2011 McIntosh
8,201,380 B2 6/2012 Hargest et al.
8,511,024 B2 8/2013 MacDonald et al.
8,938,836 B2 1/2015 Chandra et al.
D734,820 S 7/2015 Lee
D867,620 S 11/2019 Pegg
D895,153 S 9/2020 McIntosh
2002/0001509 A1 1/2002 Hong
2002/0041796 A1* 4/2002 Greenberg ..... E02D 29/0283 405/284
2003/0009970 A1 1/2003 MacDonald et al.
2003/0074856 A1 4/2003 Hammer
2003/0140840 A1 7/2003 Yang
2004/0134154 A1 7/2004 Bott
2004/0159065 A1 8/2004 Burgess et al.
2004/0161307 A1 8/2004 Hammer
2005/0008438 A1 1/2005 Babcock
2005/0081465 A1* 4/2005 Crumley ..... E04H 9/14 52/223.1
2005/0086882 A1* 4/2005 Greenberg ..... E04B 1/4157 52/299
2005/0091940 A1 5/2005 Whitson
2006/0188344 A1 8/2006 Boys
2007/0056235 A1* 3/2007 Kohler ..... E04G 21/12 52/223.7
2008/0095585 A1 4/2008 La
2008/0120931 A1 5/2008 Joslyn
2008/0184650 A1* 8/2008 Fischer ..... B28B 7/24 52/404.1
2008/0313989 A1 12/2008 Ireland
2009/0094917 A1 4/2009 McItosh
2009/0116911 A1 5/2009 Shaw
2009/0238648 A1 9/2009 Wilkman
2011/0217127 A1 9/2011 MacDonald
2012/0090260 A1* 4/2012 Muirhead ..... E04B 2/20 52/745.19
2014/0083033 A1 3/2014 McIntosh et al.
2014/0270990 A1 9/2014 Heraty
2015/0040507 A1 2/2015 MacDonald et al.
2015/0204092 A1* 7/2015 Crumley ..... E04B 1/98 52/514
2016/0160468 A1 6/2016 Rossi
2016/0024742 A1 10/2016 Heister
2017/0247879 A1* 8/2017 Gomes ..... E04B 1/30
2017/0284052 A1 10/2017 McIntosh et al.
2019/0100894 A1 4/2019 Nicol et al.

FOREIGN PATENT DOCUMENTS

CA 2290327 A1 5/2001
CA 2592213 5/2011
CA 3000082 A1 6/2018
CN 86207001 U 11/1987
CN 1270261 A 10/2000
CN 1605679 4/2005
CN 200971506 Y 11/2007
CN 101381994 3/2009
CN 201649123 U 11/2010
CN 102587410 A 7/2012
CN 102926400 2/2013
CN 103452132 A 12/2013
CN 104631491 A 5/2015
CN 104805850 A 7/2015
CN 104818724 A 8/2015
CN 105951875 A 9/2016
EP 0 021 449 A1 1/1981
EP 0 190 076 A1 8/1986
EP 2549022 1/2013
FR 2 651 258 A1 3/1991
GB 1477221 6/1977
JP S58-120924 7/1983
JP S60-43531 3/1985
JP H6-73744 A 3/1994
JP H7-145625 6/1995
JP H9-158223 6/1997
JP H9-170240 6/1997
JP H10-152848 6/1998
JP H10-195894 7/1998
JP 2000-080664 A 3/2000
JP 2000-204571 7/2000
JP 2000-314143 11/2000
JP 2002-322656 11/2002
JP 2006-316462 11/2006
JP 2008-163660 A 7/2008
JP 2010-242473 A 10/2010
JP 2010-242474 A 10/2010
JP D 1611200 8/2018
KR 10-0710850 B1 4/2007
KR 10-0824713 B1 4/2008
KR 10-2008-0077721 8/2008
KR 2009-0100160 A 9/2009

(56) References Cited

FOREIGN PATENT DOCUMENTS

| | | | |
|---|---|---|---|
| KR | 20090096238 | | 9/2009 |
| KR | 2010-0115919 | A | 10/2010 |
| KR | 10-1006963 | | 1/2011 |
| KR | 2011-0027199 | A | 3/2011 |
| KR | 10-2012-0030513 | | 3/2012 |
| KR | 2012-0021686 | A | 3/2012 |
| KR | 10-1138915 | B1 | 5/2012 |
| KR | 2015-0135659 | A | 12/2015 |
| KR | 2016-0150411 | A | 12/2016 |
| KR | 2017-0038769 | A | 4/2017 |
| KR | 300962960.0000 | | 7/2018 |
| UA | 63578 | A | 1/2004 |
| WO | WO 2007/046142 | A1 | 4/2007 |
| WO | WO 2015/007796 | A2 | 1/2015 |

OTHER PUBLICATIONS

Rod-Lock system, Retrieved from the Internet: URL: https://lockblock.com/rod-lock/ [retrieved on Mar. 7, 2023].

Chauhan et al., "Investigation of failure of a rigid retaining wall with relief shelves," Japanese Geotechnical Society Special Publication.

Chougule et al., "Effective Use of Shelves in Cantilever Retaining Walls," IRJET, vol. 04 Issue: 07, Jul. 2017.

"Counterfort Retaining Wall"—Bing images, retrieved from the internet on Sep. 27, 2017.

Erizal, "Design and Detailing of Retaining Walls," PowerPoint, Departemen Teknik Sipil Dan Lingkungan Fakultas Teknologi Pertanian IPB; SIL211 Mekanika Tanah, 3(2-3).

Gowda et al., "Stability Enhancement of Cantilever Earth Retaining Wall with Pressure Relief Shelf by Soft Computing Technique" Advanced Engineering and Applied Sciences: An International Journal 2016; 6(2): 65-68.

"High Tensile Coil Rod," Data Sheet—High Tensile Coil Rod, Spectrum Concrete Products.

Kaizer et al., "Counterfort Retaining Wall" Gandhinagar Institute of Technology: Department of Civil Engineering.

Padhye et al., "Analysis of Retaining Wall with Pressure Relief Shelf by Coulomb's Method" Proceedings of Indian Geotechnical Conference, Dec. 15-17, 2011, Kochi (Paper No. K-106).

Shehata, "Retaining walls with relief shelves" Innov. Infrastruct. Solut. (2016) 1:4.

Shinde et al., "Optimum Static Analysis of Retaining Wall with & without shelf /Shelve at different level using finite Element analysis," International Journal of Engineering Research and General Science vol. 3, Issue 2, Part 2, Mar.-Apr. 2015.

"TechWall"—Reinforced Earth, Sustainable Technology.

Tonne et al., "Optimization and Improvement in Stability of Counterfort Retaining Wall With Relief Shelf," IJRET: vol. 04 Issue: 04; Apr. 2015.

"Type T—Spherical Head T Anchors" (info-sheet) Construction Fixing Systems.

Watve et al., "Static Analysis of Retaining Wall With & Without Shelf by Using F.E.M Simulation," Global Journal of Engineering Science and Research Management; 2(7): Jul. 2015.

* cited by examiner

RETAINING WALL SYSTEMS

CROSS-REFERENCE TO RELATED APPLICATION

Any and all applications for which a foreign or domestic priority claim is identified in the Application Data Sheet as filed with the present application are hereby incorporated by reference under 37 CFR 1.57.

FIELD

This disclosure relates generally to retaining wall systems.

RELATED ART

A retaining wall system is a structure that is designed to support material, such as soil or earth, on a rear side of the retaining wall. The retaining wall is meant to resist lateral pressure exerted by the material, but retaining walls may fail for a variety of reasons. The retaining wall may not be built with enough structural strength to withstand the lateral pressure exerted by the material, particularly at greater heights, leading to failure. Retaining walls may also fail if the structure corrodes, particularly due to fractures that may develop in the wall over time, compromising the structure to the point where the wall can no longer withstand the lateral pressure exerted by the material. Failure of the retaining wall may lead to lateral displacement where a portion or the entire retaining wall is pushed forward by the retained material. Failure of the retaining wall may also lead to overturning where the retaining wall topples forward. Failure of the retaining wall may also lead to global failure where the material behind and below the retaining wall becomes unstable, displacing the retaining wall and the material behind and below the retaining wall.

Current retaining walls may attempt to avoid retaining wall failures by employing systems that utilize mechanically stabilized earth, such as geogrid systems. However, such systems are expensive and time consuming as they require excavating a large volume of material (such as soil and earth for example) from the area behind where the retaining wall will be positioned and where the earth will be mechanically stabilized. Other restrictions, both physical (such as property lines, trees, buildings, utilities, hills for example) and legal, may prevent such large excavation. Current retaining wall systems may also attempt to avoid retaining wall failures by designing rigid, monolithic structures. However, such structures are susceptible to fracturing and corrosion due to their rigidity. Such structures also require a large amount of material, making them extremely heavy, and thus expensive.

SUMMARY

According to at least one embodiment, there is disclosed a retaining wall system comprising: at least one wall block; at least one ground-stabilizing base body supporting the at least one wall block; a fastening body under the at least one ground-stabilizing base body; and at least one tension link attached to the at least one wall block and to the fastening body.

Other aspects and features will become apparent to those ordinarily skilled in the art upon review of the following description of illustrative embodiments in conjunction with the accompanying figures.

BRIEF DESCRIPTION OF THE DRAWINGS

FIG. 4 is a cross-sectional view of the base body of FIG. 3 taken along the line 4-4 in

FIG. 3.

DETAILED DESCRIPTION OF THE PREFERRED EMBODIMENT

Figure 1:
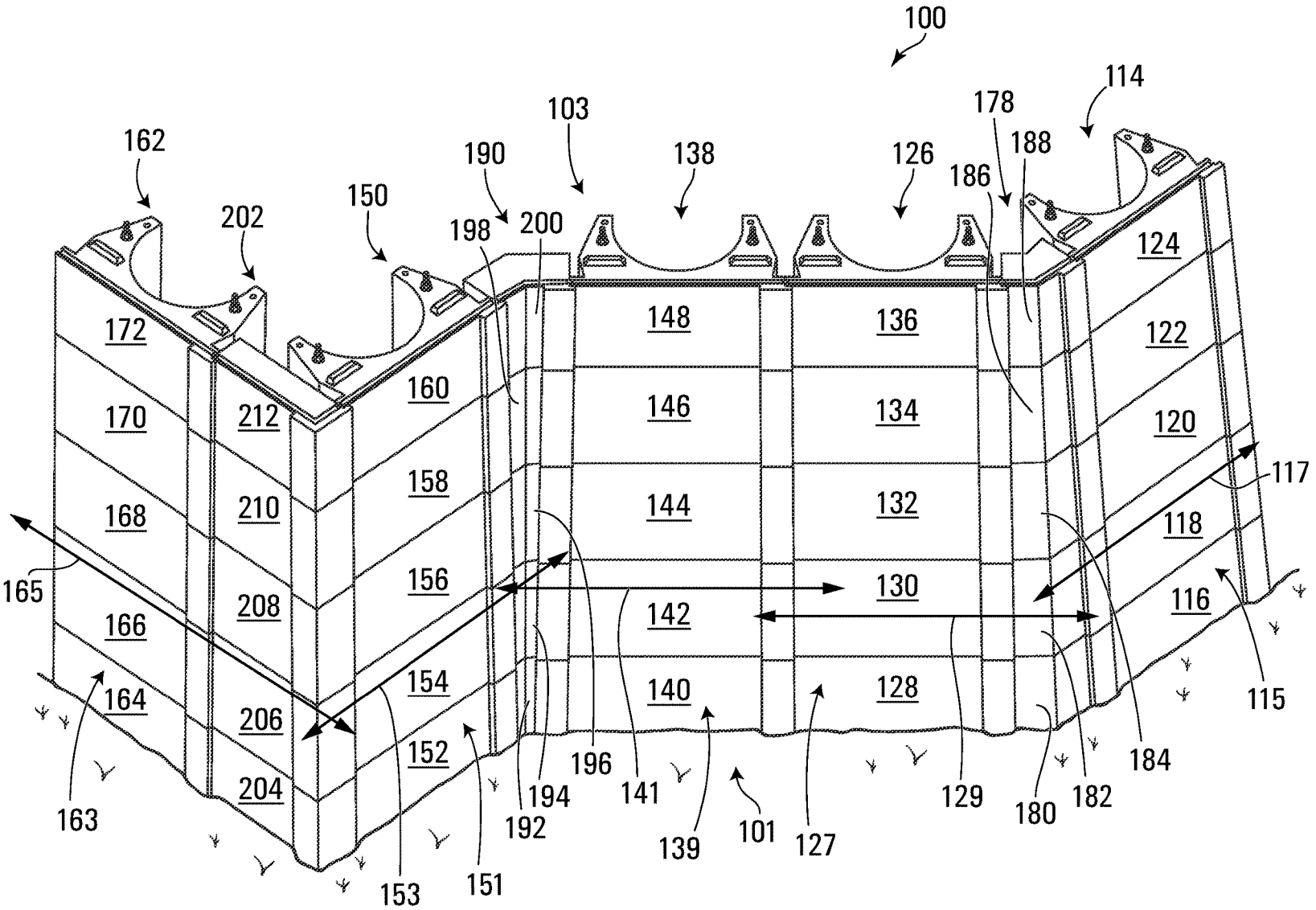
FIG. 1 is a top front perspective view of a retaining wall system according to one embodiment.
Figure 2:
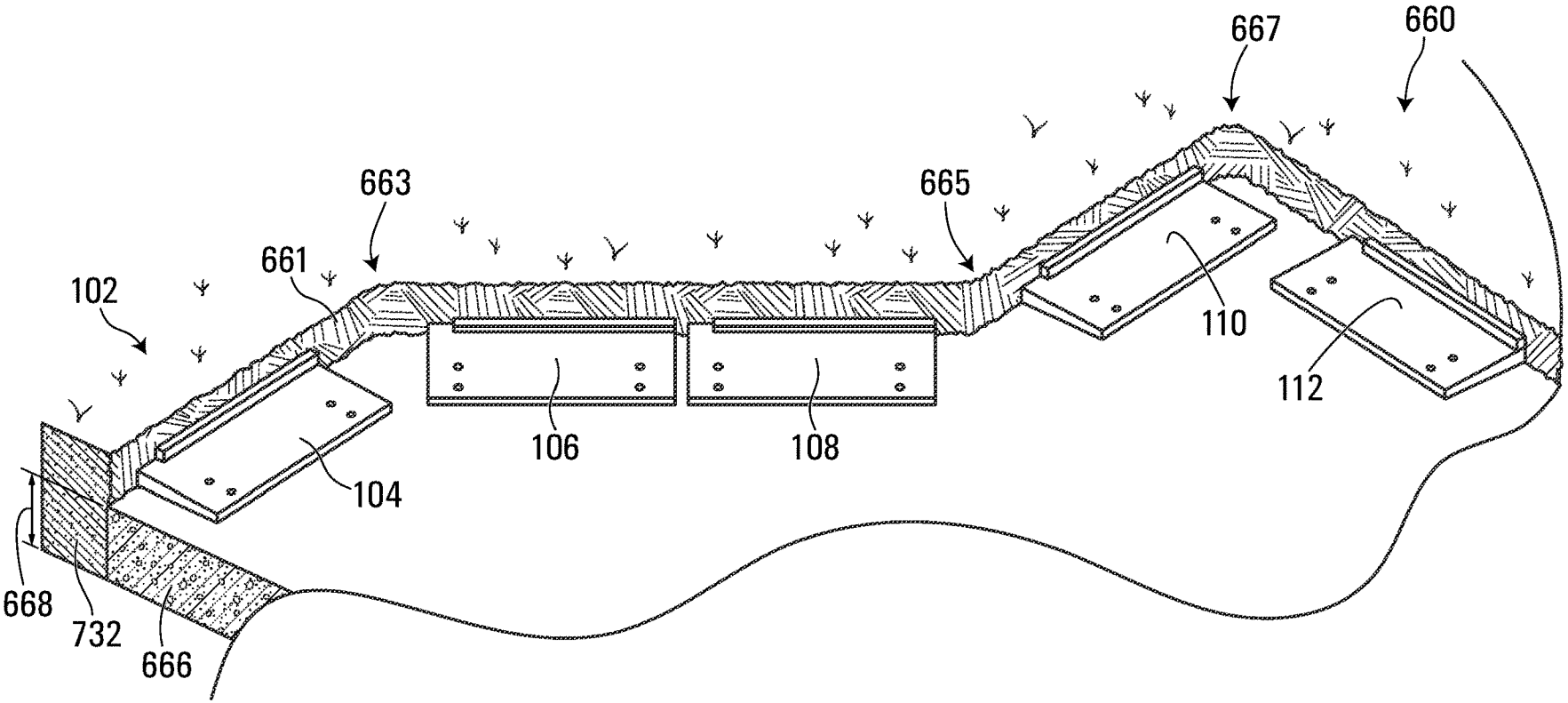
FIG. 2 is a top perspective view illustrating a base of the system of FIG. 1 during a method of constructing the system of FIG. 1.

Referring to FIGS. 1 and 2, a pre-cast modular-block retaining wall system according to one embodiment is shown generally at 100. The system 100 includes a base shown generally at 102 including ground stabilizing base bodies 104, 106, 108, 110, and 112. The system 100 also includes a plurality of wall blocks in a plurality of stacks. The system 100 includes a stack shown generally at 114 of wall blocks 116, 118, 120, 122, and 124 supported by the base body 104, the stack 114 having a non-vertical front face shown generally at 115, the front face 115 extending in a horizontal direction 117. Horizontally adjacent or laterally relative to the stack 114 is a stack shown generally at 126 of wall blocks 128, 130, 132, 134, and 136 supported by the base body 106, the stack 126 having a non-vertical front face shown generally at 127, the front face 127 extending in a horizontal direction 129 that is different from the horizontal direction 117 in the embodiment shown. Horizontally adjacent or laterally relative to the stack 126 on the side opposite from the stack 114 is a stack shown generally at 138 of wall blocks 140, 142, 144, 146, and 148 supported by the base body 108, the stack 138 having a non-vertical front face shown generally at 139, the front face 139 extending in a horizontal direction 141 that is the same as the horizontal direction 129 in the embodiment shown. Laterally relative to the stack 138 on the side opposite from the stack 126 is a stack shown generally at 150 of wall blocks 152, 154, 156, 158, and 160 supported by the base body 110, the stack 150 having a non-vertical front face shown generally at 151, the front face 151 extending in a horizontal direction 153 that is different from the horizontal direction 141 in the embodiment shown. Laterally relative to the stack 150 on the side opposite from the stack 138 is a stack shown generally at 162 of wall blocks 164, 166, 168, 170, and 172 supported by the base body 112, the stack 162 having a non-vertical front face shown generally at 163, the front face 163 extending in a horizontal direction 165 that is different from the horizontal direction 153 in the embodiment shown. The number of stacks in a retaining wall and/or the number of wall blocks in each stack may vary based on a variety of factors, such as the height and/or width of the retaining wall system. Also, the horizontal directions may vary in other embodiments.

The front faces 115, 127, 139, 151, and 163 are inclined increasingly in a direction away from a front side shown generally at 101 of the system 100 with increasing height along the system 100. Such an inclination increasingly away from the front side 101 with increasing height of the system 100 may be referred to as a setback or a batter, and may increase stability of the system 100 by causing the weight of the wall to resist forces from backfill against a rear side shown generally at 103 (and opposite the front side 101) of the system 100.

The system 100 also includes a plurality of joint wall blocks (also referred to as joint blocks) in a plurality of joint stacks positioned between the stack of wall blocks having their respective front faces extending in different horizontal directions. Thus, in the embodiment shown, a stack of joint blocks is shown generally at 178 between the stack 114 and the stack 126, a stack of joint blocks is shown generally at 190 between the stack 138 and the stack 150, and a stack of joint blocks shown generally at 202 between the stack 150 and the stack 162. Due to the setback in the system 100, for the wall block stacks that are laterally relative to one another and with front faces extending in different directions from one another, a respective width between each wall block within the stacks varies monotonically along a height of the stacks of joint blocks. Thus, a width between each wall block in the same row within the pairs of the stacks 114 and 126, 138 and 150, and 150 and 162 varies monotonically along a height of the pair of stacks. The number, shapes, and/or sizes of joint block stacks may vary based on the number of turns (or pivots) in a retaining wall system as determined by the terrain conditions to be supported. In some embodiments, such joint blocks may be omitted.

As shown in the embodiment in FIG. 1, an angle on the front side 101 of the system 100 between the front face 139 of the stack 138 and the front face 151 of the stack 150 is less than 180°. Also, the front faces 139 and 151 incline increasingly in a direction away from the front side 101 of the system 100 with increasing height along each respective stack. Thus, a respective width between each of the wall blocks in the same row within the stack 138 and the stack 150 increases with increasing height along the system 100. In other words, a width between the bottom-most wall blocks 140 and 152 is less than a width (at a greater height along the system 100) between the wall block 142 and the wall block 154, and the width between the wall block 142 and the wall block 154 is less than at width (at an even greater height along system 100) between the wall block 144 and the wall block 156 and so on. In order to accommodate the varying width between the stacks 138 and 150, the width of the stack 190 between stacks 138 and 150 correspondingly increases with increasing height. The stack 190, between the stacks 138 and 150, includes joint blocks 192, 194, 196, 198, and 200 stacked vertically one on top of another. The width of each of the joint blocks 192, 194, 196, 198, and 200 increases monotonically such that a width of the bottom-most joint block 192 is less than a width of the joint block 194, the width of the joint block 194 is less than a width of the joint block 196, the width of the joint block 196 is less than a width of the joint block 198, and the width of the joint block 198 is less than a width of the joint block 200.

An angle on the front side 101 of the system 100 between the front face 115 of the stack 114 and the front face 127 of stack 126 is greater than 180°. Also, the front faces 115 and 127 incline increasingly in a direction away from the front side 101 of the system 100 with increasing height along each respective stack. Thus, a respective width between each of the wall blocks in a row within the stack 114 and the stack 126 decreases with increasing height along the system 100. In other words, a width between the bottom-most wall blocks 116 and 128 is greater than a width (at a greater height along the system 100) between the wall block 118 and the wall block 130, and the width between the wall block 118 and the wall block 130 is greater than a width (at an even greater height along the system 100) between the wall block 120 and the wall block 132 and so on. In order to accommodate the varying width between the stacks 114 and 126, the width of the stack 178 between the stacks 114 and 126 correspondingly decreases with increasing height. The stack 178, between the stacks 114 and 126, includes joint blocks 180, 182, 184, 186, and 188 stacked vertically one on top of another. The width of each of the joint blocks 180, 182, 184, 186, and 188 decreases monotonically such that a width of the bottom-most joint block 180 is greater than a width of the joint block 182, the width of the joint block 182 is greater than a width of the joint block 184, the width of the joint block 184 is greater than a width of the joint block 186, and the width of the joint block 186 is greater than a width of the joint block 188.

An angle on the front side 101 of the system 100 between the front face 151 of the stack 150 and the front face 163 of the stack 162 is about 270°. Also, the front faces 151 and 163 incline increasingly in a direction away from the front side 101 of the system 100 with increasing height along each respective stack. Thus, a respective width between each of the wall blocks in a row within the stack 150 and the stack 162 decreases with increasing height along the system 100. In other words, a width between the bottom-most wall blocks 152 and 164 is greater than a width (at a greater height along the system 100) between the wall blocks 154 and 166, and the width between the wall blocks 154 and 166 is greater than a width (at an even greater height along the system 100) between the wall blocks 156 and 168 and so on. In order to accommodate the varying width between the stacks 150 and 162, the width of the stack 202 between the stacks 150 and 162 correspondingly decreases with increasing height. The stack 202, between the stacks 150 and 162, is composed of the joint blocks 204, 206, 208, 210, and 212 stacked vertically one on top of another. The width of each of the joint blocks 204, 206, 208, 210, and 212 decreases monotonically such that a width of the joint block 204 is greater than a width of the joint block 206, the width of the joint block 206 is greater than a width of the joint block 208, the width of the joint block 208 is greater than a width of the joint block 210, and the width of the joint block 210 is greater than a width of the joint block 212.

Figure 3:
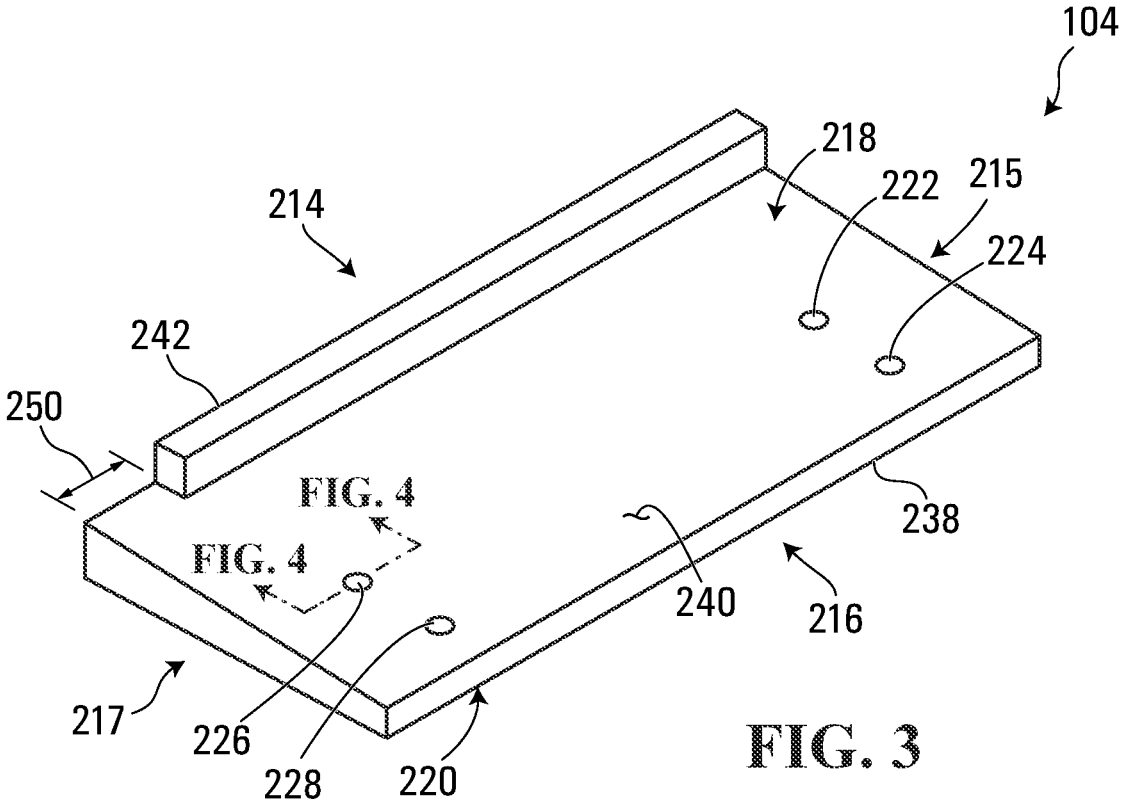
FIG. 3 is a top rear perspective view of a base body of the system of FIG. 1.

At the base 102 of the system 100 are the base bodies 104, 106, 108, 110, and 112 that support the stacks 114, 126, 138, 150, and 162, respectively. Referring to FIG. 3, the base body 104 which supports the stack 114 has a front side shown generally at 214 that corresponds in direction with the front side 101 of the system 100, a rear side shown generally at 216 that corresponds in direction with the rear side 103 of the system 100, a top side shown generally at 218, a bottom side shown generally at 220, a first side shown generally at 215, and a second side shown generally at 217. The base body 104 may be wider at the front side 214 than at the rear side 216 to permit curvature of a front face of a system including multiple such base bodies.

A bottom surface 238 and a top surface 240 are generally planar between the front side 214 and the rear side 216, but the top surface 240 of the base body 104 gradually slopes downward from the front side 214 to the rear side 216. Such a gradual slope may provide the batter or setback as described above. The size and shape of the base body may vary based on a number of factors, such as the size and shape of the wall blocks, the overall height and/or weight of a stack of wall blocks supported by the base body, and/or a desired degree of batter or setback, for example.

On the front side 214 of the base body 104 is a generally rectangular retaining projection 242 on the top surface 240 with a space 250 between the projection 242 and the second side 217 of the base body 104.

On the top surface 240 of the base body 104 are a pair of spaced-apart frontward openings 222 and 226 and a pair of spaced-apart rearward openings 224 and 228 rearward of the frontward openings 222 and 226 towards the rear side 216. Each of the frontward openings 222 and 226 and the rearward openings 224 and 228 extends into but not through the base body 104 between the top surface 240 and the bottom surface 238.

Figure 4:
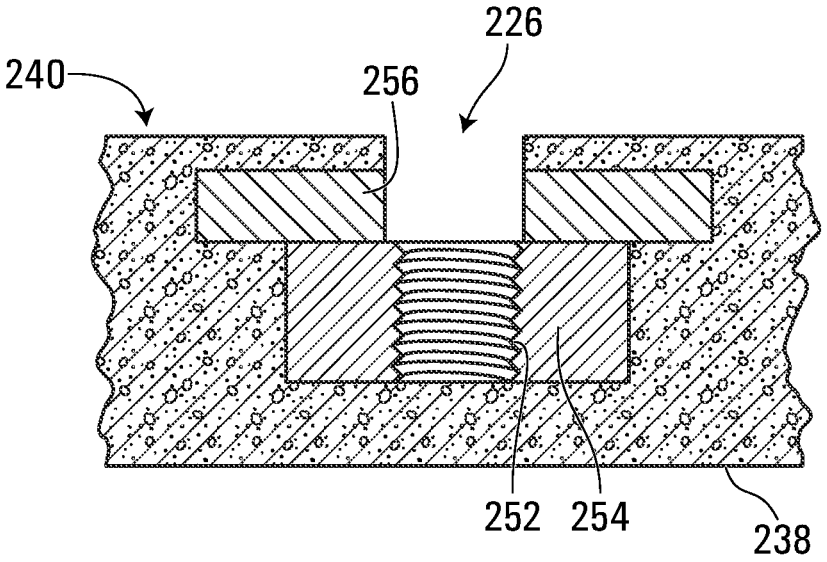

Referring to FIG. 4, the frontward opening 226 extends through the top surface 240 of the base body 104 towards the bottom surface 238, and is circumferentially encompassed by a washer 256 embedded within the base body 104 and reinforcing a nut or other fastener 254 defining a threaded opening 252 open to the frontward opening 226 to receive a threaded fastener from the top side 218 of the base body 104. The size dimensions of the frontward and rearward openings may vary depending on a variety of factors, such as the size and shape of the wall blocks and the size and shape of the base body, for example.

Figure 5:
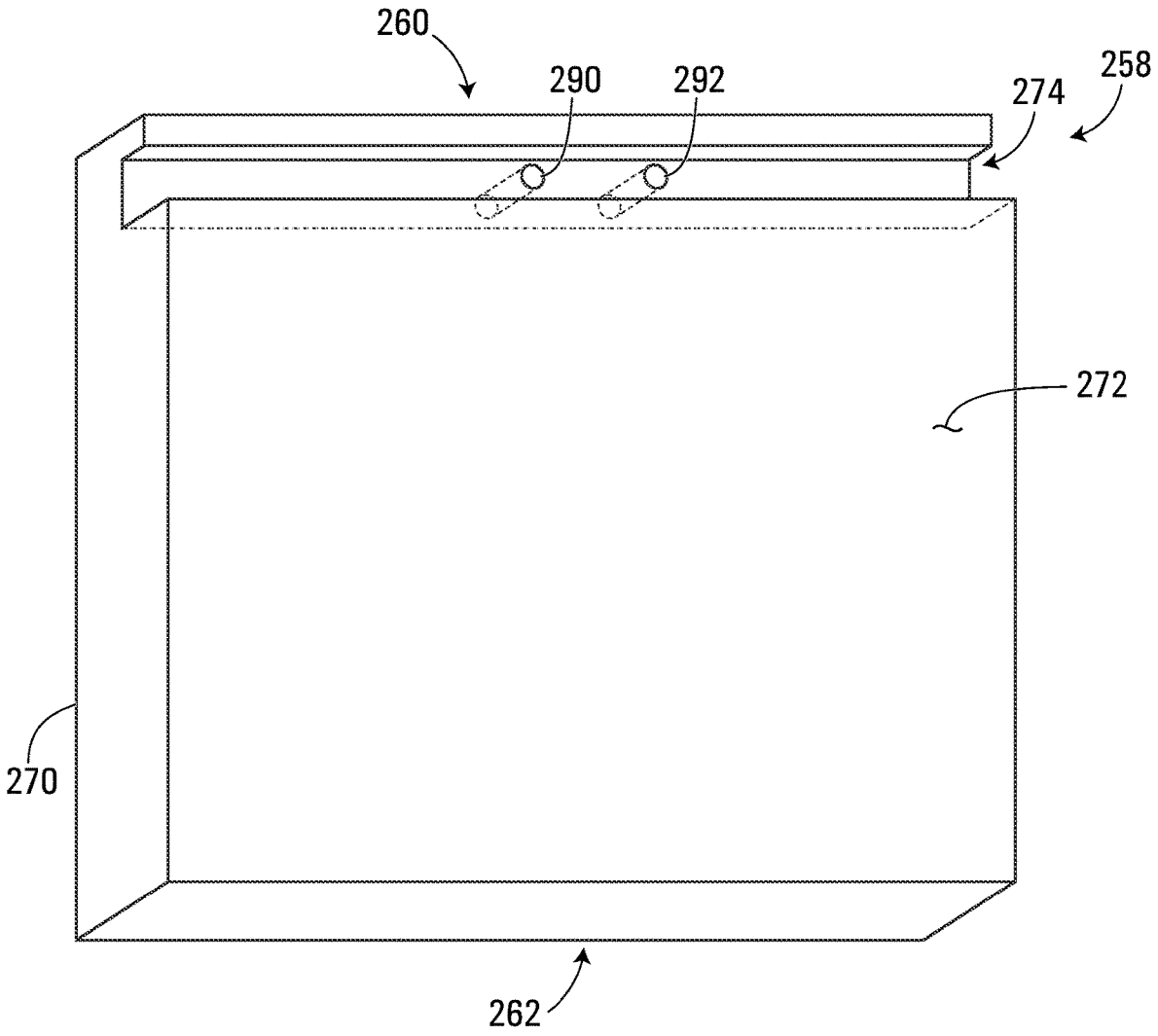
FIG. 5 is a bottom perspective view of an extension body of the system of FIG. 1.

Referring to FIG. 5, a rearward extension body shown generally at 258 may have a generally rectangular shape. Formed separately from the base body 104, the extension body 258 has a front side shown generally at 260 and a rear side shown generally at 262 and may be attached to the rear side 216 of the base body 104. The extension body 258 has a top surface 270 and a bottom surface 272, with a channel shown generally at 274 in the bottom surface 272 and towards the front side 260 extending along the width of the extension body 258. A pair of through-openings 290 and 292, positioned in the middle of the channel 274, extend from within the channel 274 to the top surface 270 to receive a fastener. The dimensions of the extension body 258 may vary depending on many factors, such as the height of the retaining wall for example. In some embodiments, an extension body may not be present in a system.

Figure 6:
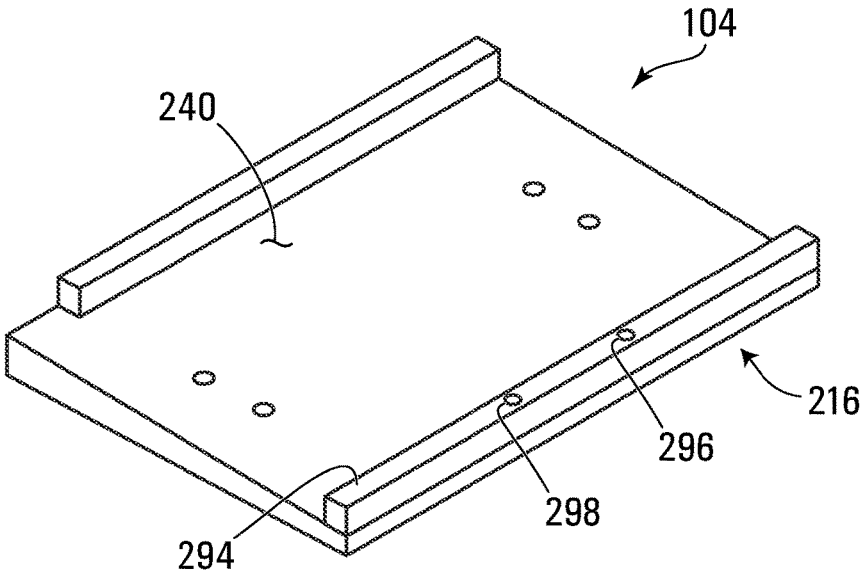
FIG. 6 is a top rear perspective view of the base body of the system of FIG. 1, further illustrating the method of constructing the system of FIG. 1.
Figure 7:
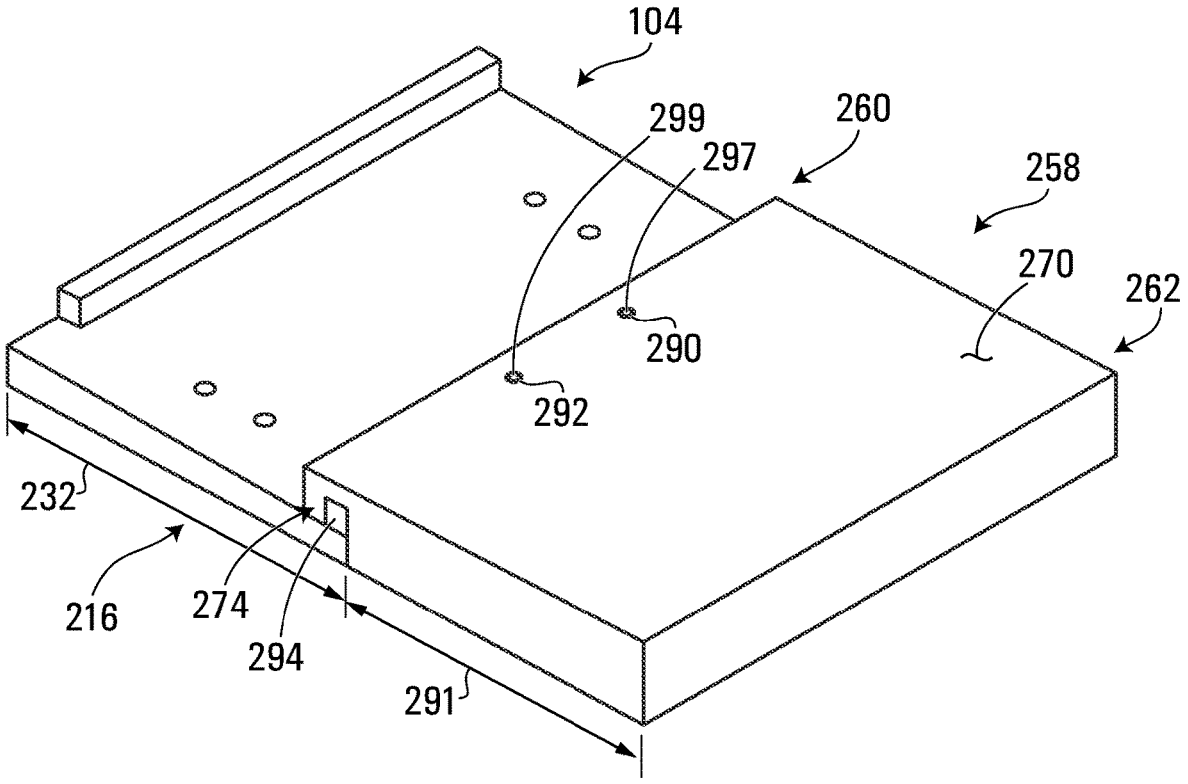
FIG. 7 is a top rear perspective view of the base body of the system of FIG. 1, further illustrating the method of constructing the system of FIG. 1.

Referring to FIGS. 6 and 7, on the rear side 216 of the base body 104, an extension body attachment 294 may have a generally rectangular shape that generally spans across a width of the base body 104 and couples the extension body 258 with the base body 104. The extension body attachment 294 attaches to the rear side 216 of the base body 104. The extension body attachment 294 is capable of insertion into the channel 274 of the extension body, and has through-openings 296 and 298 that align with the through-openings 290 and 292, respectively, on the extension body 258.

The extension body 258 may fit on top of the extension body attachment 294, with the channel 274 of the extension body 258 fitting over top of the extension body attachment 294 aligning the through-openings 290 and 292 of the extension body 258 with the through-openings 296 and 298 of the extension body attachment 294. Fasteners 297 and 299 may be received into the respective through-openings 296 and 298 of the extension body attachment 294, and the respective through-openings 290 and 292 of the extension body 258, to attach the extension body 258 and the extension body attachment 294 to the top surface 240 of the base body 104. Thus, when attached onto the base body 104, the extension body 258 adds a rearwardly extending length 291 to a length 232 of the base body 104.

The base bodies 104, 106, 108, 110, and 112 may be similar to the base body 104.

Figure 8:
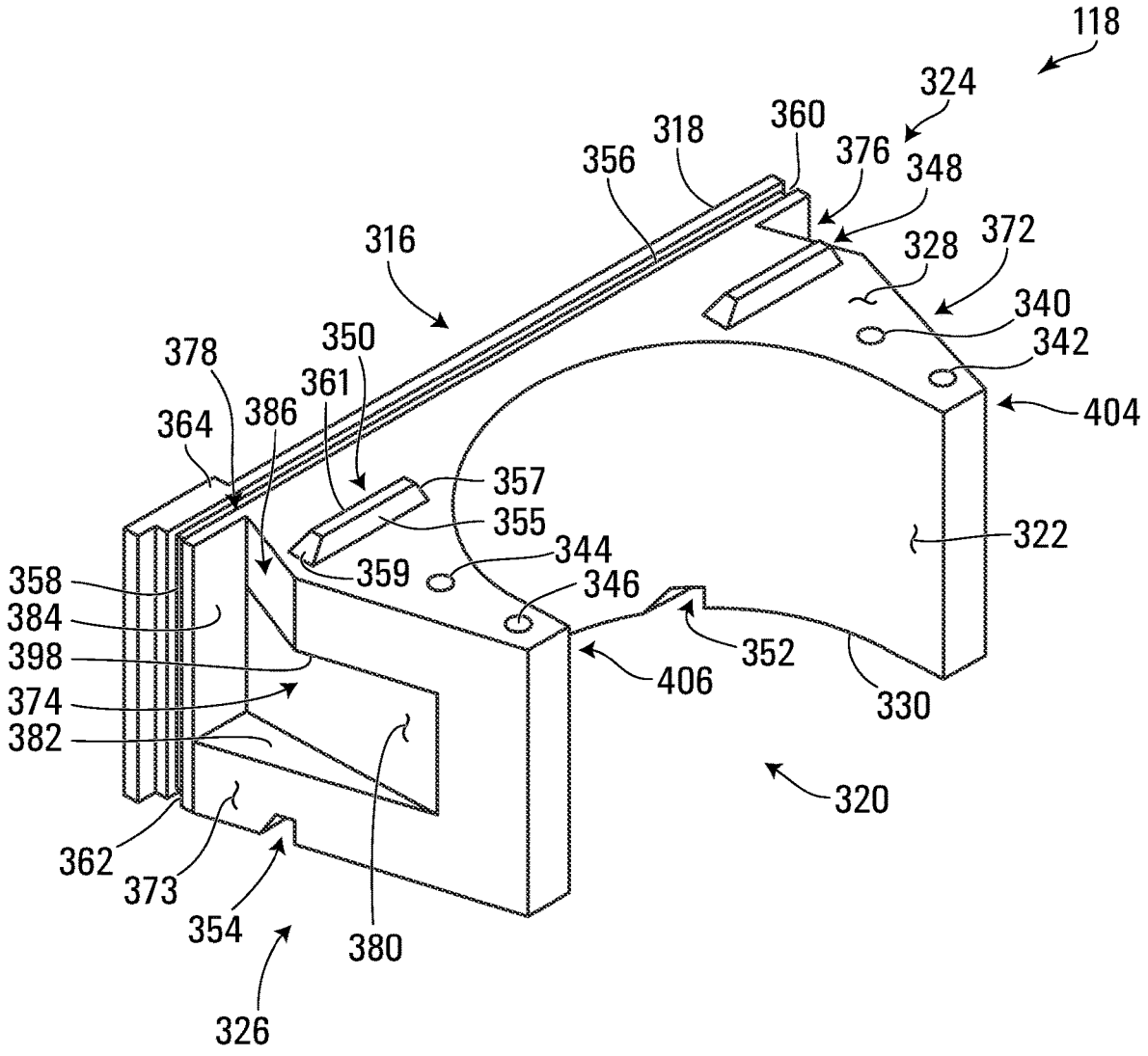
FIG. 8 is a top rear perspective view of an attachment wall block of the system of FIG. 1.
Figure 9:
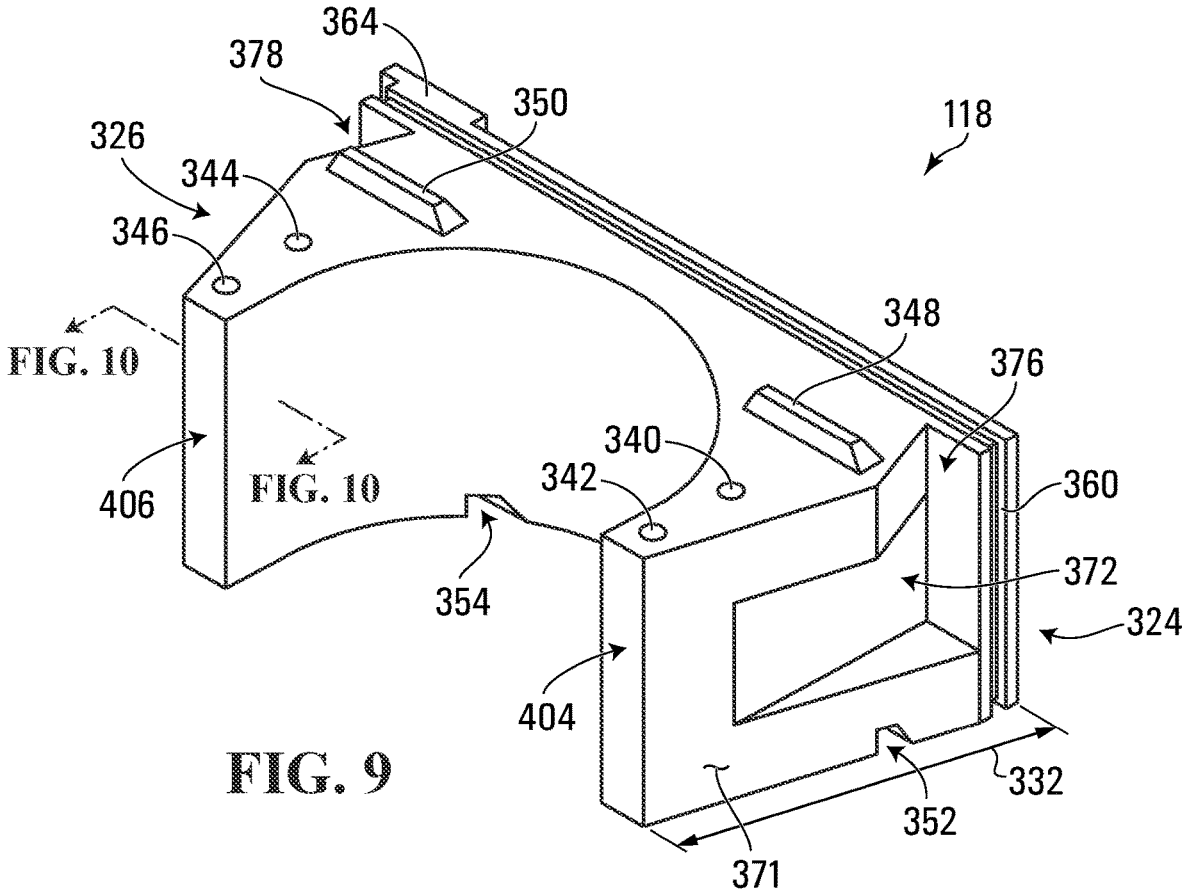
FIG. 9 is a top rear perspective view from an opposite side of the attachment block of FIG. 8.

Supported by the base body 104 is the stack 114 that includes the wall block 116 on top of the base body 104, the wall block 118 on top of the wall block 116, the wall block 120 on top of the wall block 118, the wall block 122 on top of the wall block 120, and the wall block 124 on top of the wall block 122, all in vertical assembly. Referring to FIGS. 8 and 9, the wall block 118, situated above the wall block 116 and below the wall block 120 in the stack 114, has a front side shown generally at 316 that corresponds in direction with the front side 214 of the base body 104 and the front side 101 of the system 100, a rear side shown generally at 320, a first side shown generally at 324, and a second side shown generally at 326 opposite from the first side 324. On the front side 316, the wall block 118 has a front face 318 with a planar surface that includes an overhang 364 towards the second side 326 that is integrated with the front face 318. The overhang 364 extends past a second side surface 373 of the wall block 118. The wall 118 has a rearward portion extending rearward from the front face 318 to a rearward length (or rearward distance) 332. On the rear side 320, the wall block 118 has a rear surface 322 opposite from the front face 318 that is curved inward towards the front face 318, defining a pair of rearward projections on opposite lateral sides shown generally at 404 and 406 that extend to the rearward length 332 on the rear side 320. Thus, the rear surface 322 curves between the projections 404 and 406. The respective features on the first side 324 and the second side 326 of the wall block 118 are generally similar.

On the front side 316 of the wall block 118 are channel-like grooves 356, 358, 360, and 362 extending across the surfaces of the wall block 118 in parallel configuration with and immediately rearward from the front face 318. The groove 356 extends horizontally across the entire width on the wall block 118 on a top surface 328 between a first side surface 371 and the second side surface 373 opposite the first side 371. Opposite from the groove 356, the groove 362 extends horizontally across the entire width of the wall block 118 on the bottom surface 330 between the first side surface 371 and the second side surface 373. On the first side 324, the groove 360 extends vertically along the entire height of the wall block 118 on the side surface 371 between the top surface 328 and the bottom surface 330. On the second side 326, the groove 358, opposite from the groove 360, extends vertically along the entire height of the wall block 118 on the second side surface 373 between the top surface 328 and the bottom surface 330.

The overhang 364 extends past the groove 358 and forms a barrier in front of the groove 358. In the embodiment shown, the front side 316 may be wider than the rear side 320 of the wall block 118 to permit curvature of the front face of the system 100. Thus, the first side 324 and the second side 326 of the wall block 118 may incline gradually inward from the front side 316 to the rear side 320.

The top surface 328 of the wall block 118 includes a pair of alignment protrusions shown generally at 348 and 350 positioned towards the first side 324 and the second side 326, respectively, and are generally similar in size and shape. The alignment protrusion 350 is elongated in shape having a slightly larger width at the bottom than at the top; thus the protrusion 350 tapers slightly inward from the bottom to the top. A rear surface 355 of the protrusion 350 is generally vertical, while a front surface 361, a first side surface 357, and a second side surface 359 are non-vertically inclined as they taper inward towards the top. The bottom surface 330 also includes a pair of alignment indentations 352 and 354 positioned towards the first side 324 and the second side 326, respectively, and are generally similar in size and shape. The alignment indentations 352 and 354, complementary in shape to the alignment protrusions 348 and 350, are positioned to align with and fit over top of a pair of alignment protrusions (similar in size and shape to alignment protrusions 348 and 350) positioned on a top surface of the wall block 116 below the wall block 118. The alignment protrusions 348 and 350 are positioned to align with and insert into a pair of alignment indentations (similar in size and shape to the alignment indentations 352 and 354) positioned on a bottom surface of the wall block 120 above the wall block 118. Alignment protrusions and alignment indentations may be present on all the wall blocks in the system 100 and allow proper alignment of the wall blocks in each stack. Proper alignment may reduce movement and shifting of the wall blocks within the system 100 to provide better overall stability of the system 100.

The wall block 118 also has a pair of receptacles shown generally at 372 and 374 on the first side 324 and the second side 326, respectively, and are generally similar in size and shape. The receptacles 372 and 374 each have slots shown generally at 376 and 378, respectively, that open into the cavities of receptacles 372 and 374 from the top surface of the wall block 118, and are similar in size and shape. The slot 378 is positioned rearward of the groove 356 and opens into the frontward end of the cavity of the receptacle 374. The slot 378 and the receptacle 374 are defined at their front end by a rearward facing wall 384. The wall 384 extends horizontally from the second side surface 373 inward and extends vertically from the top surface 328 downward. The slot 378 is also defined by an inclined side wall 386 extending rearward from an inner edge of the wall 384 out to the second side surface 373. The receptacle 374 is also defined by an inclined, side-facing wall 380 extending rearward from an inner edge of the wall 384 out to the second side surface 373. A top portion of the receptacle 374 is defined by a wall 398 and a bottom portion is defined by a wall 382.

The projections 404 and 406 of the wall block 118 have a pair of frontward through-openings 340 and 344 extending from the top surface 328 to the bottom surface 330 and located rearward of the alignment protrusion 348 and 350, respectively. The projections 404 and 406 also have a pair of rearward through-openings 342 and 346 located rearward from the frontward through-openings 340 and 344, respectively. The rearward through-openings 342 and 346 extend from the top surface 328 to the bottom surface 330 of the wall block 118. In the embodiment shown, the size and shape of the frontward through-openings 340 and 344 and the rearward through-openings 342 and 346 are generally similar.

Figure 10:
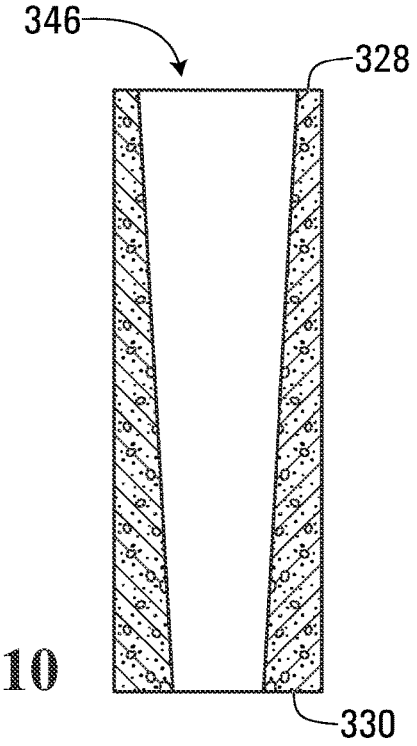
FIG. 10 is a cross-sectional view of the wall block of FIG. 9 taken along the line 10-10 in FIG. 9.

Referring to FIG. 10, the rearward through-opening 346 tapers in a downward direction from the top surface 328 to the bottom surface 330 of the wall block 118, such that the rearward through-opening 346 has a width at the top surface 328 that is larger than a width at the bottom surface 330. In some embodiments, a pair of frontward and rearward through-openings taper in an upward direction from a bottom surface to a top surface of a wall block, such that the pair of frontward and rearward through-openings are wider at the bottom surface than at the top surface.

In the stack 114 of the system 100, the wall blocks 116 and 124 may be similar to the wall block 118. The wall blocks 116, 118, and 124 may be referred to as attachment wall blocks.

Figure 11:
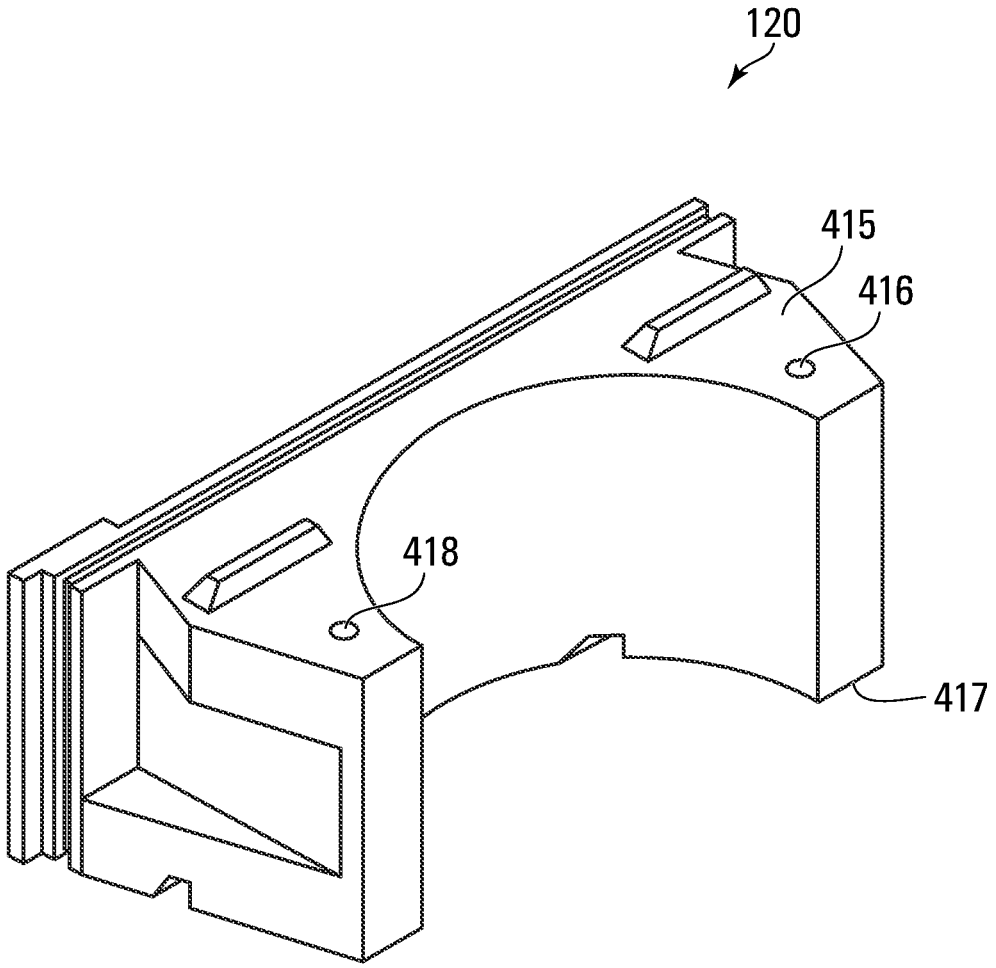
FIG. 11 is a top rear perspective view of a standard wall block of the system of FIG. 1.
Figure 12:
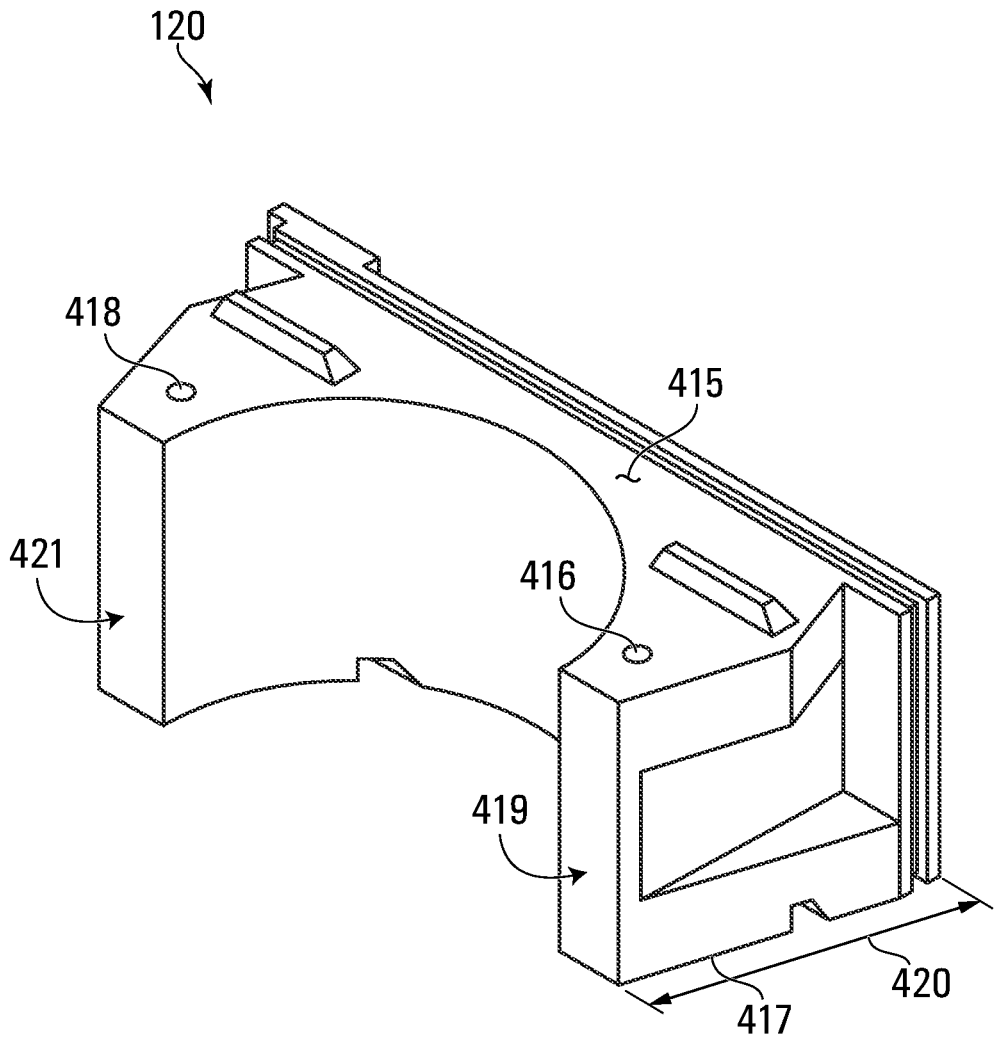
FIG. 12 is a top rear perspective view from an opposite side of the standard wall block of FIG. 11.

Referring to FIGS. 11 and 12, the wall block 120, positioned above the wall block 118 and below the wall block 122, is generally similar to the wall block 118 except that the wall block 120 has a pair of rearward projections shown generally at 419 and 421 on opposite lateral sides of the wall block 120 that has only a single pair of through-openings, frontward through-openings 416 and 418, and no rearward through-openings. The projections 419 and 421 of the wall block 120 are shorter in length relative to the corresponding projections 404 and 406 of the wall block 118, and thus a rearward length 420 of the wall block 120 is less than the corresponding rearward length 332 of the wall block 118. The frontward through-openings 416 and 418 of the wall block 120 extend from a top surface 415 to a bottom surface 417.

In the stack 114 of system 100, the wall block 122 may be similar to the wall block 120. The wall blocks 120 and 122 may be referred to as standard wall blocks. The stacks 126, 138, 150, and 162 of the system 100 each include generally similar combinations of attachment and standard wall blocks in similar configurations to the wall blocks in the stack 114.

Figure 13:
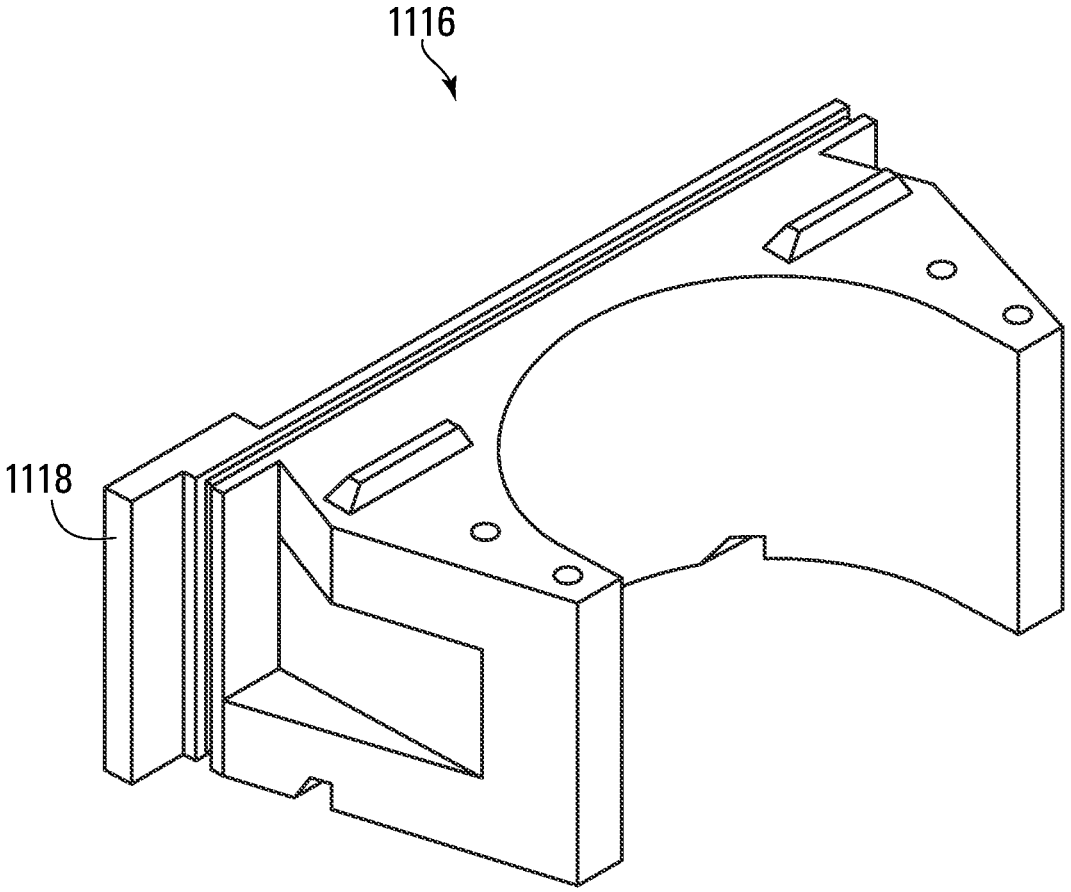
FIG. 13 is a top rear perspective view of an attachment wall block according to another embodiment.

Referring to FIG. 13, in another embodiment, a wall block 1116 includes an overhang 1118 that has a greater width and horizontal depth relative to a width and horizontal depth of the overhang 364 of wall block 118.

Figure 14:
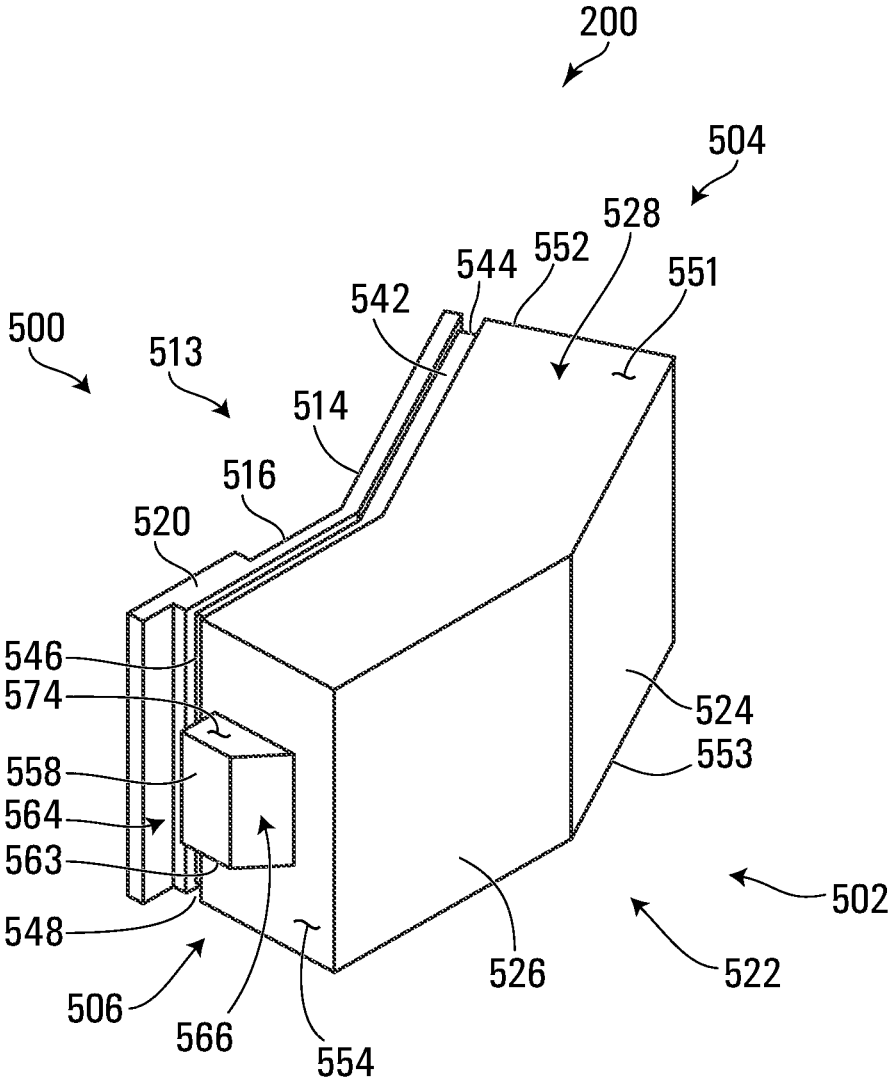
FIG. 14 is a top rear perspective view of a joint block of the system of FIG. 1.
Figure 15:
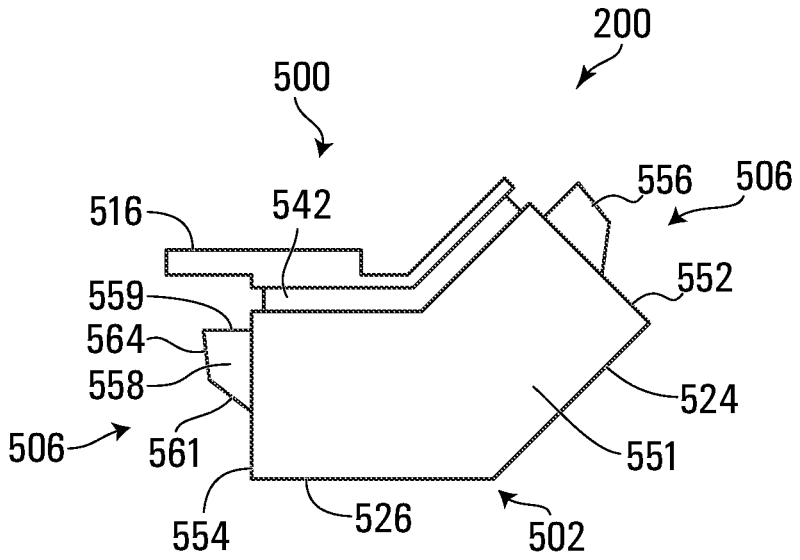
FIG. 15 is a top plan view of the joint block of FIG. 15.

The joint stack 190, between the stacks 138 and 150, include the joint blocks 192, 194, 196, 198, and 200 in vertical assembly that increase monotonically in width from the bottom-most joint block 192 at the base 102 to the joint block 200 at the top of the joint stack 190. Other than width, the joint blocks 192, 194, 196, 198, and 200 are generally similar. Referring to FIGS. 14 and 15, the joint block 200 has a front side shown generally at 500 that corresponds in direction with the front side 101 of the system 100, a rear side shown generally at 502, a first side shown generally at 504, and a second side shown generally at 506. The joint block 200 has a front face shown generally at 513 on the front side 500 and a rearward portion 528 extending rearward from the front face 513 to a rear face shown generally at 522.

The front face 513 of the joint block 200 has an overall concave shape, having a first front face 514 and a second font face 516 adjacent to the first front face 514 that each extend in a horizontal direction slightly inward towards one another. The second front face 516 includes an overhang 520 adjacent to and integrated with the second front face 516 that extends past a second side surface 554 of the joint block 200.

The joint block 200 also includes channel-like grooves on its surfaces. Grooves 542, 544, 546, and 548 extend across the surfaces of the joint block 200 in parallel configuration with and immediately rearward from the front face 513. The groove 542 extends horizontally across the entire width of the joint block 200 on a top surface 551 between a first side surface 552 and the second side surface 554. On an opposite side from the groove 542, the groove 548 extends horizontally across the entire width of a bottom surface 553 between the first side surface 552 and the second side surface 554. On the first side 504, the groove 544 extends vertically along the entire height of the joint block 200 on the first side surface 552 between the top surface 551 and the bottom surface 553. Opposite from the first side 504, on the second side 506 the groove 546 extends vertically along the entire height of the second side surface 554 between the top surface 551 and the bottom surface 553.

The joint block 200 also includes side protrusions 556 and 558 located on the first side surface 552 and the second side surface 554, respectively, and are generally similar. The side protrusion 558 has a generally cube-like shape, with a horizontally planar top surface 574 and a bottom surface 563 parallel and opposite from the top surface 574. The side protrusion 558 also has a front-facing surface 559 and a rear surface 561 on an opposite side from the front-facing surface 559. While the front-facing surface 559 is generally parallel with the second front face 516 of the joint block 200, the rear surface 561 is non-parallel to the front facing surface 559, inclining outward in a rearward direction. A side surface 564 has a slight downward incline in a rearward direction.

The side protrusion 558 is located rearward from the groove 546, located on the rearward portion 528 of the joint block 200. The side protrusion 558 is generally vertically centered on the second side surface 554, and horizontally positioned slightly off center and closer to the front side 500 of the joint block 200. The side protrusion 558 is shaped and positioned on the second side surface 554 to permit a receptacle (generally similar to the receptacle 374 of the wall block 118 discussed above), located on a first side surface of the wall block 148 that faces the second side surface 554 of the joint block 200, to receive the side protrusion 558.

The rear face 522, opposite the front face 513 of the joint block 200, has an overall convex shape having a first rear face 524 and a second rear face 526 adjacent the first rear face 524 that each extend horizontally in a slightly outward direction.

Figure 16:
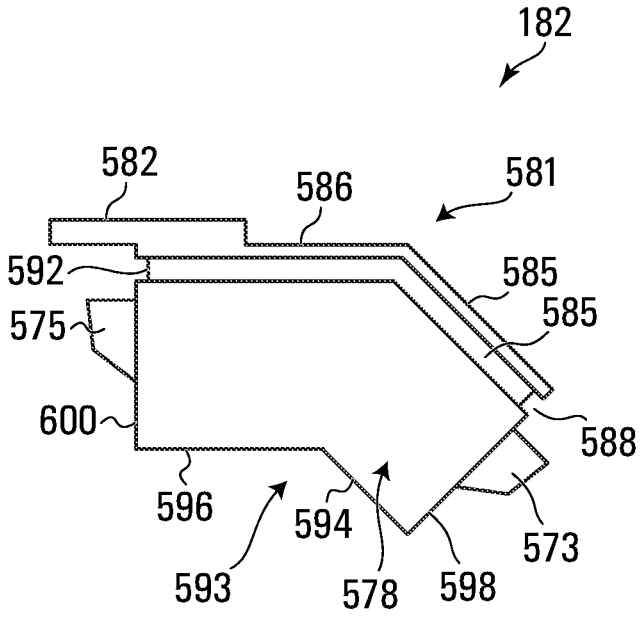
FIG. 16 is a top plan view of a joint block of the system of FIG. 1.

The joint stack 178, between the stacks 114 and 126, includes the joint blocks 180, 182, 184, 186, and 188 in vertical assembly, that decrease monotonically in width from the bottom-most joint block 180 at the base 102 to the joint block 188 at the top of the joint stack 178. Other than width, the joint blocks 180, 182, 184, 186, and 188 are generally similar. Referring to FIG. 16, the joint block 182 has a front face shown generally at 581, a rear face shown generally at 593, and a rearward portion shown generally at 578. The front face 581 of the joint block 182 has an overall convex shape, having a first front face 584 and a second font face 586 adjacent to the first front face 584 that each extend horizontally in a slightly outward direction from one another. The second front face 586 also includes an overhang 582 adjacent to and integrated with the second front face 586 that extends past a second side surface 600 of the joint block 182.

The joint block 182 also includes channel-like grooves rearward from and in parallel configuration to the front face 581, extending all the way across its surfaces. The joint block 182 has a groove 585 on a top surface, a groove 589 on a bottom surface opposite from the top surface, a groove 588 on a first side surface 598, and a groove 592 on a second side surface 600 opposite from the groove 588. The joint block 182 also includes side protrusions 573 and 575 located on the first side surface 598 and the second side surface 600, respectively.

The rear face 593 opposite from the front face 581, has an overall concave shape. A first rear face 594 and a second rear face 596 adjacent the first rear face 524 each extend horizontally in a slightly inward direction towards one another.

Figure 17:
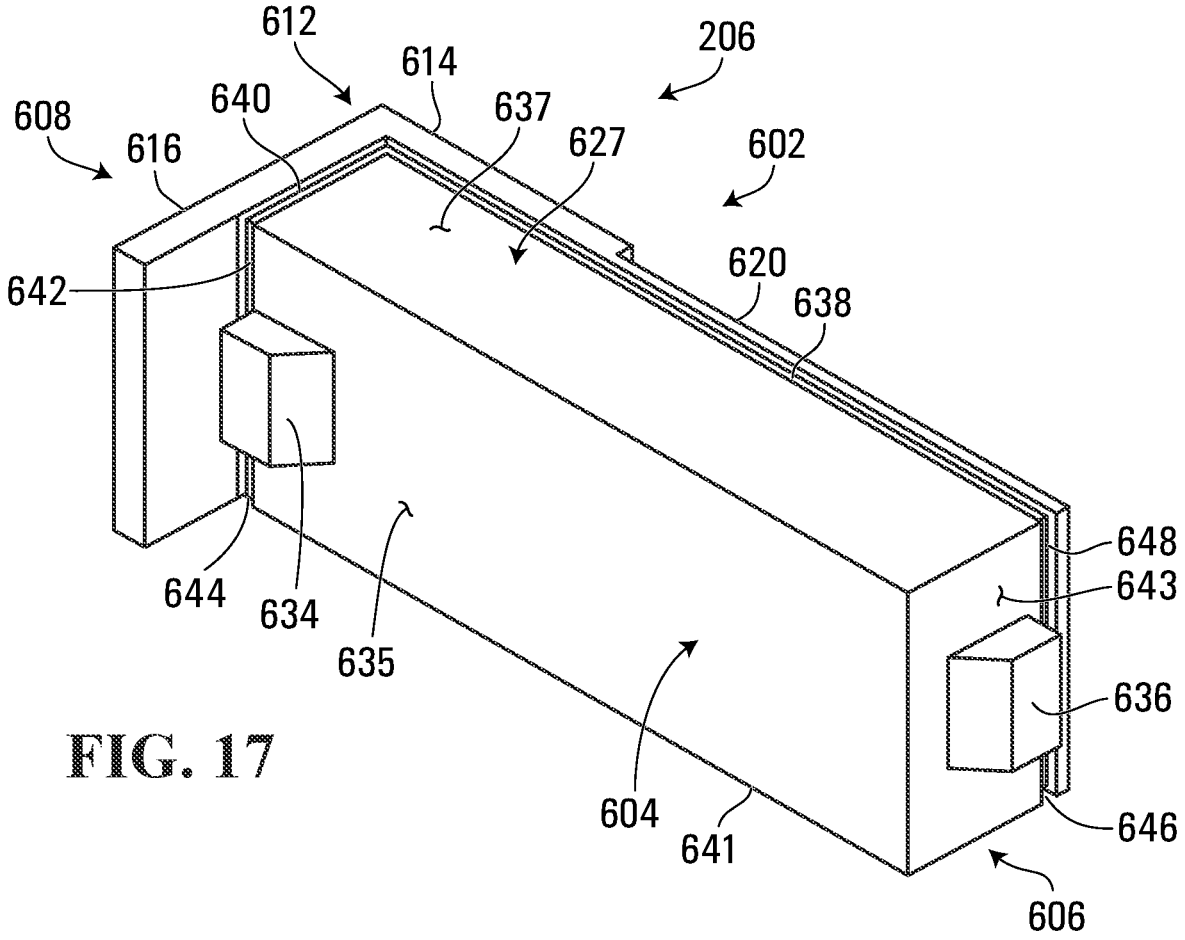
FIG. 17 is a top rear perspective view of a joint block of the system of FIG. 1.

The joint stack 202, between the stacks 150 and 162, include the joint blocks 204, 206, 208, 210, and 212, that decrease monotonically in width from the bottom-most joint block 204 at the base 102 to the joint block 212 at the top of the joint stack 202. Other than width, the joint blocks 204, 206, 208, 210, and 212 are generally similar. Referring to FIG. 17, the joint block 206 has a front side shown generally at 602, a rear side shown generally at 604, a first side shown generally at 606, and a second side shown generally at 608. The front side 602 has a generally planar front face 620, along with an overhang shown generally at 612. Rearward from the front face 620 is a rearward portion shown generally at 627. The rearward portion 627 has a protrusion 634 on a rear surface 635 located towards the overhang 612 and a protrusion 636 on a side surface 643. The overhang 612 has a first portion 614 that is integrated with and immediately adjacent to the front face 620 towards the second side 608 and a second portion 616 that continues rearward from the first portion 614 along the second side 608, extending rearward past the rear surface 635 of the rearward portion 627.

The joint block 206 also includes channel-like grooves 638, 640, 642, 644, 646, and 648 on the surfaces of joint block 206. The grooves 638 and 646, located on a respective top surface 637 and a respective bottom surface 641, are immediately rearward of and parallel to the front face 620 and the first portion 614 of the overhang 612 extending horizontally across the entire width of the rearward portion 627 of the joint block 206. The groove 648 is on a first side surface 643 and extends vertically between the top surface 637 and the bottom surface 641 and is immediately rearward of the front face 620. Thus, the groove 648 connects between the grooves 638 and 646. The grooves 640 and 644 on the top surface 637 and the bottom surface 641, respectively, are immediately adjacent to and parallel with the second portion 616 of the overhang 620 and extend from immediately rearward of the first portion 614 of the overhang 620 to a rear surface 635 of the rearward portion 627. Thus the groove 640 connects between the groove 638 and the groove 642, while the groove 644 connects between the groove 646 and the groove 642. The groove 642 on the rear surface 635 extends between the top surface 637 and the bottom surface 641 and is positioned between the protrusion 634 and the second portion 616 of the overhang 620. Thus, the groove 642 connects between the grooves 640 and 644. Together, grooves 638, 640, 642, 644, 646, and 648 interconnect in a continuous manner on the surfaces of the joint block 206.

The grooves in the joint blocks within a stack of joint blocks and the grooves in the wall blocks within a stack of wall blocks in system 100 comprise sealing material positioned within the grooves that restrict fluid flow through the system 100. The sealing material may be any fluid resistant material (such as rubber gaskets, for example). The sealing material may also provide better grip and a tighter fit between the joint and/or wall blocks, thus reducing shifting of the blocks within the system 100.

Figure 18:
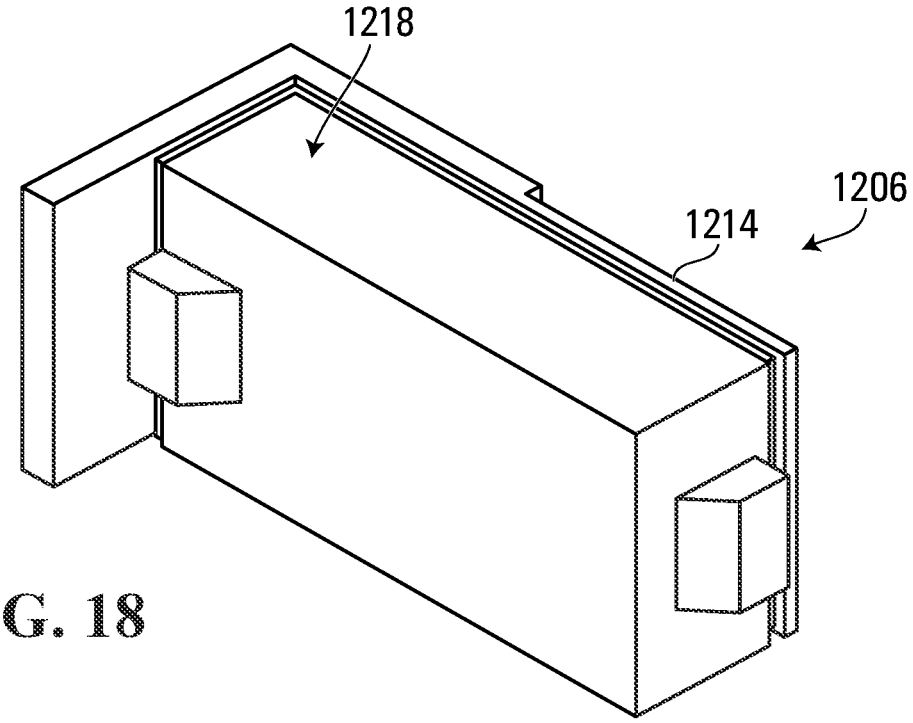
FIG. 18 is a top rear perspective view of a joint block according to another embodiment.

Referring to FIG. 18, in some embodiments, a joint block 1206 has a front face 1214 and a rearward portion shown generally at 1218 having less of a width than the front face 620 and the rearward portion 627 of the joint block 206.

Figure 19:
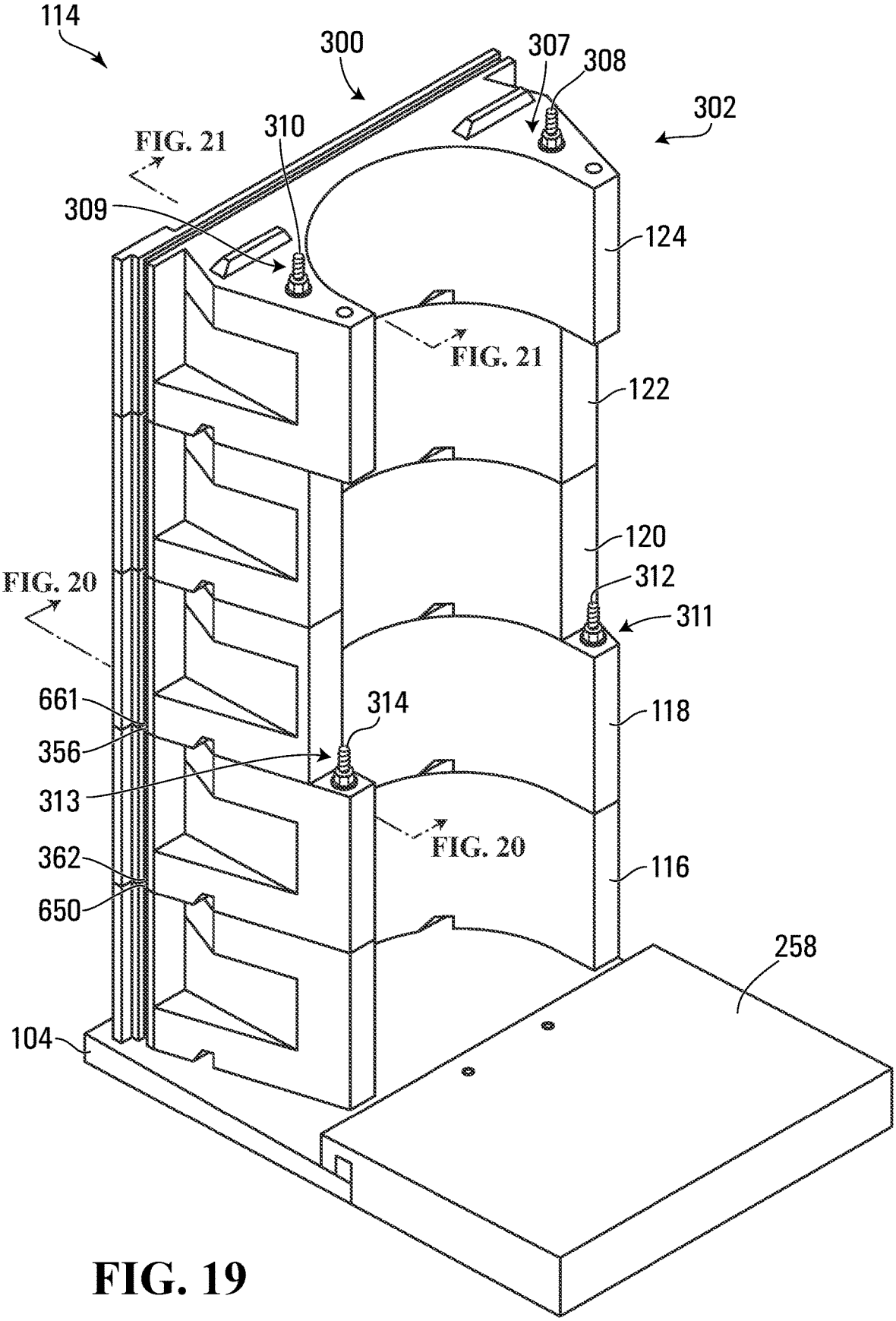
FIG. 19 is a top rear perspective view of a stack of wall blocks of the system of FIG. 1.

Referring to FIG. 19, the stack 114 includes the wall blocks 116, 118, 120, 122, and 124 in vertical assembly attached to the base body 104 and the stack 114 is held in a fixed position relative to the base body 104. The top surfaces of the wall blocks 116, 118, 120, and 122 each have a groove, a pair of alignment protrusions, and one or more pairs of through-openings, that align with or fit into a corresponding groove, a corresponding pair of alignment indentations, and one or more corresponding pairs of through-openings on the bottom surfaces of the wall blocks 118, 120, 122, and 124, respectively. Thus, when the stack 114 is assembled, the groove 362 on the bottom surface of the wall block 118 aligns with a groove 650 on a top surface of the wall block 116, and a groove 356 on a top surface of the wall block 118 aligns with a groove 661 on a bottom surface of the wall block 120.

The alignment indentations 352 and 354 on the bottom surface 330 of the wall block 118 fit over top of a pair of alignment protrusions on the top surface of the wall block 116 located below the wall block 118. Similarly, a pair of alignment indentations on a bottom surface of the wall block 120, located above the wall block 118, fit over top of the alignment protrusions 348 and 350 on the top surface 328 of the wall block 118.

In the stack 114, the wall blocks 116, 118, 120, 122, and 124 each have a pair of rearward projections on opposite lateral sides of the wall block that include a pair of frontward through-openings that each align with one another and the pair of frontward openings 222 and 226 on base body 104. More particularly, the pair of frontward openings 222 and 226 on the base body 104 aligns with a pair of frontward through-openings in the wall block 116. The frontward through-openings of the wall block 116, in turn, align with the frontward through-openings 340 and 344 of the wall block 118 on top of the wall block 116. The frontward through-openings 340 and 344 of the wall block 118, in turn, align with a pair of frontward through-openings 416 and 418 on the wall block 120 stacked on top of the wall block 118 and so on. In this way, when each of the wall blocks in the stack 114 is fully aligned, the frontward through-openings of each wall block collectively open into the frontward opening 222 and 226 and the base body 104, forming a pair of cavities shown generally at 307 and 309 that extend vertically through the stack 114, starting from the frontward openings in base body 104 to the frontward through-openings of the wall block 124.

A pair of tension links 308 and 310 may be positioned inside respective cavities 307 and 309 and serve as a point of attachment for the stack 114 to the base body 104. Each tension link may be a continuous elongated, rod-like shape made of any rigid, tensionable material (such as a metal coil rod, which may be galvanized steel and may be about one inch in diameter, for example) capable of holding the wall blocks 116, 118, 120, 122, and 124 onto the base body 104. The tension links 308 and 310 generally span the entire height of the system 100 and may be fastened at the bottom end of the threaded openings in the frontward openings 222 and 226 and may be fastened at the top onto a top surface of wall block 124 with a fastener nut.

In the stack 114, the pair of rearward projections of the wall blocks 116 and 118 also includes a pair of rearward through-openings that each aligns with one another and with the rearward openings 224 and 228 on the base body 104. More particularly, the pair of rearward openings 224 and 228 on the base body 104 align with a pair of rearward through-openings in the wall block 116. The rearward through-openings of the wall block 116, in turn, align with the rearward through-openings 342 and 346. Thus, the rearward through-openings of the wall block 116 and 118 collectively open into the rearward openings 224 and 228 on the base body 104 forming a pair of cavities shown generally at 311 and 313 that extend vertically through the wall blocks 116 and 118, from the rearward openings 224 and 228 of base body 104 to the rearward through-openings 342 and 346 of the wall block 118. A pair of tension links 312 and 314 may be positioned inside the respective cavities 311 and 313. The tension links 312 and 314 may be fastened at the bottom to the threaded openings in the rearward openings 224 and 228 and may be fastened at the top onto the surface 328 of the wall block 118 with a fastener nut. The tension links 312 and 314 in the rearward through-openings on the wall blocks 116 and 118 may serve as a secondary point of attachment for the stack 114 to the base body 104. Further, the top portion of the tension links 312 and 314 that extend beyond the top surface 328 of the wall block 118 may be inserted into through-openings on or one or more members coupled to a rigid stabilizing body. The members may be attached onto the top surface 328 in the wall block 118 with fastener nuts. Similarly, a pair of tension links may be inserted into the rearward through-openings in the wall block 124 along with one or more members coupled to a rigid stabilizing body. The members may be attached onto the surface of the wall block 124 with fastener nuts.

Referring to FIG. 1, the joint stack 178 includes the joint blocks 180, 182, 184, 186, and 188 in vertical assembly. The top surfaces of the joint blocks 180, 182, 184, and 186 each have a groove that aligns with a corresponding groove on the bottom surfaces of the joint blocks 182, 184, 186, and 188, respectively. Thus, a groove on a bottom surface of the joint block 182 aligns with a groove on a top surface of the joint block 180, and the groove 585 on a top surface of the joint block 182 aligns with a groove on a bottom surface of the joint block 184. Once the joint stack 178 is positioned between the stacks 114 and 126, each of the second side surfaces of the joint blocks 180, 182, 184, 186, and 188 of the stack 178 have a groove and a side protrusion that aligns and couples with a corresponding groove and a corresponding receptacle on each of the first side surfaces of the wall blocks 116, 118, 120, 122, and 124, respectively, of the stack 114. Similarly, each of the first side surfaces of the joint blocks 180, 182, 184, 186, and 188 of the stack 178 have a groove and a side protrusion that aligns and couples with a corresponding groove and a corresponding receptacle on each of the second side surfaces of the wall blocks 128, 130, 132, 134, and 136, respectively, of the stack 126. Thus, the groove 592 on the second side surface 600 of the joint block 182 facing the first side surface 371 of the wall block 118 aligns with the groove 360 on the first side surface 371 of the wall block 118. The side protrusion 575 on the second side surface 600 of the joint block 182 couples with the receptacle 372 on the first side surface 371 of the wall block 118 that receives the side protrusion 575. On the side opposite from the second side surface 600 of the joint block 182, the groove 588 on the first side surface 598 facing a second side surface of the wall block 130 aligns with a groove on the second side surface of the wall block 130. The side protrusion 573 on the first side surface 598 of the joint block 182 couples with a receptacle on the second side surface of the wall block 130 that receives the side protrusion 573. Coupling each of the joint stacks and each of the wall blocks in such a manner permits interconnection between joint blocks and wall blocks across the system 100 and provides greater overall stability to the system 100.

Figure 20:
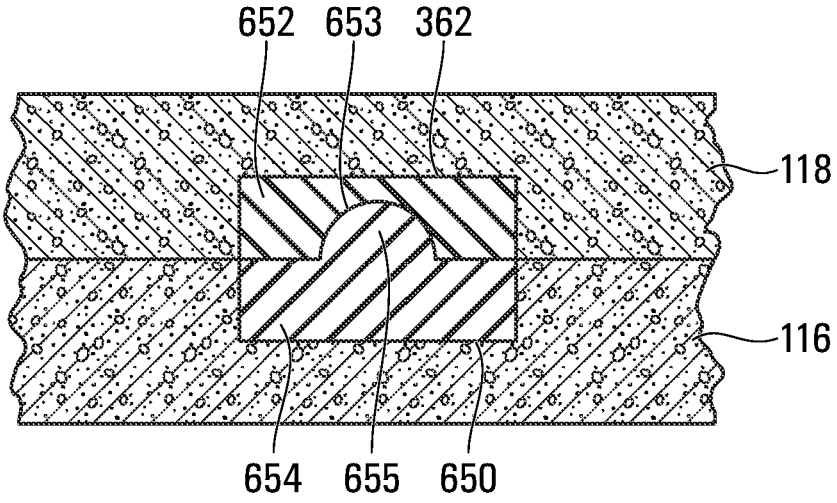
FIG. 20 is a cross-sectional view of the stack of wall blocks of FIG. 19 taken along the line 20-20 in FIG. 19.

Referring to FIG. 20, the groove 362 of wall block 118 and the groove 650 of wall block 116 form a generally rectangular cavity between the wall blocks. The grooves 362 and 650 contain sealing materials 652 and 654, respectively, suitably shaped to fill the cavity formed by the grooves 362 and 650. Sealing materials 652 and 654 face one another and are in contact with one another to restrict fluid flow within the wall blocks 116 and 118 and reduce shifting between the wall blocks 116 and 118. The sealing material 652 of the groove 362 may have a recess 653 on the part of its surface that faces the sealing material 654 and the sealing material 654 may have a projection 655 on the part of its surface that faces the sealing material 652. The recess 653 fits into the projection 655 which receives the recess 653, providing a better seal between sealing materials 652 and 654 and further restricting fluid flow in the system 100.

Figure 21:
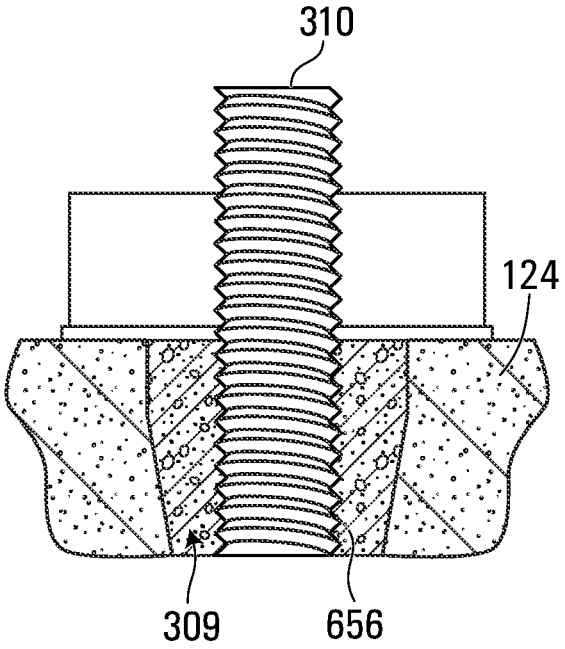
FIG. 21 is a cross-sectional view of the stack of wall blocks of FIG. 19 taken along the line 21-21 in FIG. 19.

The cavities 307, 309, 311, and 313, containing the tension links 308, 310, 312, and 314, respectively, may also contain filler material that encase and harden around the tension links thus reducing movement or shifting of the tension links. Referring to FIG. 21, the space within the cavity 309 that remains unoccupied may be filled with a filler material 656. The filler material 656 encases the tension link 310, fills the cavity 309, and seals off the frontward through-opening of the wall block 124. The filler material may be any material that is suitable to fill the cavity 309 and that hardens once dry (such as concrete or grout, for example). In another embodiment, the top end of a tension link within a through-opening may reach a vertical height up to just below a top surface of a top wall block in a stack (instead of extending past a top surface of a top block in a stack, as shown in other embodiments). In some embodiments, a top portion of a through-opening containing a tension link may include a countersink.

Such filler material may be omitted in some embodiments, for example in embodiments in which the tension links are galvanized. In embodiments in which such filler material is omitted, wall blocks as described herein may define drainage holes extending laterally between bottom ends of through-openings (such as the through-opening 346) and outer surfaces of the wall blocks to allow drainage laterally out of such through-openings.

Figure 22:
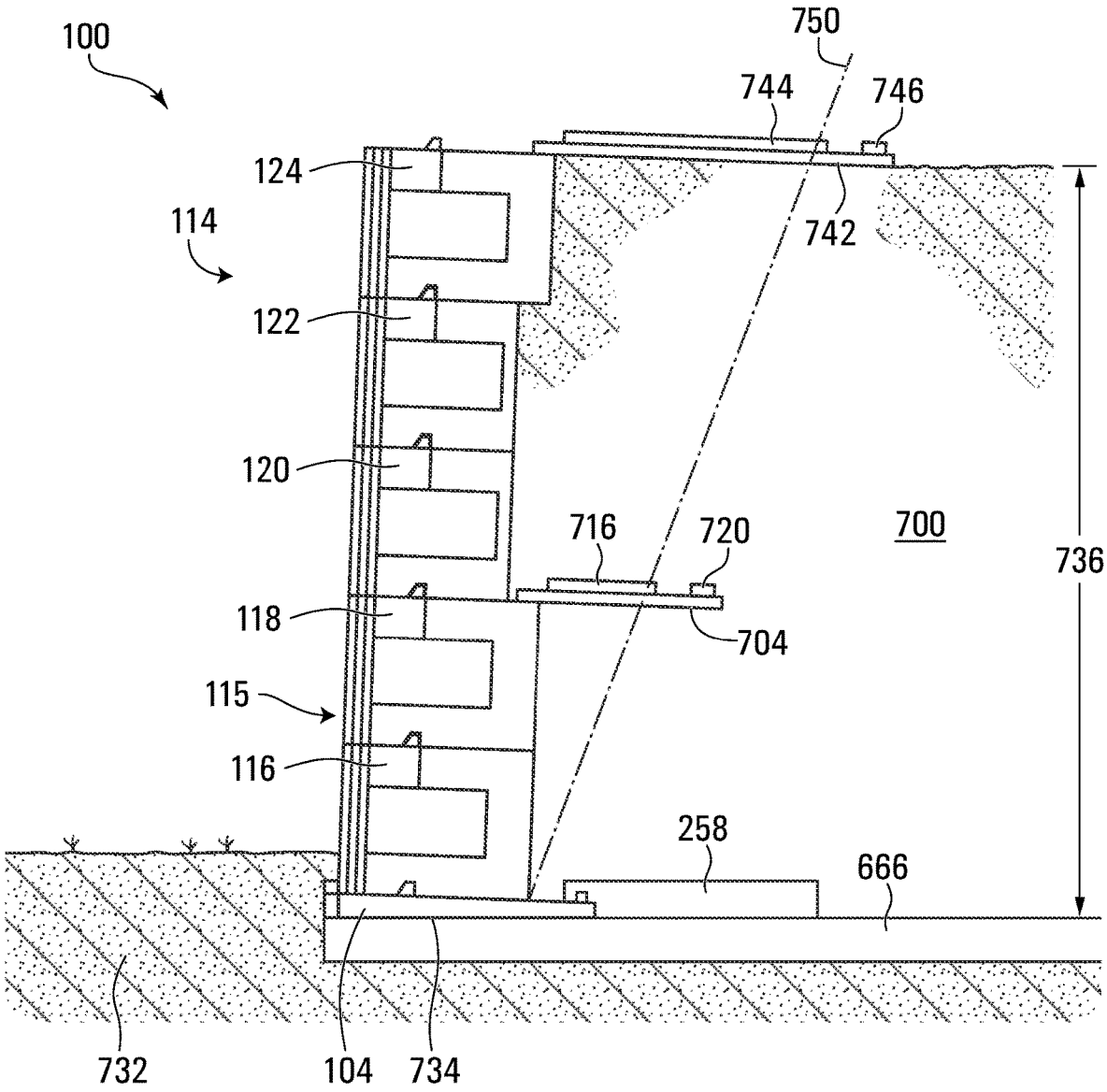
FIG. 22 is a side elevation view of the system of FIG. 1.

Referring to FIG. 22, in the stack 114 the rearward length of each of the wall blocks 116, 118, and 124 is greater than the respective rearward length of the wall blocks 120 and 122. This additional rearward length provides an attachment portion within the rearward projections of the wall blocks 116, 118, and 124 that include the rearward through-openings and thus allows additional attachments at the respective attachment portions in the wall blocks 116, 118, and 124. The attachment portions thus allow the wall blocks 116 and 118 to be additionally attached through tension links 312 and 314 to the base body 104, allow attachment of a rigid stabilizing body 716 to the wall block 118, and allow attachment of a rigid stabilizing body 744 to the wall block 124. On the rear side 103 of the system 100, the backfill 700 may be filled to a height 736 up to a top surface of the wall block 124.

In the embodiment shown, the wall block 124 includes members 740 and 742 extending in a rearward direction from and attached to a top surface of the wall block 124, the rigid stabilizing body 744 attached to a top surface of the members 740 and 742, and a beam 746 attached to and extending transversely to the members 740 and 742, each coupled to a pair of rearward projections of the wall block 124. Similarly, the wall block 118 includes members 702 and 704 extending in a rearward direction from and attached to a top surface of the wall block 118, the rigid stabilizing body 716 attached to a top surface of the members 702 and 704, and a beam 720 attached to and extending transversely to the members 702 and 704, each coupled to the pair of rearward projections 404 and 406 of the wall block 118. The members 702, 704, 740, and 742, the rigid stabilizing bodies 716 and 744, and the beams 720 and 746 each extend past a rupture line 750 of the backfill 700. The rupture line 750 (also known as a failure plane) in the backfill 700 begins approximately at the bottom edge of the backfill 700 against the rear side 103 of the system 100 and slopes at an angle extending away from the rear side 103 of the system 100 with increasing height. Thus the rearward (or horizontal) distance from the system 100 to the rupture line 750 increases at a greater height along the system 100. The angle of the rupture line 750 may vary depending on a variety of factors such as the material composition of the backfill 700 and its moisture content. The rupture line 750 is at a greater rearward distance from the system 100 at a height where the rigid stabilizing body 716 is attached to the wall block 118 compared to a height where the rigid stabilizing body 744 is attached to the wall block 124. Thus, to extend past the rupture line 750, the members 740 and 742 and the rigid stabilizing body 744 have a greater rearward length (or horizontal depth) relative to the members 702 and 704 and the rigid stabilizing body 716, respectively.

Figure 23:
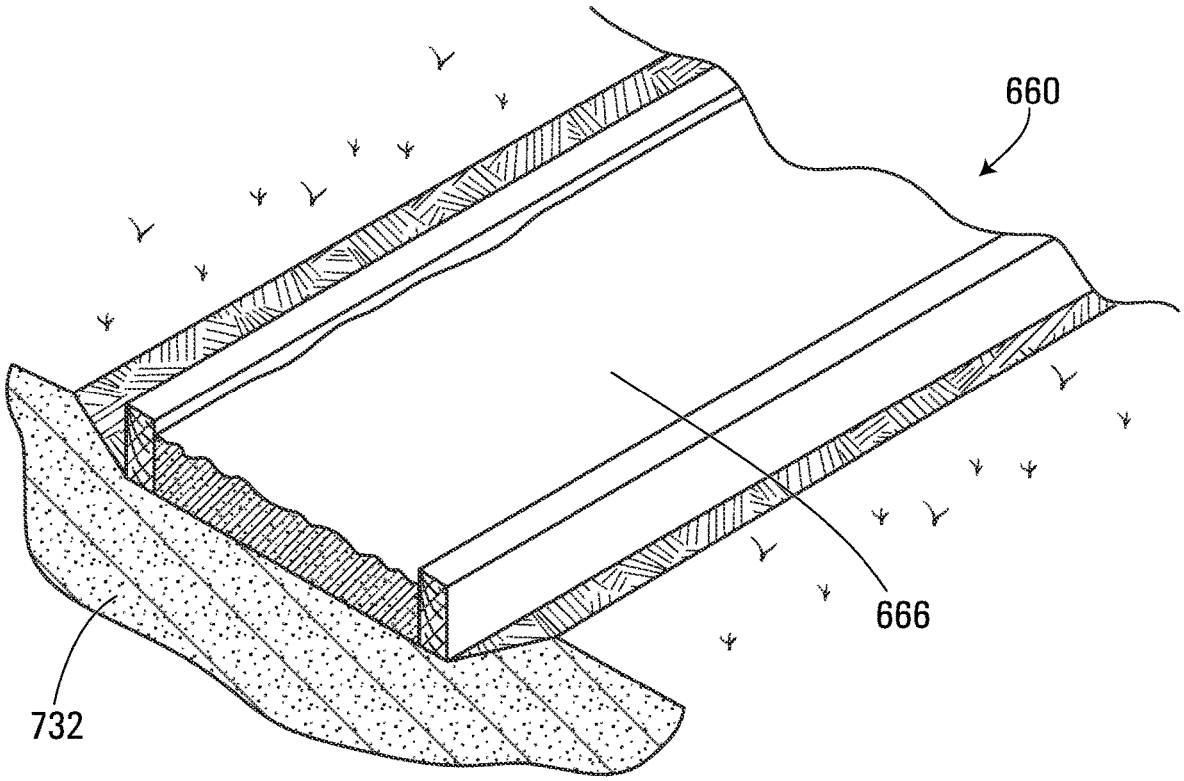
FIG. 23 is a top perspective view illustrating a trench of the system of FIG. 1 during a method of constructing the system of FIG. 1.
Figure 24:
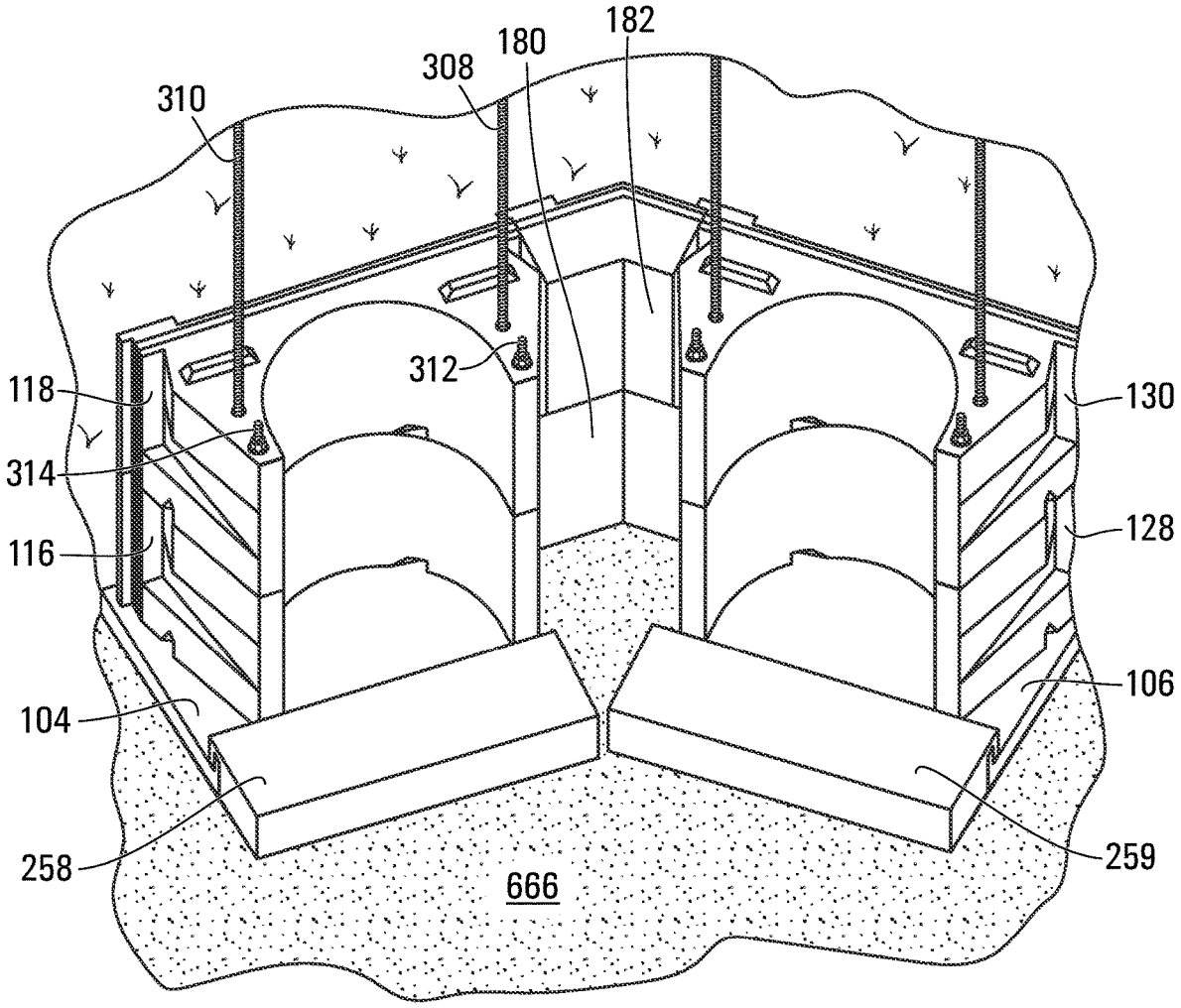
FIG. 24 is a top rear perspective view illustrating two stacks of the system of FIG. 1 during a method of constructing the system of FIG. 1.

FIGS. 2 and 23-29 illustrate a method of constructing the system 100. Referring to FIG. 23, the method involves excavating a trench shown generally at 660 in the pre-existing soil, earth, or other material 732. The material to be retained by system 100 may be temporarily excavated to provide room for construction of the system 100 as described below. At least a portion of the trench 660 may be filled with sand or gravel 666 compacted to 100% standard proctor density ("SPMDD"). To build the layer of sand or gravel 666 within the trench 660 and to facilitate compaction, the outer edges of the area to be filled with sand or gravel 666 may be framed with lumber, and the layer of sand or gravel 666 may be built up within the frame.

Depending on the landscape (for example, shape) of the terrain to be supported by a retaining wall system, rather than an entirely linear or gradually curved terrain, there may be a number of turns (or pivots) within the terrain and each turn may vary in size and degree. Thus, a trench accommodating the retaining wall system to support such terrain is shaped accordingly. Referring to FIG. 2, in the embodiment shown, a front wall 661 of the trench 660 has generally flat portions and has turns shown generally at 663, 665, and 667. The base bodies 104, 106, 108, 110, and 112 may be positioned laterally adjacent to each other on top of the compacted sand or gravel 666, with a front side of the base body positioned along the generally flat portions of a front wall 661 of the trench 660. Thus, the turn 663 is between the base bodies 104 and 106, the turn 665 is between the base bodies 108 and 110, and the turn 667 is between the base bodies 110 and 112. Turns 663, 665, and 667 ultimately lead to the different horizontal directions between the front faces of the stacks 114 and 126, 138 and 150, and 150 and 162, respectively, as discussed above. The front side of each base body (such as the front side 214 of base body 104) faces away from the backfill 700 to be retained at the rear side 103 of the system 100.

The base bodies 104, 106, 108, 110, and 112 may have an extension body connected to the rear side of each of the base bodies. In the embodiment shown in FIG. 24, the extension body 258 is connected to a rear side of the base body 104 and an extension body 259 is connected to a rear side of the base body 106. When connected to the base body 104, the extension body 258 provides greater surface area over which the weight of the backfill 700 can exert downward pressure onto both the extension body 258 and the base body 104, further reducing the possibility of overturning or pushout.

The wall blocks 116 and 118 are positioned on top of the base body 104 in vertical alignment as described above. The tension links 308 and 310 are inserted into the front through-openings of the wall blocks 116 and 118 and fastened into the front openings 222 and 226 on base body 104. The tension links 312 and 314 are inserted into the rear through-openings of the wall blocks 116 and 118 and fastened into the respective rear openings 224 and 228 of the base body 104. The tension links may be inserted and fastened to the base body prior to or after stacking the wall block 116 or the wall block 118 onto the base body 104. Similarly, the wall blocks 128 and 130 are positioned on top of the base body 106 and fastened with tension links.

Each of the joint blocks 180 and 182, positioned in vertical alignment as discussed above, is between the base body 104 and the base body 106, respectively. The joint blocks 180 and 182 are also in horizontal alignment, as discussed above, with the wall blocks 116 and 118 and the wall blocks 128 and 130 on opposite lateral sides. The joint block 180 may be positioned at the base 102 of the system 100 prior to or after stacking the wall block 116 and/or the wall block 128 onto the base bodies 104 and 106, respectively. Similarly, the joint block 182 may be positioned on top of the joint block 180 prior to or after stacking the wall block 118 and/or 130. If, within a row of blocks, the joint block is the final block to be positioned between two wall blocks that are already in position, then the joint block may be inserted from the top, guiding the side protrusions of the joint block through slots and into receptacles on both sides of the wall blocks facing the joint blocks. More particularly, if, for example, the joint block 182 is positioned after stacking the wall blocks 118 and 130 on either side, the joint block 182 may be inserted into the width of space between the wall blocks 118 and 130 from above, guiding the side protrusion 573 of the joint block 182 through a slot and into a receptacle on a second side of the wall block 130 and guiding the side protrusion 575 of the joint block 182 through the slot 376 and into the receptacle 372 on the first side 324 of the wall block 118. Each of the joint stacks sits directly on top of the compacted sand or gravel 666. In other embodiments, each stack of joint blocks is supported by a base body to which the stack of joint blocks may be fastened.

Figure 25:
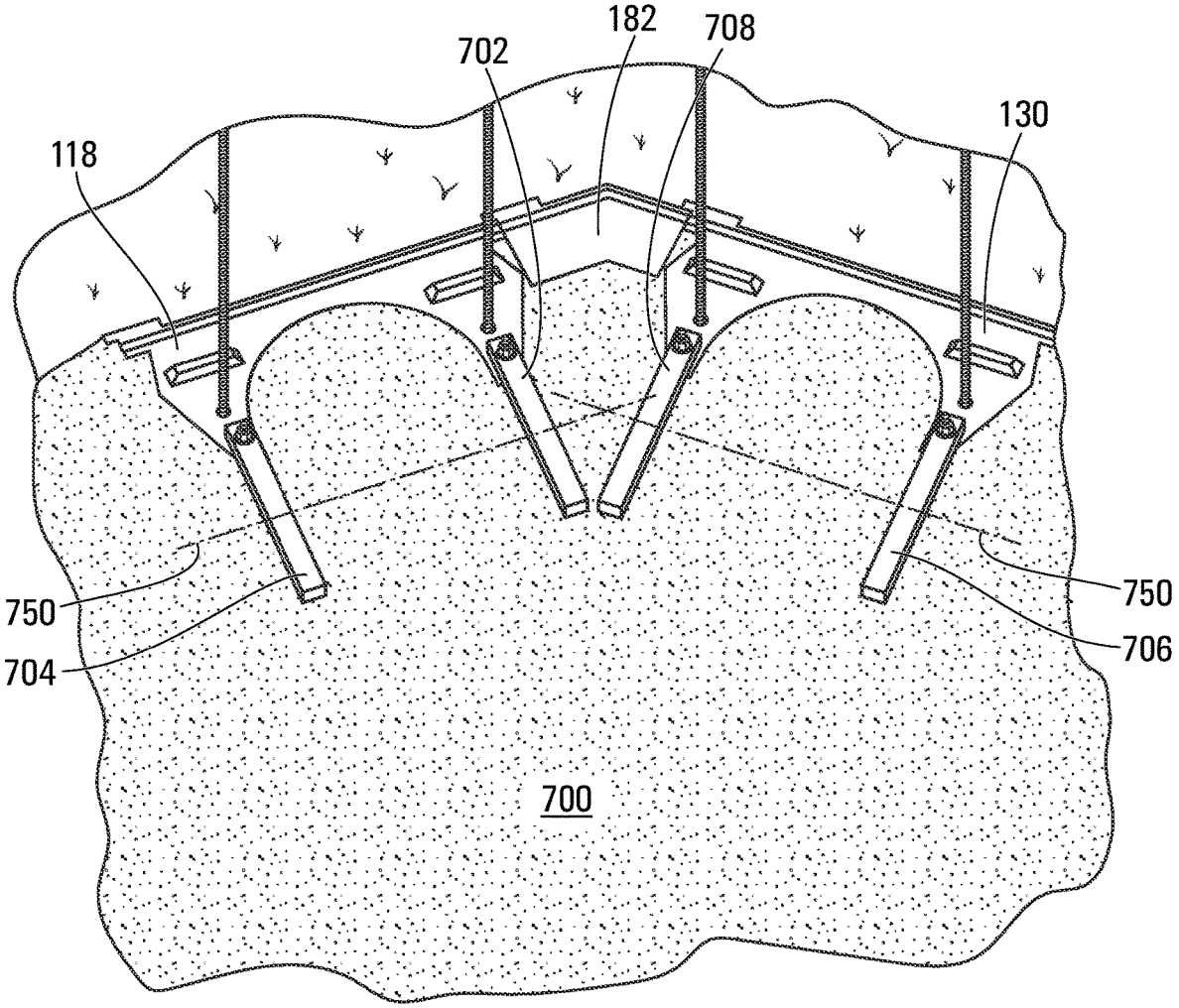
FIG. 25 is a top rear perspective view further illustrating the two stacks of FIG. 23 during a method of constructing the system of FIG. 1.

Backfill 700 may be filled on the rear side 103 of the system 100 in stages at various time points during assembly. As shown in FIG. 25, after a second row of wall blocks is stacked, a portion of the backfill 700 may be filled on the rear side 103 of the wall blocks. In order to couple the rigid stabilizing body 716 to the wall block 118, a member 702 is attached to the rearward projection 404 of the wall block 118 and a member 704 is attached to the rearward projection 406 of the wall block 118. In the embodiment shown, the members 702 and 704 are attached to the top surface 328 of the wall block 118. The members 702 and 704 extend a rearward distance from the system 100 that is past the rupture line 750 of a backfill 700 retained on the rear side 103 of the system 100. The members may be of any rigid, elongated material and may each include a through-opening sized to allow insertion of tension links 312 and 314 through the member 702 and the member 704, respectively. The member 702 and the member 704 may be attached to the wall block 118 through a fastener nut. In other embodiments, only one member may be coupled to the wall block. In other embodiments, more than two members may be attached to the wall block.

Similarly, members 706 and 708 are attached to respective rearward projections of the wall block 130. Once attached, the members 702, 704, 706, and 708 are held in a fixed position relative to the wall blocks 118 and 130.

At least a portion of a rigid stabilizing body, extending rearward from at least one block, may be attached to at least one member. In some embodiments, a system may have a single rigid stabilizing body that may extend rearward from more than one wall block with a portion of the rigid stabilizing body extending rearward from each of the more than one wall blocks. In some embodiments, a system may have a plurality of rigid stabilizing bodies in separately formed pieces with each rigid stabilizing body separately extending rearward from each wall block. In the embodiment shown in FIG. 26, a rigid stabilizing body 716 extends rearward from the wall block 118 and is attached to top surfaces of the members 702 and 704 of the wall block 118. The rear stabilizing body 716 extends transversely to the members 702 and 704. The rigid stabilizing body 716 extends rearward from the wall block 118 and extends past the rupture line 750 of the backfill 700.

Similarly, a rigid stabilizing body 718 extends rearward from the wall block 130 and is attached to top surfaces of the members 706 and 708 of the wall block 130. The rear stabilizing body 718 extends transversely to the members 706 and 708. The rigid stabilizing body 718 extends rearward from the wall block 130, past the rupture line 750 of the backfill 700.

Where a rigid stabilizing body is in separate pieces, each rigid stabilizing body may have a width sufficient to allow it to abut a laterally adjacent rigid stabilizing body. In the embodiment shown in FIG. 26, the rigid stabilizing body 716 of the wall block 118 has a width sufficient to allow it to abut the rigid stabilizing body 718 of the wall block 130 and may they be joined together at an abutting end by attaching them to the member 708 of the wall block 130. In other embodiments, the rigid stabilizing bodies 716 and 718 may be joined together at an abutting end by attaching them to the member 702 of the wall block 118.

By attaching portions of a stabilizing body or one or more stabilizing bodies that are separate but horizontally connected, directly or indirectly through attachment to members, a plurality of horizontally adjacent wall blocks may be connected to each other at a position rearward of the plurality of wall blocks. In some embodiments, the rigid stabilizing body is a rigid shelf. In some embodiments the rigid stabilizing body is attached directly to a rearward portion of a wall block. In some embodiments, the rigid stabilizing body is attached to a top surface of a rearward portion of a wall block.

Figure 26:
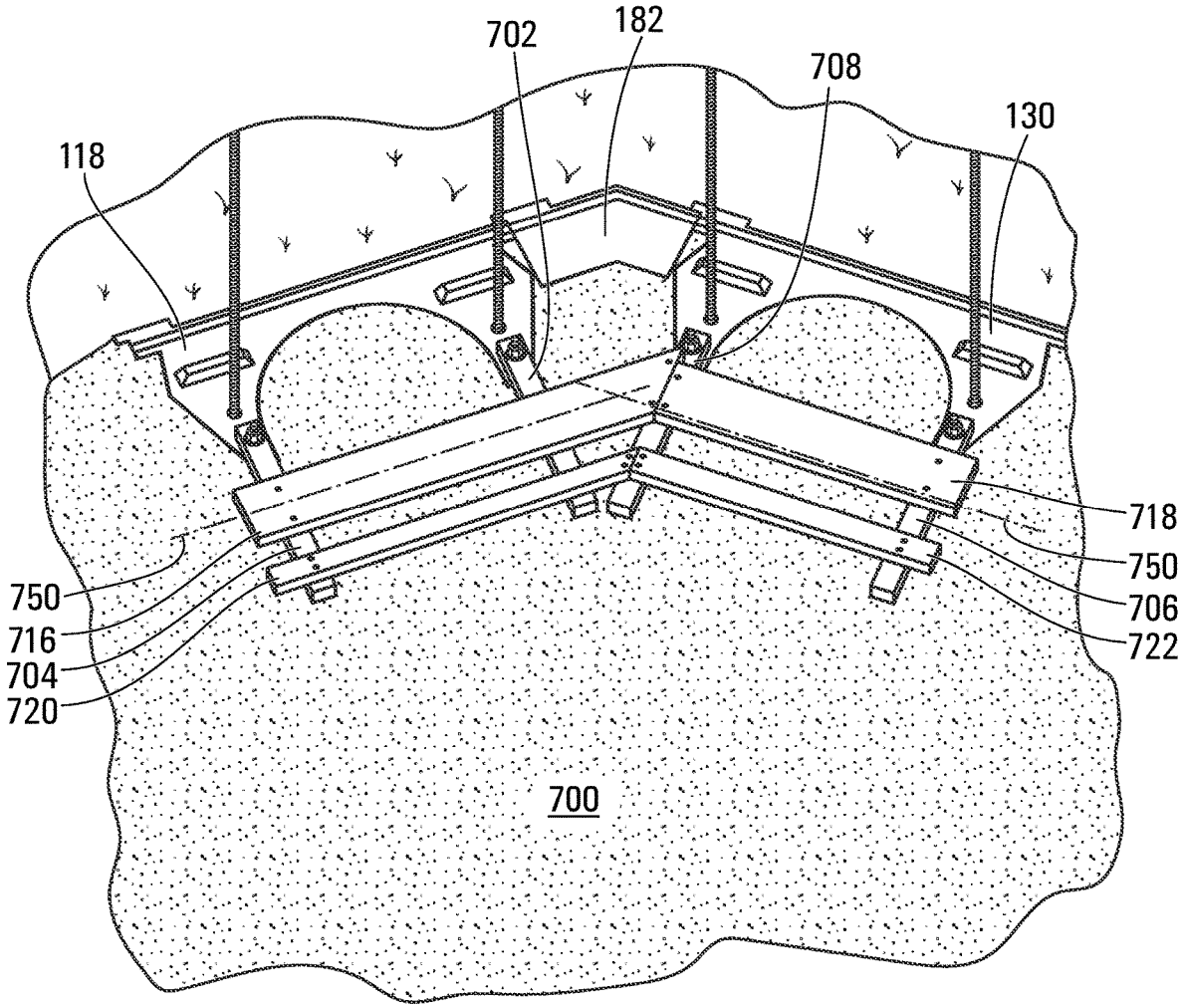
FIG. 26 is a top rear perspective view further illustrating the two stacks of FIG. 24 during a method of constructing the system of FIG. 1.

Referring to FIG. 26, a beam 720 is positioned rearward from the rigid stabilizing body 716 on an opposite side of the rupture line in the backfill 700 from the wall block 118. The beam 720 may be elongated in shape and made of any rigid material, and may be similar in height relative to the rigid stabilizing body 716. In other embodiments, a beam may be greater in height relative to a rigid stabilizing body. The beam 720 is attached to the top surfaces of the members 702 and 704. Each beam has a width sufficient to allow it to abut a laterally adjacent beam. The beams 720 and 722 have sufficient width to allow them to abut one another at one end, and the beams 720 and 722 may be joined together by attaching them to the member 708 of the wall block 130. In other embodiments, the beams 720 and 722 may be attached to the member 702 of the wall block 118. In some embodiments, a single beam may extend rearward from two or more wall blocks, with a first portion extending rearward from a first wall block, and a second portion extending rearward from a second wall block laterally relative to the first wall block. The first portion of the beam is attached to a first pair of members attached to the first wall block, and the second portion of the beam is attached to a second pair of members attached to the second wall block.

Figure 27:
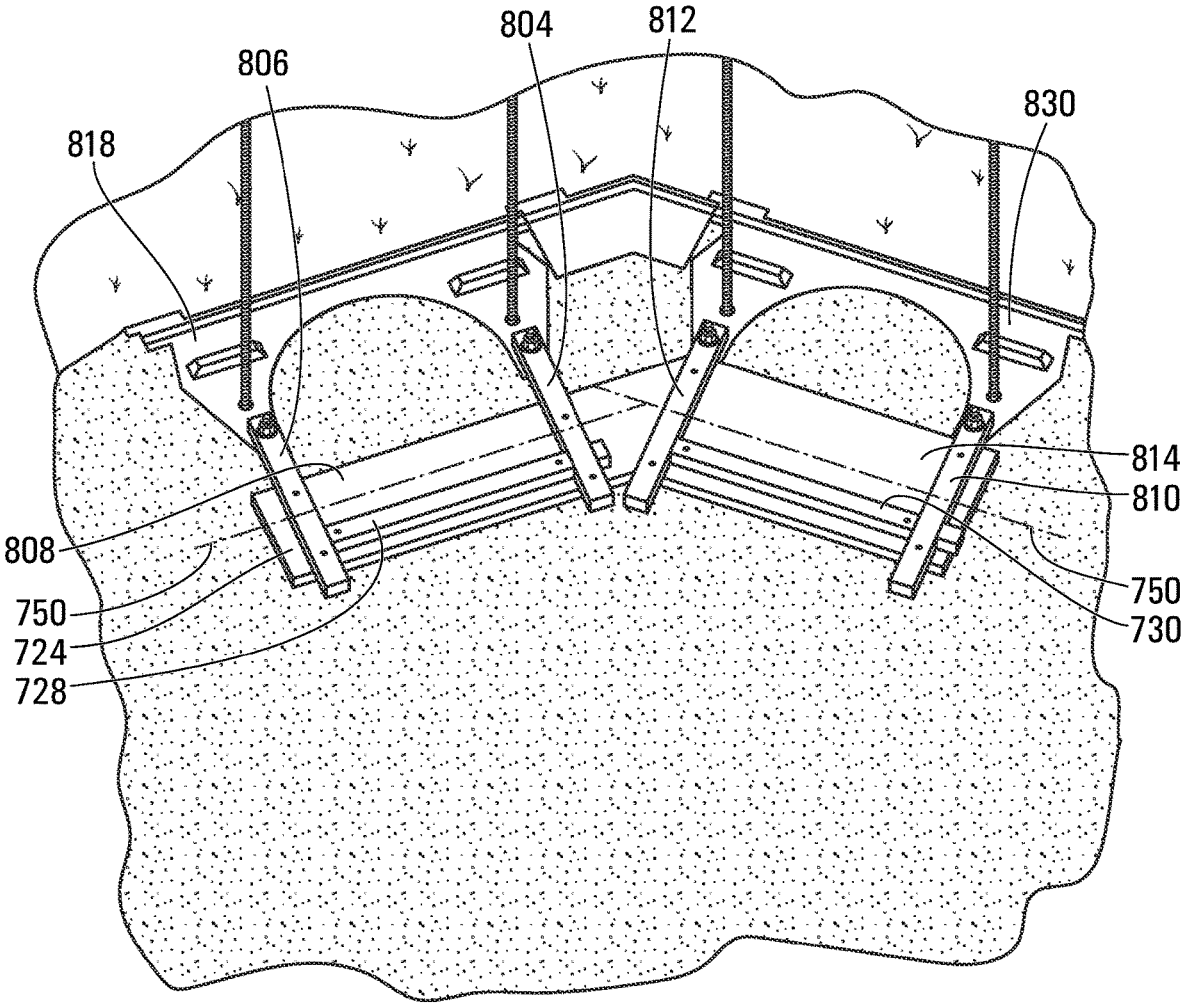
FIG. 27 is a top rear perspective view illustrating two stacks during a method of constructing according to another embodiment.

In the embodiment shown in FIG. 27, a single rigid stabilizing body 724 may be attached to bottom surfaces of members 804, 806, 810, and 812. The rigid stabilizing body 724 extends rearward from the wall blocks 818 and 830 positioned laterally relative to one another, with a first portion 808 of the rigid stabilizing body 724 extending rearward from the wall block 818, and a second portion 814 extending rearward from the wall block 830. The first portion 808 is attached to bottom surfaces of the members 804 and 806 and the second portion 814 is attached to bottom surfaces of the members 810 and 812. Thus, the wall blocks 818 and 830 are connected to each other through the rigid stabilizing body 724 at a position rearward of the wall blocks. A beam 728 may be positioned directly in between the members 804 and 806 of the wall block 818, and attached directly to a top surface of the first portion 808 of the rigid stabilizing body 724.

Figure 28:
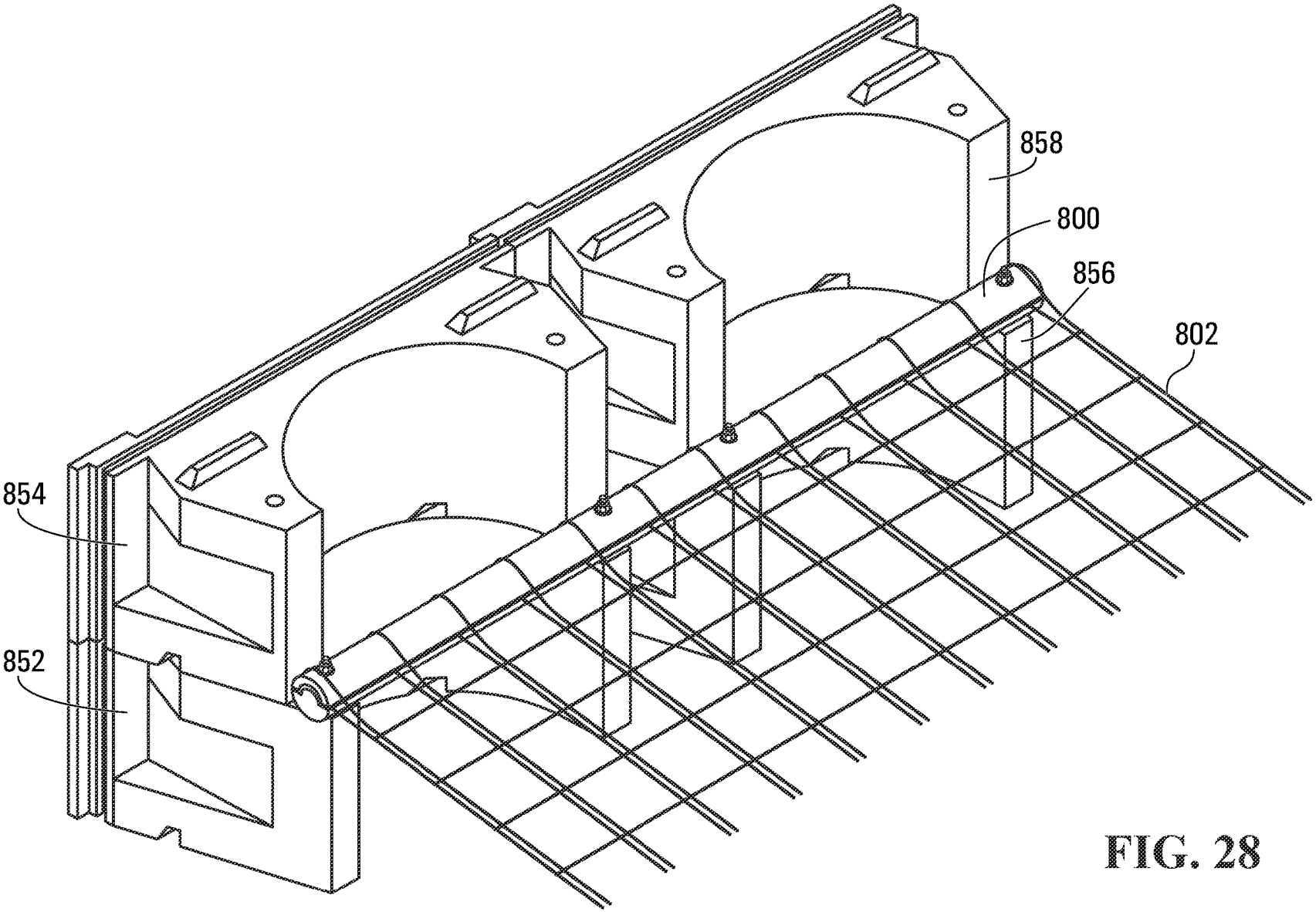
FIG. 28 is a top rear perspective view of a retaining wall system according to another embodiment.
Figure 29:
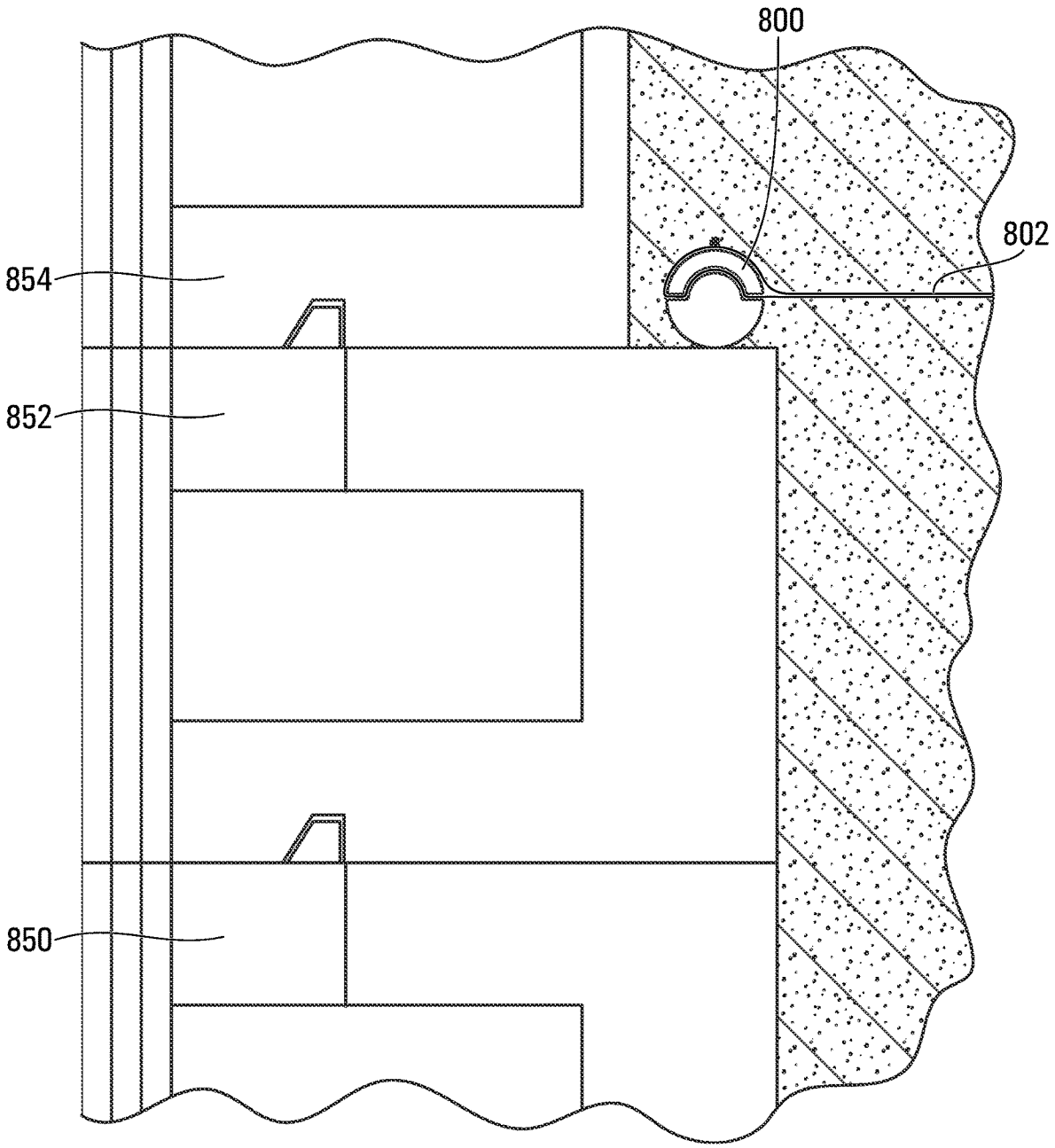
FIG. 29 is a partial side view of the system of FIG. 28.

In the embodiments shown in FIGS. 28 and 29, a pre-cast modular-block retaining wall system includes wall blocks 850, 852, and 856 (each of which may be similar to the wall block 118) and wall blocks 854 and 858 (each of which may be similar to the wall block 120), and an attachment 800 (such as a geogrid attachment, for example) is attached to the wall blocks 852 and 856, with the wall blocks laterally relative to one another (or horizontally adjacent). The attachment 800 spans across the rear side of the wall blocks 852 and 856, attached to a pair of rearward projections of the wall blocks 852 and 856. A reinforcing material 802 (such as geogrid, for example) is coupled to the attachment 800 and extends rearward from the wall blocks shown. However, alternative embodiments may differ. For example, some embodiments may omit the attachment 800, and in at least some such embodiments, the reinforcing material 802 may be retained simply by extending the reinforcing material 802 between adjacent wall blocks, for example by extending the reinforcing material 802 between the wall blocks 852 and 854 and between the wall blocks 856 and 858.

Figure 30:
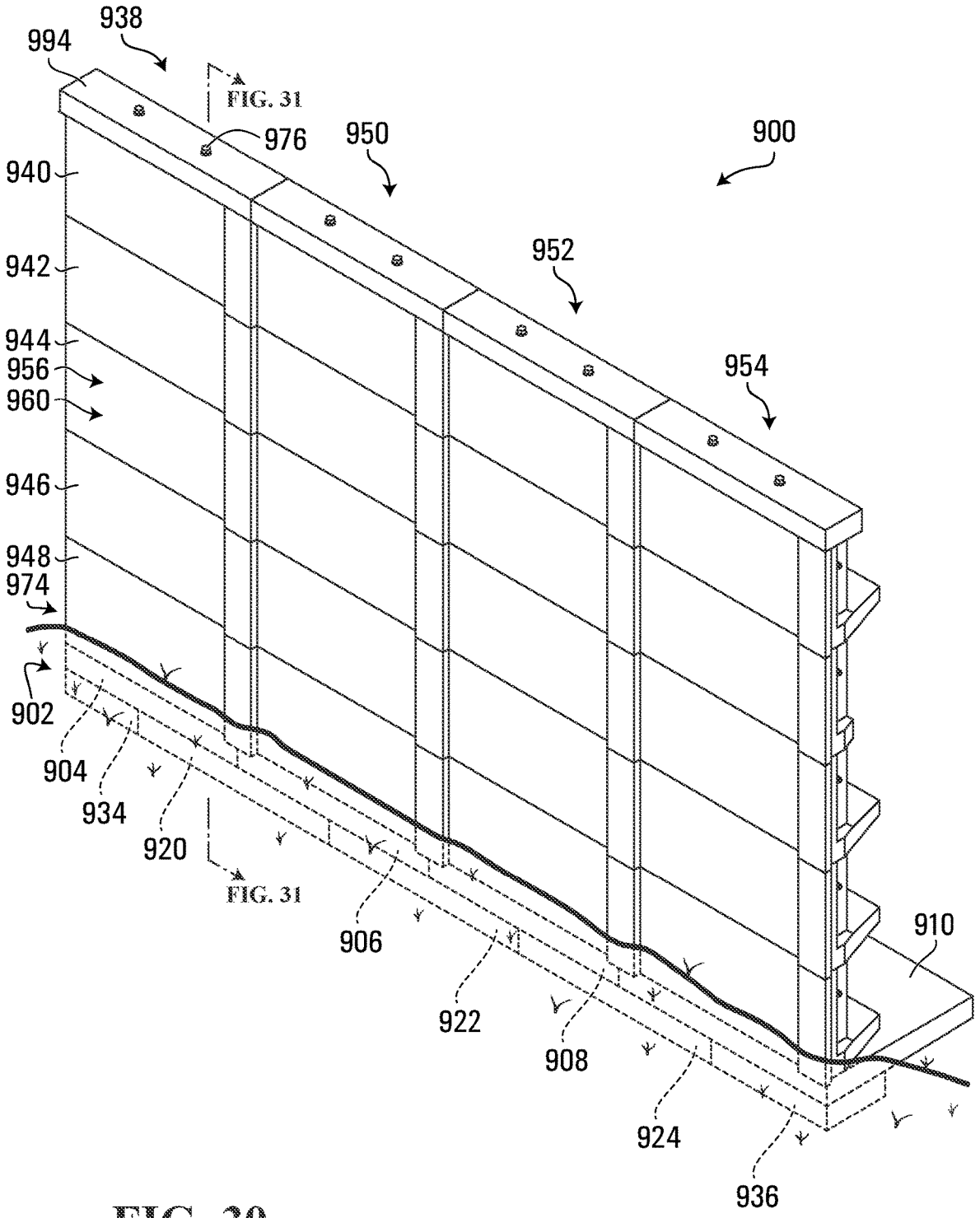
FIG. 30 is a top front perspective view of a retaining wall system according to another embodiment.
Figure 31:
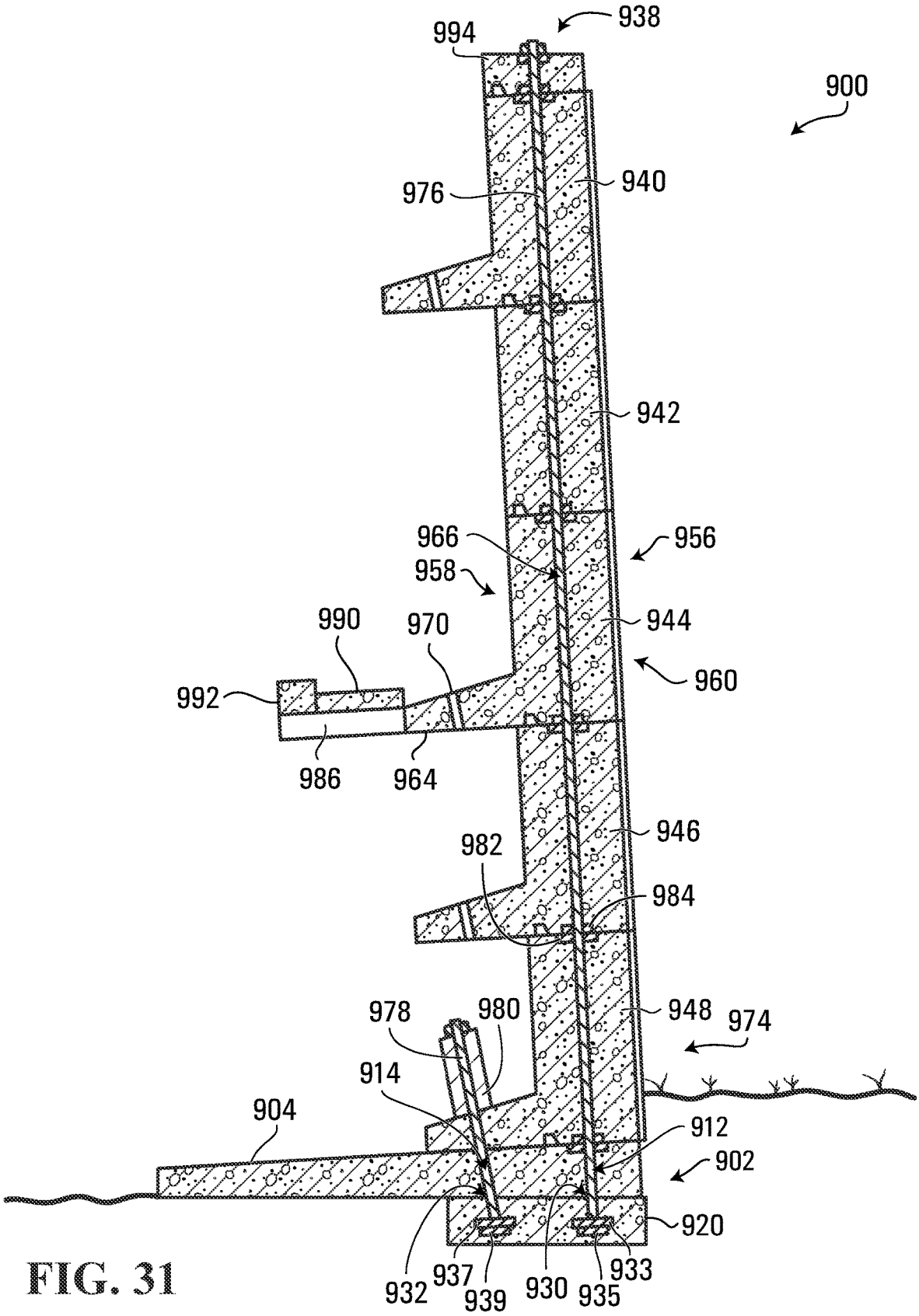
FIG. 31 is a cross-sectional view of the system of FIG. 30 taken along the line 31-31 in FIG. 30.

Referring to FIGS. 30 and 31, a pre-cast modular-block retaining wall system according to another embodiment is shown generally at 900. The system 900 includes a base shown generally at 902 including ground stabilizing base bodies 904, 906, 908, and 910.

Figure 32:
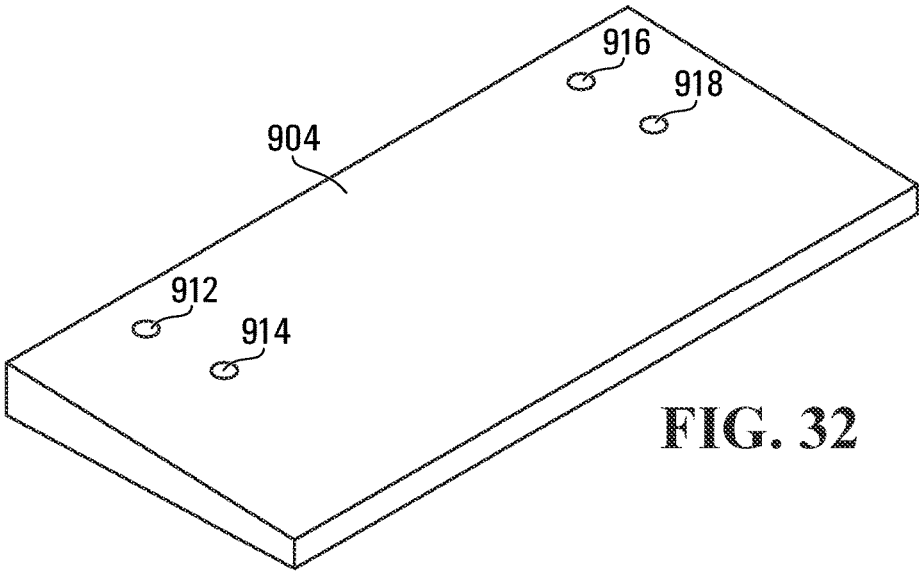
FIG. 32 is a top rear perspective view of a base body of the system of FIG. 30.

Referring to FIG. 32, the base body 904 may be similar to the base body 104, although the base body 904 may omit the projection 242 and may define spaced-apart through-openings shown generally at 912, 914, 916, and 918, each extending between top and bottom sides of the base body 904. The through-openings 912 and 914 are on a left-hand side of the base body 904 and may be referred to as left-side through-openings of the base body 904. The through-openings 916 and 918 are on a right-hand side of the base body 904 and may be referred to as right-side through-openings of the base body 904. The through-openings 912 and 916 are on a front side of the base body 904 and may be referred to as front-side through-openings of the base body 904. The through-openings 914 and 918 are on a rear side of the base body 904 and may be referred to as rear-side through-openings of the base body 904. The base bodies 906, 908, and 910 may be similar to the base body 904.

Referring to back FIGS. 30 and 31, the base 902 also includes shear keys 920, 922, and 924. The shear key 920 has a height 921 of about one foot and a width 923 of about eight feet, although other embodiments may differ. The shear key 920 is under both (and therefore straddles) the base bodies 904 and 906. The shear key 922 may be similar to the shear key 920 and is under both (and therefore straddles) the base bodies 906 and 908. The shear key 924 may be similar to the shear key 920 and is under both (and therefore straddles) the base bodies 908 and 910.

Figure 33:
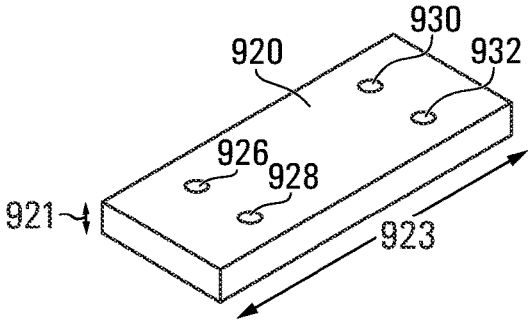
FIG. 33 is a top rear perspective view of a shear key of the system of FIG. 30.

Referring to FIG. 33, the shear key 920 may be generally rectangular and may define spaced-apart openings shown generally at 926, 928, 930, and 932. The openings 926 and 928 are on a left-hand side of the base body 904 and may be referred to as left-side openings of the shear key 920. The openings 930 and 932 are on a right-hand side of the base body 904 and may be referred to as right-side openings of the shear key 920. The openings 926 and 930 are on a front side of the base body 904 and may be referred to as front-side openings of the shear key 920. The openings 928 and 932 are on a rear side of the base body 904 and may be referred to as rear-side openings of the shear key 920.

Each of the openings 926, 928, 930, and 932 extends through a top surface of the shear key 920 towards a bottom surface of the shear key 920, and (as described above and shown in FIG. 4, for example) may be circumferentially encompassed by a washer and nut, coil-rod anchor, or other fastener (which may be stainless steel) defining a threaded opening open to the opening to receive a threaded fastener from the top side of the shear key 920. For example, as shown in FIG. 31, a washer 933 retains or reinforces a nut, coil-rod anchor, or other fastener 935 (which may be stainless steel) defining a threaded opening open to the opening 930, and a washer 937 retains or reinforces a nut, coil-rod anchor, or other fastener 939 (which may be stainless steel) defining a threaded opening open to the opening 932. The washer 933 and the nut, coil-rod anchor, or other fastener 935 (and similar other structures such as those described herein) define compression connections (as opposed to tension connections) because, in general, compression connections may be stronger than tension connections in concrete.

The openings 926, 928, 930, and 932 are positioned such that, when the shear key 920 is under the base bodies 904 and 906 as shown in FIGS. 30 and 31, the right-side openings 930 and 932 are aligned with the left-side through-openings 912 and 914 respectively, and the left-side openings 926 and 928 are aligned with respective right-side through-openings (similar to the through-openings 916 and 918 respectively) of the base body 906.

Referring to back FIGS. 30 and 31, at lateral ends of the system 900, the base 902 also includes partial shear keys 934 and 936. The partial shear key 934 includes openings similar to the left-side openings 926 and 928 that are aligned with the right-side through-openings 916 and 918 respectively when the partial shear key 934 is under the base body 904 as shown in FIG. 30. The partial shear key 936 includes openings similar to the right-side openings 930 and 932 that are aligned with respective left-side through-openings (similar to the through-openings 912 and 914 respectively) of the base body 910 when the partial shear key 936 is under the base body 910 as shown in FIG. 30.

The system 900 also includes a plurality of wall blocks in a plurality of stacks. The system 900 includes a stack shown generally at 938 of wall blocks 940, 942, 944, 946, and 948 supported by the base body 904. The wall block 944 is below the wall block 942 and above the wall block 946. The wall block 946 is below the wall block 944 and above the wall block 948. Horizontally adjacent or laterally relative to the stack 938 is a stack shown generally at 950 of wall blocks similar to the wall blocks of the stack 938 and supported by the base body 906. Horizontally adjacent or laterally relative to the stack 950 on the side opposite from the stack 938 is a stack shown generally at 952 of wall blocks similar to the wall blocks of the stack 938 and supported by the base body 908. Horizontally adjacent or laterally relative to the stack 952 on the side opposite from the stack 950 is a stack shown generally at 954 of wall blocks similar to the wall blocks of the stack 938 and supported by the base body 910. The number of stacks in a retaining wall and/or the number of wall blocks in each stack may vary based on a variety of factors, such as the height and/or width of the retaining wall system.

Figure 34:
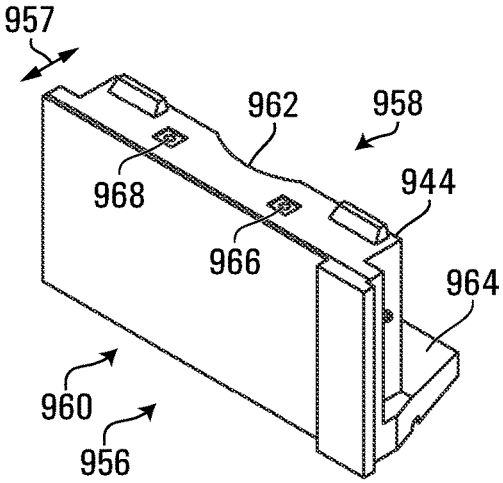
FIG. 34 is a top front perspective view of a relief wall block of the system of FIG. 30.
Figure 35:
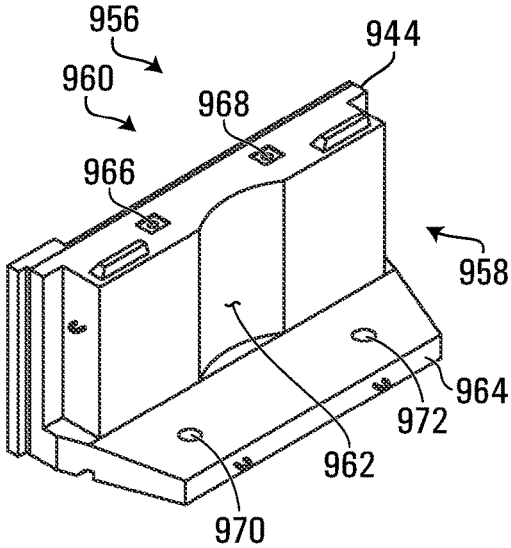
FIG. 35 is a top rear perspective view of the relief wall block of FIG. 34.
Figure 36:
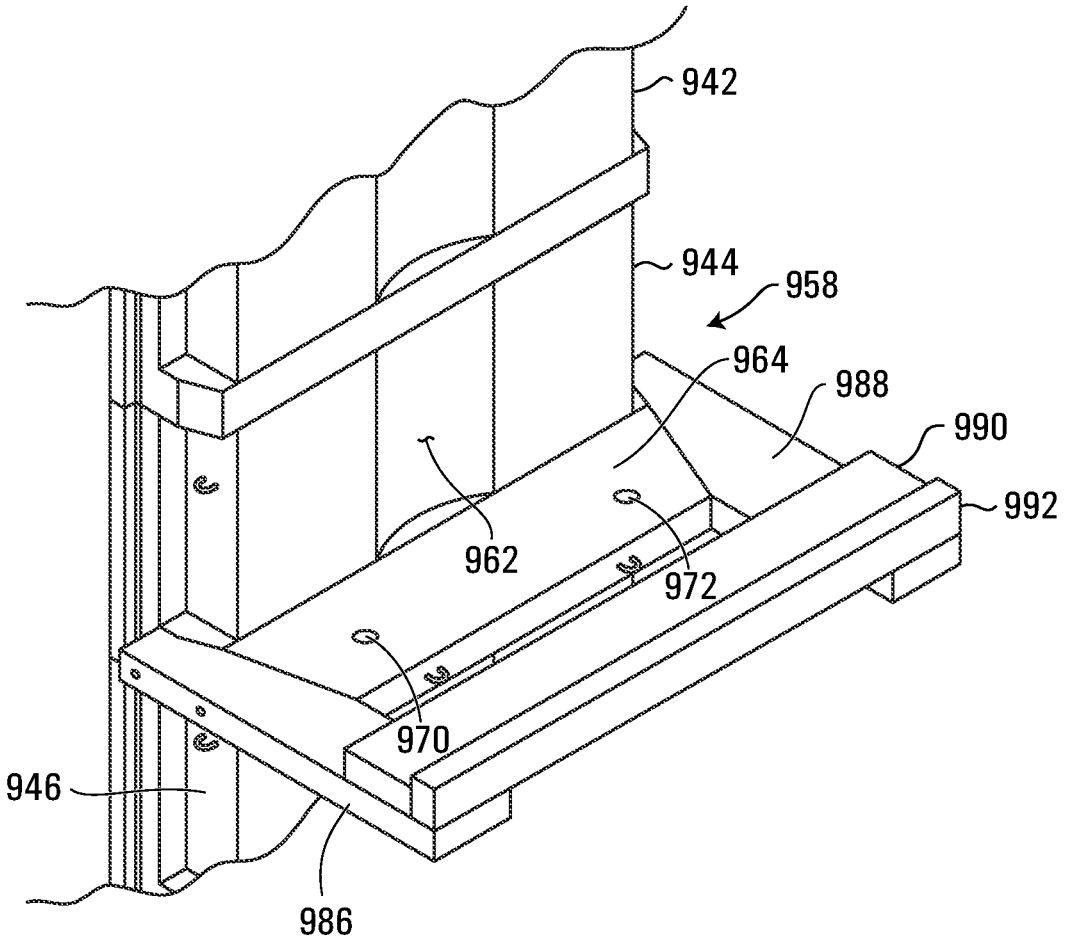
FIG. 36 is a top rear perspective view of the relief wall block of FIG. 34 in the system of FIG. 30 and with a rigid stabilizing body attached to a portion of the relief wall block of FIG. 34.

Referring to FIGS. 34 and 35, the wall block 944 may be generally similar to wall blocks described above but may be thinner to reduce material, reduce weight, and permit greater curvature. For example, the wall block 944 and has a front side shown generally at 956 and a rear side shown generally at 958 opposite from the front side 956, and the wall block 944 and may have a thickness 957 between the front and rear sides 956 and 958 of about eight inches or about 14 inches. The wall block 944 has a front face shown generally at 960. On the rear side 958, the wall block 944 has a rear surface 962 that is curved inward towards the front face 960. Also on the rear side 958, the wall block 944 includes a rearwardly projecting and laterally extending shelf 964.

The wall block 944 has through-openings shown generally at 966 and 968 and extending from a top surface of the wall block 944 to a bottom surface the wall block 944. The through-openings 966 and 968 may be tapered as shown in FIG. 10, or may, for example, be wider at the bottom surface than at the top surface. The top and bottom surfaces of the wall block 944 define recesses surrounding the through-openings 966 and 968. The wall block 944 also defines through-openings shown generally at 970 and 972 and extending from a top surface of the shelf 964 to a bottom surface the shelf 964. The through-openings 966 and 968 are on a front side of the wall block 944 and may be referred to as front-side through-openings of the wall block 944. The through-openings 970 and 972 are on a rear side of the wall block 944 and may be referred to as rear-side through-openings of the wall block 944. The through-openings 966, 968, 970, and 972 are positioned such that, when the wall block 944 is positioned on and supported by the base body 904, the through-openings 966, 968, 970, and 972 are aligned with the through-openings 912, 916, 914, and 918 respectively.

Referring to back FIGS. 30 and 31, the wall blocks 940, 946, and 948 are similar to the wall block 944 and may be referred to as relief wall blocks or as shelf wall blocks. The wall block 942 is similar to the wall block 944, except that the wall block 942 omits the shelf 964. The wall block 942 may therefore be referred to as a standard wall block.

The system 900 may be assembled generally as described above and as shown in FIGS. 2 and 23-29 for the system 100. For example, a method of assembling the system 900 may involve excavating a trench in pre-existing soil, earth, or other material, and at least a portion of the trench may be filled with sand or gravel that may be compacted. The shear keys 920, 922, and 924 and the partial shear keys 934 and 936 may be positioned as shown in FIGS. 30 and 31, and the base bodies 904, 906, 908, and 910 may be positioned on top of the shear keys 920, 922, and 924 and the partial shear keys 934 and 936 such that the each of the shear keys 920, 922, and 924 straddles a respective pair of the base bodies 904, 906, 908, and 910, and such that the openings of the shear keys 920, 922, and 924 and of the partial shear keys 934 and 936 are aligned with respective through-openings of the base bodies 904, 906, 908, and 910.

After the shear keys 920, 922, and 924, the partial shear keys 934 and 936, and the base bodies 904, 906, 908, and 910 are positioned as shown in FIGS. 30 and 31 and as described above, a row of wall blocks shown generally at 974 (including the wall block 948 and other wall blocks in a same row as the wall block 948) may be positioned on the base bodies 904, 906, 908, and 910 as shown in FIG. 30 such that each wall block in the row 974 is above and supported by a respective different one of the base bodies 904, 906, 908, and 910.

After the wall blocks in the row 974 are positioned as shown in FIG. 30 and as described above, tension links (such as metal coil rods, which may be galvanized steel and may be about one inch in diameter, or other continuous elongated, rod-like rigid, tensionable material such as stainless steel, for example) may be passed through respective front-side through-openings (similar to the through-openings 966 and 968) of the wall blocks in the row 974, through respective front-side through-openings (similar to the through-openings 912 and 916) of the base bodies 904, 906, 908, and 910, and into respective front-side openings (similar to the openings 926 and 930) of the shear keys 920, 922, and 924 and of the partial shear keys 934 and 936, and may be threadedly fastened at the bottom to nuts, coil-rod anchors, or other fasteners in the shear keys 920, 922, and 924 and in the partial shear keys 934 and 936 as described above to fasten the tension links to the shear keys or partial shear keys. For example, as shown in FIG. 31, a tension link 976 (such as a metal coil rod, which may be galvanized steel and may be about one inch in diameter, or another continuous elongated, rod-like rigid, tensionable material such as stainless steel, for example) may be passed through a front-side through-opening (similar to the through-opening 966) of the wall block 948, through the through-opening 912, and into the opening 930 and fastened at the bottom to the nut, coil-rod anchor, or other fastener 935 to fasten the tension link 976 to the shear key 920. The shear keys 920, 922, and 924 and the partial shear keys 934 and 936 may therefore be referred to as fastening bodies. In the embodiment shown, the shear keys are formed separately from the base bodies and are therefore (absent tensions in the tension links) movable relative to the base bodies. The shear keys also extend downwardly from lowermost surfaces of the base bodies, and may therefore facilitate engagement with underlying material.

After the wall blocks in the row 974 are positioned as shown in FIG. 30 and as described above, and after the tension links (such as the tension link 976) are passed through the respective front-side through-openings (similar to the through-openings 966 and 968) of the wall blocks in the row 974, through the respective front-side through-openings (similar to the through-openings 912 and 916) of the base bodies 904, 906, 908, and 910, and into the respective front-side openings (similar to the openings 926 and 930) of the shear keys 920, 922, and 924 and of the partial shear keys 934 and 936, spaces defined by the wall blocks in the row 974, by the base bodies 904, 906, 908, and 910, and by the shear keys 920, 922, and 924 and the partial shear keys 934 and 936 and surrounding the tension links may be filled with a filler material that encases the tension links and fills the spaces. The filler material may be any material that is suitable to fill the spaces and that hardens once dry (such as concrete or grout, for example).

Further, washers (such as a washer 982) and nuts or other fasteners (such as a nut 984) may be fastened to the tension links on a top surface of the wall blocks in the row 974 to fasten the wall blocks in the row 974 to the base bodies 904, 906, 908, and 910, to the shear keys 920, 922, and 924, and to the partial shear keys 934 and 936. Each of the tension links is thus attached to one of the wall blocks in the row 974, to one of the base bodies 904, 906, 908, and 910, and one of the to the shear keys 920, 922, and 924 and the partial shear keys 934 and 936, and each of the tension links is thus tensionable to hold the one of the wall blocks in the row 974 to the one of the base bodies 904, 906, 908, and 910. The washers may be received in recesses similar to the recesses as described above in the top surface of the wall block 944, and the nuts may be received in recesses similar to the recesses as described above in the bottom surface of the wall block 944.

Further, after the wall blocks in the row 974 are positioned as shown in FIG. 30 and as described above, tension links (such as metal coil rods, which may be galvanized steel and may be about one inch in diameter, or other continuous elongated, rod-like rigid, tensionable material such as stainless steel, for example) may be passed through respective rear-side through-openings (similar to the through-openings 970 and 972) of the wall blocks in the row 974, through respective rear-side through-openings (similar to the through-openings 914 and 918) of the base bodies 904, 906, 908, and 910, and into respective rear-side openings (similar to the openings 928 and 932) of the shear keys 920, 922, and 924 and of and the partial shear keys 934 and 936, and may be threadedly fastened at the bottom to nuts, coil-rod anchors, or other fasteners in the shear keys 920, 922, and 924 and in the partial shear keys 934 and 936 as described above to fasten the tension links to the shear keys or partial shear keys. For example, as shown in FIG. 31, a tension link 978 (such as a metal coil rod, which may be galvanized steel and may be about one inch in diameter, or another continuous elongated, rod-like rigid, tensionable material such as stainless steel, for example) may be passed through a rear-side through-opening (similar to the through-opening 970) of the wall block 948, through the through-opening 914, and into the opening 932 and fastened at the bottom to the nut, coil-rod anchor, or other fastener 939 to fasten the tension link 978 to the shear key 920.

A resilient body (such as a coil spring) 980 may be positioned between an end of the tension link 978 and a top surface of a shelf (similar to the shelf 964) of the wall block 948, and similar resilient bodies may be positioned between some or all other tension links and top surfaces of shelves (similar to the shelf 964) of the wall blocks in the row 974. In some embodiments, the resilient body 980 may accommodate up to 40,000 pounds of force, and the tension link 978 may be tightened to 15,000 pounds of force at the time of assembly of the system 900.

The resilient body 980 may allow the shelves (similar to the shelf 964) of the wall blocks in the row 974, and thus the wall blocks of the system 900, to move resiliently relative to the base 902 when forces from the wall blocks of the system 900 cause a force on the shelves (similar to the shelf 964) of the wall blocks in the row 974 to exceed the initial tension (for example, 15,000 pounds per resilient body), which may accommodate seismic or other movement of the wall blocks of the system 900 relative to the base 902 and increase overall stability of the system 900. Further, when forces from the wall blocks of the system 900 cause a force on the shelves (similar to the shelf 964) of the wall blocks in the row 974 to exceed the initial tension (for example, 15,000 pounds per resilient body), the wall blocks in the row 974 may rotate slightly, which may increase tension in front-side tension links (such as the tension link 976) and further strengthen the system 900 against overturning from such forces. The resilient body 980 is optional and may be omitted in some embodiments.

The shear keys 920, 922, and 924 and the partial shear keys 934 and 936 may be formed separately from the base bodies 904, 906, 908, and 910, may be held against one or two of the base bodies 904, 906, 908, and 910 only by tension links as described above, and may be movable relative to the base bodies 904, 906, 908, and 910. Fastening tension links as described above to shear keys 920, 922, and 924 and partial shear keys 934 and 936 that are formed separately from the base bodies 904, 906, 908, and 910 may allow horizontal or other movement of the tension links relative to the base bodies 904, 906, 908, and 910 and may allow greater tension to be applied to the tension links than when compared to tension links fastened directly to such base bodies, which may increase overall strength of the base 902, for example by preventing damage to the base bodies that could be caused by tension applied to the tension links when fastened directly to such base bodies.

The system 900 may be further assembled in successive rows generally as described above and as shown in FIGS. 2 and 23-29 for the system 100. After each row of wall blocks of the system 900 is positioned, the process as described above may be repeated by filling the front-side through-openings (similar to the through-openings 966 and 968) of the wall blocks in the row with a filler material, and by positioning washers and nuts or other fasteners on the tension links to hold the wall blocks in the row to one of the base bodies 904, 906, 908, and 910.

As the system 900 is assembled, backfill may be positioned on a rear side of the wall blocks of the system 900 (such as on the rear side 958). Shelves (similar to the shelf 964) of the relief wall blocks of the system 900 may extend into the backfill, which may increase overall stability of the system 900.

Further, similar to the rigid stabilizing bodies as described above, one or more rigid stabilizing bodies may be positioned to extend past a rupture line of the backfill on the rear side of the wall blocks of the system 900. For example, the shelf 964 is a portion of the wall block 944 extending rearward from the wall block 942, and members 986 and 988 (which may be rigid members) are attached (using bolts, for example) to lateral surfaces of the shelf 964 and extend in a rearward direction from the wall block 944. A rigid stabilizing body (such as a plank) 990 and a beam 992 may rest upon or be attached to, and may extend transversely to, the members 986 and 988, and may extend past a rupture line of backfill similarly to the rigid stabilizing bodies as described above, for example. Similar members, rigid stabilizing bodies, and beams may be attached to other relief wall blocks of the system 900, such as to the other relief wall blocks in a same row as the wall block 944, for example. In some embodiments, such rigid stabilizing bodies attached to wall blocks in a same row of wall blocks may abut in a wall that may have a curved front face as shown in FIGS. 26 and 27.

After all of the rows of wall blocks have been positioned, a row of top blocks (such as the top block 994) may be positioned and fastened using filler material, and using washers and nuts or other fasteners on the tension links, as described above.

In general, tension links as described herein may be single unitary bodies or separately formed bodies joined together. For example, in some embodiments, the tension link 966 may be a single coil rod extending from the shear key 920 and through the top block 994, or the tension link 966 may be formed of multiple separately formed coil rods joined together with one or more coil couplers. Alternative embodiments may include tension links other than coil rods, and such tension links may not necessarily be threaded or rigid.

Figure 37:
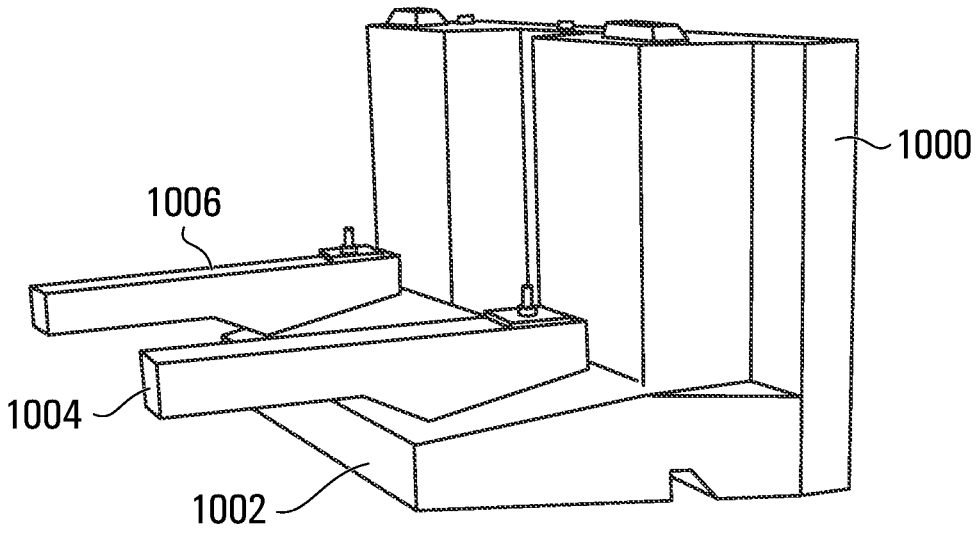
FIG. 37 is a top rear perspective view of a wall block and members according to another embodiment.

Referring to FIG. 37, a wall block 1000 according to another embodiment may be similar to the wall block 944 and may have a front face that is about eight feet wide and about 3.5 feet high. However, some embodiments may include half-blocks that are only about four feet wide, and of course other embodiments may vary. The vertical-board-like portion on the front side of the wall block 1000 may be about 15 inches wide and about four inches thick to cover gaps in curved walls. The wall block 944 includes a rearwardly projecting and laterally extending shelf 1002 that may be similar to the shelf 964. However, the shelf 1002 may omit the through-openings 970 and 972 and may instead include through-openings that permit members 1004 and 1006 (which may be rigid members) to be attached (using bolts, for example) to a top surface of the shelf 1002 and extend in a rearward direction from the wall block 1000.

Figure 40:
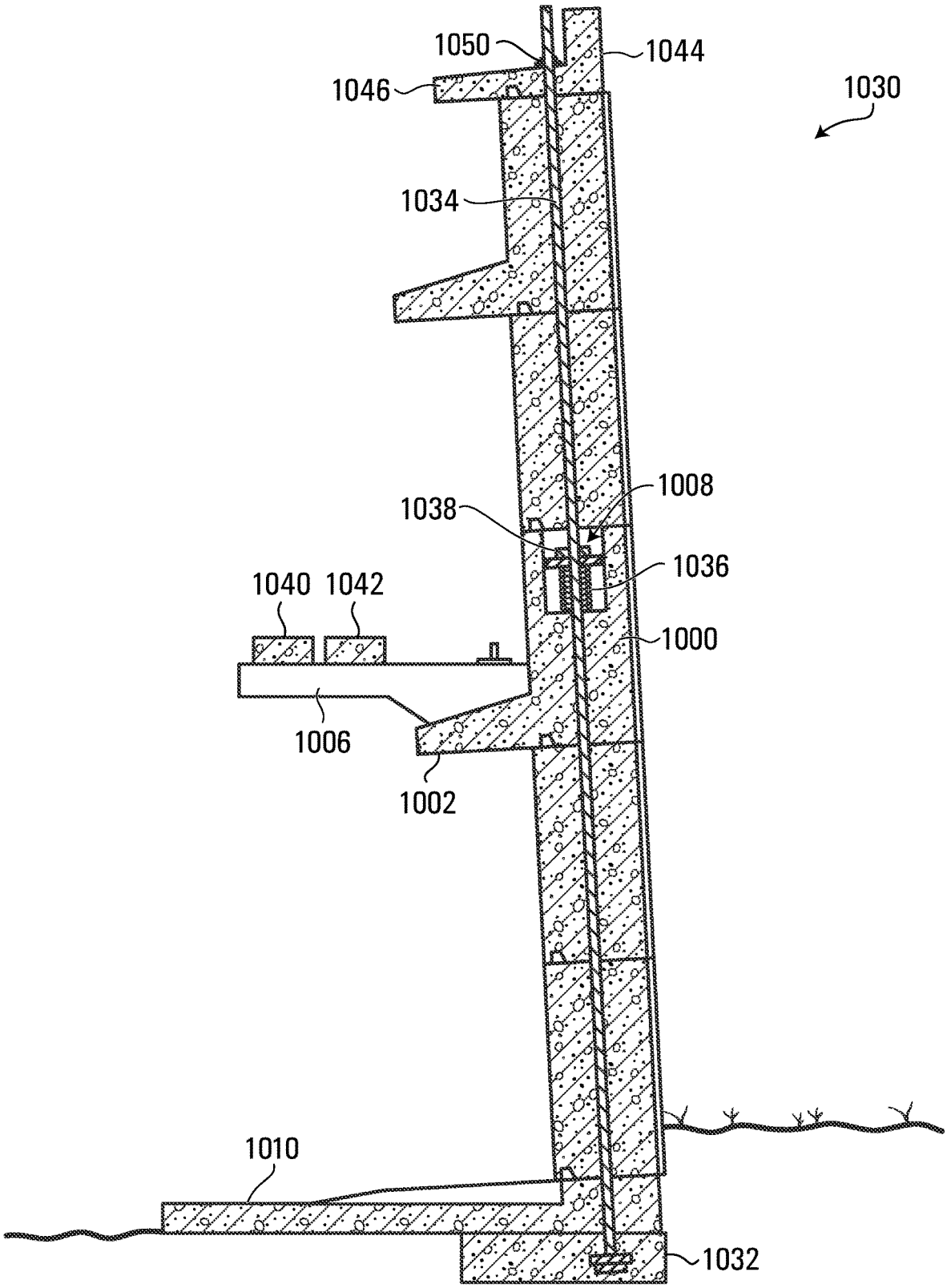
FIG. 40 is a cross-sectional view of a retaining wall system according to another embodiment and including the wall block and members of FIG. 37 and the base body of FIG. 38.

Referring to FIG. 40, the wall block 1000 may also define a space shown generally at 1008 to receive a coil spring as described below.

Figure 38:
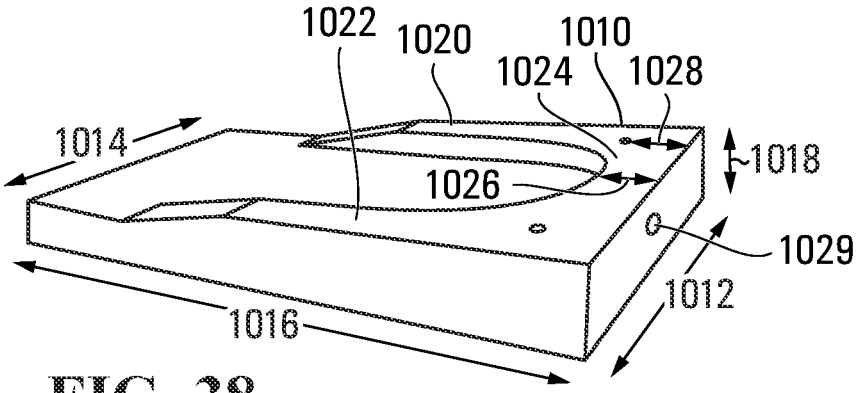
FIG. 38 is a top front perspective view of a base body according to another embodiment.
Figure 39:
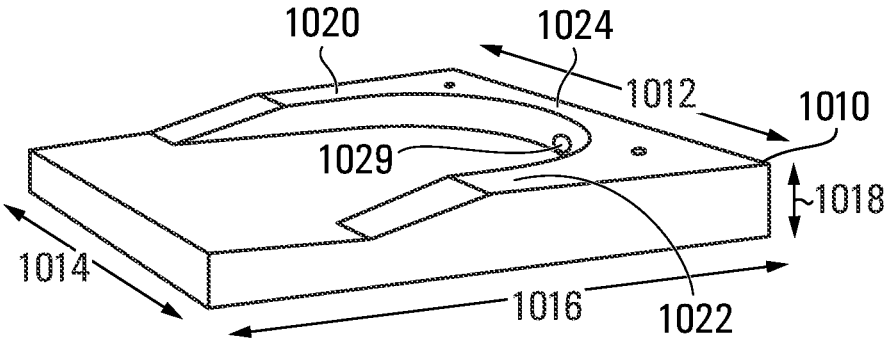
FIG. 39 is a top rear perspective view of the base body of FIG. 38.

Referring to FIGS. 38 and 39, a base body 1010 according to another embodiment may be similar to the base body 904, although the base body 1010 may have a different shape including a front width 1012 of about eight feet, a rear width 1014 of about 7.5 feet, a length 1016 of about eight feet, and a height 1018 of about one foot. Further, the base body 1010 may include lateral raised portions 1020 and 1022 that may slope downwards towards a rear side of the base body 1010 by a slope of about one degree over a length that may be about four feet. A front raised portion 1024 may curve as shown in FIGS. 38 and 39 between the lateral raised portions 1020 and 1022 and have a minimum thickness 1026 of about nine inches, and spaced-apart through-openings similar to the front-side through-openings 912 and 916 may be a distance 1028 of about ten inches from a front of the base body 1010. A drain hole 1029 may have a diameter of about three inches, for example, and extends through or under the front raised portion 1024 between front and rear sides of the base body 1010 and may allow water to drain from a rear side of the base body 1010 to a front side of the base body 1010.

The wall block 1000 and the base body 1010 may be shaped so that, when assembled into a wall system, a front face of the wall system may curve by as much as about 11 degrees or about 22 degrees between adjacent stacks of wall blocks.

Referring to FIG. 40, a pre-cast modular-block retaining wall system according to another embodiment is shown generally at 1030. The system 1030 includes shear keys (including a shear key 1032) that may be similar to the shear keys as described above. The system 1030 also includes base bodies including the base body 1010. The shear keys and base bodies of the system 1030 may be arranged as in the embodiment of FIG. 31 as described above, for example. The system 1030 also includes wall blocks (including the wall block 1000) that may be arranged as in the embodiment of FIG. 31 as described above, for example. In the system 1030, some wall blocks may be similar to the wall block 1000, and some wall blocks may be similar to the wall block 1000 but without the shelf 1002, or the system 1030 may include other wall blocks such as other wall blocks as described herein. The system 1030 also includes a tension link 1034 (such as a metal coil rod, which may be galvanized steel and may be about one inch in diameter, or another continuous elongated, rod-like rigid, tensionable material such as stainless steel, for example) that, as in the embodiment of FIG. 31 as described above for example, may be passed through through-openings of the wall blocks of the system 1030, through a through-opening of the base body 1010, and fastened to the shear key 1032.

As shown in FIG. 40, a coil spring (or other resilient body) 1036 may be positioned in the space 1008 (and therefore within the wall block 1000), and a nut or other fastener 1038 may compress the coil spring (or other resilient body) 1036 to apply tension to a portion of the tension link 1034 below the nut or other fastener 1038. The space 1008 and the coil spring (or other resilient body) 1036 are optional and may be omitted in some embodiments. Other embodiments may include more such spaces and coil springs, or such spaces and coil springs in one or more different locations.

Beams 1040 and 1042 may be positioned on the members 1004 and 1006 as shown in FIG. 40, which members may extend past a rupture line as described above, and the system 1030 may otherwise be assembled as in the embodiment of FIG. 31 as described above for example.

As shown in FIG. 40, the base bodies (such as the base body 1010) extend rearward farther than a rear side of one wall block, of a stack of at least two wall blocks, of a stack of at least three wall blocks, of a stack of at least four wall blocks, or of a stack of at least five wall blocks of the system 1030. Such rearward extension of base bodies may increase weight of backfill on portions of the base bodies, which may increase stability of the system 1030, may reduce or avoid any need for further stabilizing materials such as the reinforcing material 802, and may permit a reduced setback or batter of the wall blocks of the system 1030 when compared to a wall without such rearward extension of base bodies.

Figure 41:
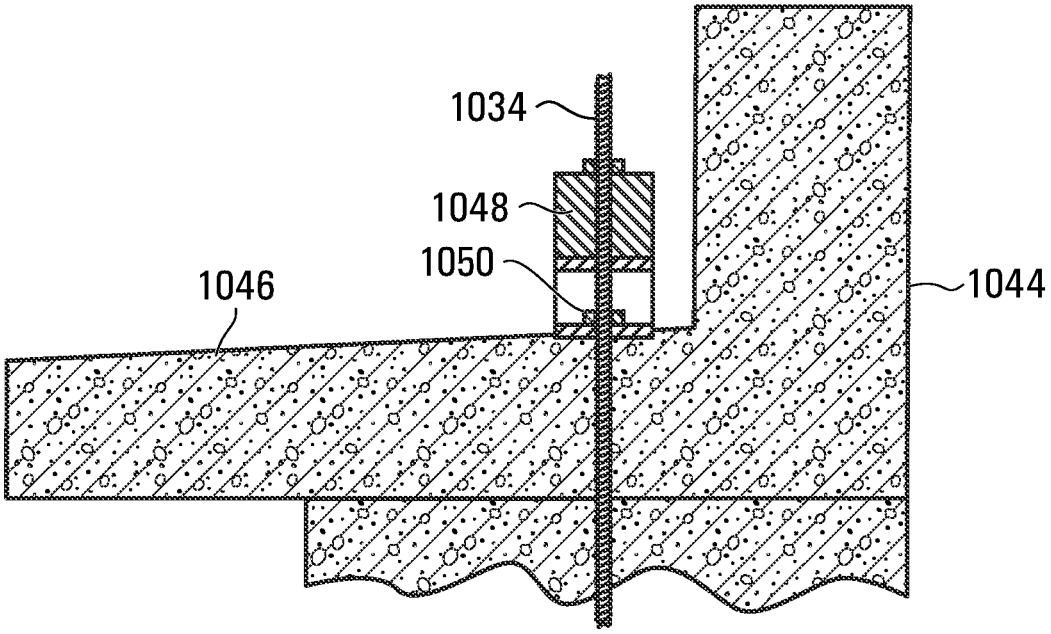
FIG. 41 is a fragmentary view of the system of FIG. 40.

As shown in FIGS. 40 and 41, the system 1030 also includes top blocks including a top block 1044. The top block 1044 includes a rearward projection 1046. The rearward projection 1046 may facilitate stabilizing the system 1030 in backfill and may prevent additional backfill from falling behind the wall blocks of the system 1030 and wedging the system 1030 forward.

The top block 1044 also defines one or more through-openings to receive one or more tension links such as the tension link 1034. Once the system 1030 is otherwise assembled, tension may be applied to tension links (such as the tension link 1034) using a ram (such as a hydraulic ram) 1048 shown in FIG. 41. After the ram 1048 applies tension, and while the ram 1048 maintains such tension, one or more fasteners (such as a nut 1050) may be tightened to maintain the tension on the tension links, and the ram 1048 may be removed (as shown in FIG. 40) and reused for other tension links or in other applications.

In some embodiments, tension from one or more tension links may apply pressure between the wall blocks and base body attached to the one or more tension links. For example, in the embodiment of FIG. 40, two tension links (the tension link 1034 and another tension link, similar to the tension links as shown in FIG. 30 for example) pass through wall blocks (including the wall block 1000) and are attached to the base body 1010 under and supporting those wall blocks.

In general, combined tension from such tension links may exceed an anticipated lateral load on the system 1030 at one-third of a height of the system 1030. For example, if an anticipated lateral load on the system 1030 at one-third of the height of the system 1030 is 100,000 pounds, then the combined tension from tension links may exceed 100,000 pounds. For example, if the system 1030 includes eight tension links (similar to the tension links as shown in FIG. 30 for example), then each tension link may be tensioned during assembly of the system 1030 to a tension of 12,500 pounds for a combined tension of 100,000 pounds. Further, the tension links may have capacity for tension that exceeds the tension that is applied during assembly of the system 1030. For example, if, during assembly of the system 1030, each tension link is tensioned to a tension of 12,500 pounds, each tension link (and each anchor, such as an anchor including the washer 933 and the nut, coil-rod anchor, or other fastener 935) may have a capacity for tension of at least 25,000 pounds. Such additional capacity may stabilize the system 1030 during extraordinary loads, such as a load from an earthquake for example.

In general, each such tension link may apply at least 6,000 pounds, at least 7,000 pounds, at least 10,000 pounds, at least 15,000 pounds, at least 20,000 pounds, at least 25,000 pounds, at least 30,000 pounds, at least 35,000 pounds, or at least 40,000 pounds of force to the base body to which the tension link is attached. Such forces are in addition to the weights of the wall blocks and of any other components of the system 1030. A tension link (such as a coil rod) may stretch by about 0.25 inches or about 0.5 inches under such tension.

In general, when a lateral load is applied to the system 1030, the lateral load may be transferred to tension links of the system 1030. Such tension in such tension links may prevent movement of the system 1030 under significant lateral loads, and if extraordinary lateral loads cause any wall blocks of the system 1030 to move from originally assembled positions to displaced positions, such tension in such tension links may cause such wall blocks to return to from their displaced positions back to their originally assembled positions after the extraordinary lateral loads are removed.

In some embodiments, as shown in FIG. 30 for example, wall blocks may be in stacks, and each stack may be above a respective base body. In such embodiments, each stack may include two tension links attached to the base body below the wall blocks of the stack, and the total tension applied to the base body may be the combined tension of those two tension links.

Further, applying such tensions to such tension links allows for evaluation of the system 1030, because any defects in any components of the system 1030 may become apparent when such tensions are applied to such tension links, and the system 1030 may be free from defects if no defects become apparent when such tensions are applied to such tension links.

In general, the tensions in the tension links of the system 1030 may hold the wall blocks of the system 1030 to the base bodies of the system 1030, and the base bodies of the system 1030 may have sufficient stability (for example, from weight of backfill on portions of the base bodies that extend behind the wall blocks of the system 1030) that the setback or batter of the wall blocks of the system 1030 may be reduced compared to other walls. For example, the setback or batter of the wall blocks of the system 1030 may be about two degrees, compared to above five degrees in other walls. Such reduced setback or batter may reduce an overall amount of space required for the system 1030 when compared to other walls. Such a reduced setback or batter may also reduce or avoid any need for joint blocks such as those described above.

References above to front, rear, left, and right are only for description of certain embodiments, and are not intended to limit any embodiments or require any particular orientations or perspectives.

The wall blocks, other blocks, base bodies, members, beams, shear keys, partial shear keys, and other bodies described herein may be formed from concrete, with or without reinforcement, or one or more of the same or different other materials. Such wall blocks, other blocks, base bodies, members, beams, shear keys, partial shear keys, and other bodies may all be separately pre-cast or otherwise separately formed before assembly into walls or other systems such as those described herein. For example, such wall blocks, other blocks, base bodies, members, beams, shear keys, partial shear keys, and other bodies may be formed without cold joints.

The embodiments above may be combined or varied. For example, wall blocks or other blocks as described herein may be modified to include features of other blocks such as those described herein. Also, alternatives to the system 900 or the system 1030 may include joint blocks such as those of the system 100. Further, alternatives to the system 100, 900, or 1030 may include the base bodies of the system 100, 900, or 1030. In such embodiments, resilient bodies (such as the resilient body 980) may be attached to a wall block (for example, to a shelf such as the shelf 964) and to a base body of the system 100 or 1030 instead of to a fastening body of the system 900. Also, the system 100 may include shear keys or partial shear keys from the system 900 or 1030. Further, alternatives to the system 900 or to the system 1030 may include sealing material as in the system 100 or reinforcing material (such as the reinforcing material 802, for example).

More generally, the embodiments described above are examples only, and alternative embodiments may differ. For example, in alternative embodiments, wall blocks, other blocks, base bodies, members, beams, shear keys, partial shear keys, and other bodies may have different shapes or configurations. Further, systems and methods of alternative embodiments may differ. For example, methods of alternative embodiments may include additional steps, steps in a different order, or alternatives to the steps described above, or may omit some of the steps described above. Wall systems according to other embodiments may include more or fewer wall blocks, different wall blocks or combinations of one or more different wall blocks including but not limited to wall blocks as described herein, and other arrangements of wall blocks in various different wall systems. All shapes, dimensions, and arrangements described herein are examples only, and alternative embodiments may differ.

This disclosure further includes, but is not limited to, the following clauses, each of which may be combined with one or more other clauses or any other subject matter in this specification.

1. A retaining wall system comprising:

a first at least one wall block having a non-vertical front face on a front side of the retaining wall system and extending in a first horizontal direction;

a second at least one wall block positioned laterally relative to the first at least one wall block and having a non-vertical front face on the front side of the retaining wall system and extending in a second horizontal direction different from the first horizontal direction; and a plurality of wall blocks positioned in a stack of wall blocks between the first at least one wall block and the second at least one wall block, each wall block of the plurality of wall blocks having a respective width between the first at least one wall block and the second at least one wall block, the respective widths of the wall blocks of the plurality of wall blocks varying monotonically along the stack of wall blocks.

2. The retaining wall system of clause 1, wherein the front face of the first at least one wall block and the front face of the second at least one wall block are inclined increasingly in a direction away from the front side of the retaining wall system with increasing height along the retaining wall system.

3. The retaining wall system of clause 2, wherein:

an angle on the front side of the retaining wall system between the front face on the first at least one wall block and the front face on the second at least one wall block is less than 180°; and the respective width of each wall block of the plurality of wall blocks increases with increasing height along the stack of wall blocks.

4. The retaining wall system of clause 2, wherein:

an angle on the front side of the retaining wall system between the front face on the first at least one wall block and the front face on the second at least one wall block is greater than 180°; and the respective width of each wall block of the plurality of wall blocks decreases with increasing height along the stack of wall blocks.

5. The retaining wall system of any one of clauses 1 to 4, wherein a first wall block of the plurality of wall blocks is coupleable to the first at least one wall block.

6. The retaining wall system of clause 5, wherein the first wall block of the plurality of wall blocks comprises a protrusion, and wherein the first at least one wall block comprises a receptacle that receives the protrusion of the first wall block of the plurality of wall blocks.

7. The retaining wall system of clause 5 or 6, wherein the first wall block of the plurality of wall blocks is coupleable to the second at least one wall block.

8. The retaining wall system of clause 7, wherein the first wall block of the plurality of wall blocks comprises a protrusion, and wherein the second at least one wall block of the plurality of wall blocks comprises a receptacle that receives the protrusion of the second at least one wall block.

9. The retaining wall system of any one of clauses 1 to 8, further comprising sealing material in the retaining wall system to restrict fluid flow through the retaining wall system.

10. The retaining wall system of clause 9, wherein the sealing material comprises at least one gasket.

11. The retaining wall system of clause 9 or 10, wherein the first at least one wall block defines at least one groove, at least a portion of the sealing material positioned in the at least one groove of the first at least one wall block.

12. The retaining wall system of clause 9, 10, or 11, wherein the stack of wall blocks defines at least one groove, at least a portion of the sealing material positioned in the at least one groove of the stack of wall blocks.

13. The retaining wall system of any one of clauses 9 to 12, wherein the second at least one wall block defines at least one groove, at least a portion of the sealing material positioned in the at least one groove of the second at least one wall block.

14. A retaining wall system comprising:

a plurality of wall blocks in a stack of wall blocks, each wall block of the plurality of wall blocks having a respective front face and a respective rearward length from the respective front face, the plurality of wall blocks comprising a first wall block and a second wall block, the respective rearward length of the first wall block greater than the respective rearward length of the second wall block; and a rigid stabilizing body attached to a portion of the first wall block extending rearward from the second wall block, at least a portion of the rigid stabilizing body extending rearward from the first wall block.

15. The retaining wall system of clause 14, wherein the rigid stabilizing body is attached to a top surface of the portion of the first wall block.

16. The retaining wall system of clause 14 or 15, wherein the rigid stabilizing body is attached to lateral surfaces of the portion of the first wall block.

17. The retaining wall system of clause 14, 15, or 16, wherein the portion of the first wall block comprises a pair of rearward projections of the first wall block on opposite lateral sides of the first wall block.

18. The retaining wall system of clause 14, 15, or 16, wherein the portion of the first wall block comprises a laterally extending shelf of the first wall block.

19. The retaining wall system of any one of clauses 14 to 18, further comprising at least one member extending rearward from the first wall block and attaching the rigid stabilizing body to the portion of the first wall block.

20. The retaining wall system of clause 19, when directly or indirectly dependent from clause 15, wherein the at least one member is attached to the top surface of the portion of the first wall block.

21. The retaining wall system of clause 19, when directly or indirectly dependent from clause 16, wherein the at least one member is attached to the lateral surfaces of the portion of the first wall block.

22. The retaining wall system of clause 19, 20, or 21, wherein the member is rigid.

23. The retaining wall system of clause 19, 20, 21, or 22, wherein the member is held in a fixed position relative to the first wall block.

24. The retaining wall system of any one of clauses 19 to 23, further comprising a beam positioned rearward from the rigid stabilizing body, extending transversely to the at least one member, and attached to the at least one member.

25. The retaining wall system of any one of clauses 19 to 23, further comprising a beam positioned rearward from the rigid stabilizing body and attached to the rigid stabilizing body.

26. The retaining wall system of clause 24 or 25, wherein a height of the beam is greater than a height of the at least a portion of the rigid stabilizing body.

27. The retaining wall system of any one of clauses 14 to 26, wherein the at least a portion of the rigid stabilizing body extends rearward from the first wall block past a rupture line of a backfill on a rear side of the retaining wall system.

28. The retaining wall system of clause 27, when directly or indirectly dependent from clause 24 or 25, wherein the beam is positioned in the backfill on an opposite side of the rupture line from the plurality of wall blocks.

29. The retaining wall system of any one of clauses 14 to 28, wherein the rigid stabilizing body comprises a rigid shelf.

30. The retaining wall system of any one of clauses 14 to 29, wherein the first wall block is adjacent the second wall block.

31. A retaining wall system comprising:

a first wall block having a front face and a rear face opposite the front face of the first wall block, wherein the rear face of the first wall block is curved inward towards the front face of the first wall block.

32. The retaining wall system of clause 31, wherein the first wall block comprises first and second projections on opposite lateral sides of the first wall block and projecting rearward to a first rearward distance from the front face of the first wall block, and wherein the rear face of the first wall block curves between the first and second projections.

33. The retaining wall system of clause 32, further comprising:

a second wall block vertically aligned with the first wall block, the second wall block having a front face and a rear face opposite the front face of the second wall block, the second wall block comprising third and fourth projections on opposite lateral sides of the second wall block and projecting rearward to a second rearward distance from the front face of the second wall block, wherein the rear face curves between the third and fourth projections, and wherein the first rearward distance is greater than the second rearward distance; and a rigid stabilizing body attached to a portion of the first wall block extending rearward from the second wall block, at least a portion of the rigid stabilizing body extending rearward from the first wall block.

34. The retaining wall system of clause 33, wherein the first wall block is adjacent the second wall block.

35. The retaining wall system of clause 32, further comprising a rigid stabilizing body attached to the first and second projections, at least a portion of the rigid stabilizing body extending rearward from the first wall block.

36. The retaining wall system of clause 33, 34, or 35, wherein the rigid stabilizing body comprises a rigid shelf.

37. A retaining wall system comprising:

a first wall block having a front face extending in a first horizontal direction;

a second wall block positioned laterally relative to the first wall block and having a front face extending in a second horizontal direction different from the first horizontal direction; and a rigid stabilizing body comprising a first portion and a second portion, the first portion extending rearward from the first wall block and attached to a portion of the first wall block, the second portion extending rearward from the second wall block and attached to a portion of the second wall block.

38. The retaining wall system of clause 37, further comprising a first at least one member extending rearward from the first wall block and attaching the first wall block to the rigid stabilizing body.

39. The retaining wall system of clause 38, further comprising a second at least one member extending rearward from the second wall block and attaching the second wall block to the rigid stabilizing body.

40. The retaining wall system of clause 37, 38, or 39, wherein the rigid stabilizing body extends rearward from the first and second wall blocks past a rupture line of a backfill on a rear side of the retaining wall system.

41. The retaining wall system of any one of clauses 37 to 40, further comprising a beam positioned rearward from the rigid stabilizing body and attached to the rigid stabilizing body.

42. The retaining wall system of clause 41, wherein the beam is positioned in the backfill on an opposite side of the rupture line from the stack of wall blocks.

43. The retaining wall system of clause 41 or 42, when directly or indirectly dependent from clause 38, wherein at least a first portion of the beam extends transversely to the first at least one member.

44. The retaining wall system of clause 41, 42, or 43, when directly or indirectly dependent from clause 39, wherein at least a second portion of the beam extends transversely to the second at least one member.

45. The retaining wall system of any one of clauses 37 to 44, wherein the first portion of the rigid stabilizing body and the second portion of the rigid stabilizing body are separate pieces abutting one another.

46. The retaining wall system of clause 45, wherein the first portion and second portion are attached to each other.

47. The retaining wall system of any one of clauses 37 to 46, wherein the rigid stabilizing body connects the first and second wall blocks to each other.

48. The retaining wall system of any one of clauses 37 to 47, wherein the rigid stabilizing body comprises a rigid shelf.

49. A retaining wall system comprising:

a first wall block defining a groove in at least one surface of the first wall block; and at least one sealing material received in the groove of the first wall block.

50. The retaining wall system of clause 49, further comprising:

a second wall block adjacent the first wall block and defining a groove in at least one surface of the second wall block; and at least one sealing material received in the groove of the second wall block.

51. The retaining wall system of clause 50, wherein the sealing material of the first wall block faces the sealing material of the second wall block.

52. The retaining wall system of clause 51, wherein the sealing material of the first wall block defines a recess, and wherein the sealing material of the second wall block defines a projection complementary to and received in the recess.

53. The retaining wall system of any one of clauses 50 to 52, wherein the sealing material received in the groove of the second wall block comprises a gasket.

54. The retaining wall system of any one of clauses 49 to 53, wherein the sealing material received in the groove of the first wall block comprises a gasket.

55. A retaining wall system comprising:

at least one wall block having a top side and a bottom side and defining a through-opening within the at least one wall block and extending between the top and bottom sides of the at least one wall block;

at least one ground-stabilizing base body supporting the at least one wall block; and a tension link in the through-opening of the at least one wall block, attached to the at least one wall block and to the at least one ground-stabilizing base body, and tensionable to hold the at least one wall block on the at least one ground-stabilizing base body.

56. The retaining wall system of clause 55, further comprising a resilient body resiliently attaching the tension link to the at least one wall block.

57. The retaining wall system of clause 56, wherein the resilient body comprises a coil spring.

58. The retaining wall system of clause 56 or 57, wherein the resilient body resiliently attaches the tension link to a rearwardly projecting and laterally extending shelf of the at least one wall block.

59. A retaining wall system comprising:

at least one wall block;

at least one ground-stabilizing base body supporting the at least one wall block;

a fastening body under the at least one ground-stabilizing base body; and at least one tension link attached to the at least one wall block and to the fastening body.

60. The retaining wall system of clause 59, wherein:

the at least one wall block comprises a first at least one wall block and a second at least one wall block positioned laterally relative to the first at least one wall block;

the at least one ground-stabilizing base body comprises a first ground-stabilizing base body supporting the first at least one wall block and a second ground-stabilizing base body supporting the second at least one wall block;

the fastening body is under the first and second ground-stabilizing base bodies;

the at least one tension link comprises a first tension link attached to the first wall block and to the fastening body; and the at least one tension link further comprises a second tension link attached to the second wall block and to the fastening body.

61. The retaining wall system of clause 59 or 60, wherein:

the at least one wall block has a top side and a bottom side and defines a through-opening within the at least one wall block and extending between the top and bottom sides of the at least one wall block; and the tension link extends through the through-opening of the at least one wall block.

62. The retaining wall system of clause 59, 60, or 61, wherein the fastening body is formed separately from the at least one ground-stabilizing base body.

63. The retaining wall system of clause 59, 60, 61, or 62, wherein, absent a tension applied to the at least one tension link, the fastening body is movable relative to the at least one ground-stabilizing base body.

64. The retaining wall system of any one of clauses 59 to 63, further comprising a resilient body resiliently attaching the tension link to the fastening body.

65. The retaining wall system of clause 64, wherein the resilient body comprises a coil spring.

66. The retaining wall system of clause 64 or 65, wherein the resilient body resiliently attaches the tension link to a rearwardly projecting and laterally extending shelf of the at least one wall block.

67. The retaining wall system of clause 64 or 65, wherein the resilient body is within the at least one wall block.

68. The retaining wall system of any one of clauses 59 to 67 wherein the fastening body is a shear key extending downwardly from a lowermost surface of the at least one ground-stabilizing base body.

69. The retaining wall system of clause 55, 56, or 61, or of any one of clauses 62 to 68 when directly or indirectly dependent from clause 61, wherein the through-opening has a tapered shape.

70. The retaining wall system of clause 69, wherein the through-opening has a first width at the top side and a second width at the bottom side, the first width larger than the second width.

71. The retaining wall system of clause 69, wherein the through-opening has a first width at the top side and a second width at the bottom side, the second width larger than the first width.

72. The retaining wall system of any one of clauses 55 to 71, wherein the tension link is rigid.

73. The retaining wall system of any one of clauses 55 to 72, wherein the tension link comprises a coil rod.

74. The retaining wall system of any one of clauses 55 to 73, wherein each tension link of the at least one tension link applies at least 6,000 pounds of force to the at least one ground-stabilizing base body.

75. The retaining wall system of any one of clauses 55 to 73, wherein each tension link of the at least one tension link applies at least 7,000 pounds of force to the at least one ground-stabilizing base body.

76. The retaining wall system of any one of clauses 55 to 73, wherein each tension link of the at least one tension link applies at least 10,000 pounds of force to the at least one ground-stabilizing base body.

77. The retaining wall system of any one of clauses 55 to 73, wherein each tension link of the at least one tension link applies at least 15,000 pounds of force to the at least one ground-stabilizing base body.

78. The retaining wall system of any one of clauses 55 to 73, wherein each tension link of the at least one tension link applies at least 20,000 pounds of force to the at least one ground-stabilizing base body.

79. The retaining wall system of any one of clauses 55 to 73, wherein each tension link of the at least one tension link applies at least 25,000 pounds of force to the at least one ground-stabilizing base body.

80. The retaining wall system of any one of clauses 55 to 73, wherein each tension link of the at least one tension link applies at least 30,000 pounds of force to the at least one ground-stabilizing base body.

81. The retaining wall system of any one of clauses 55 to 73, wherein each tension link of the at least one tension link applies at least 35,000 pounds of force to the at least one ground-stabilizing base body.

82. The retaining wall system of any one of clauses 55 to 73, wherein each tension link of the at least one tension link applies at least 40,000 pounds of force to the at least one ground-stabilizing base body.

83. The retaining wall system of any one of clauses 55 to 82, wherein the at least one ground-stabilizing base body defines at least one drain hole between front and rear sides of the retaining wall system.

84. The retaining wall system of any one of clauses 55 to 83, wherein the at least one ground-stabilizing base body extends rearward farther than a rear side of the at least one wall block.

85. The retaining wall system of any one of clauses 55 to 83, wherein the at least one wall block comprises a plurality of wall blocks positioned in a stack of wall blocks, and the at least one ground-stabilizing base body extends rearward farther than a rear side of the plurality of wall blocks.

86. The retaining wall system of any one of clauses 55 to 85, wherein the at least one ground-stabilizing base body comprises concrete.

87. The retaining wall system of any one of clauses 55 to 86, wherein the at least one wall block comprises concrete.

88. The retaining wall system of any one of clauses 55 to 87, wherein the fastening body comprises concrete.

89. The retaining wall system of any one of clauses 55 to 88, wherein the at least one wall block defines a groove in at least one surface of the at least one wall block, the retaining wall system further comprising at least one sealing material received in the groove of the first wall block.

90. A method of stabilizing the retaining wall of any one of clauses 55 to 89, the method comprising causing tension to be applied to the at least one tension link.

91. The method of clause 90, wherein causing the tension to be applied to the at least one tension link comprises causing at least one ram to apply the tension to the at least one tension link.

92. The method of clause 90, wherein causing the tension to be applied to the at least one tension link comprises causing at least one hydraulic ram to apply the tension to the at least one tension link.

93. A retaining wall system comprising:

at least one wall block;

at least one ground-stabilizing base body supporting the at least one wall block; and at least one rearward extension body formed separately from and attached to the at least one ground-stabilizing base body, the at least one rearward extension body rearwardly extending a length of the at least one ground-stabilizing base body.

94. The retaining wall system of clause 93, wherein the at least one block is attached to the ground-stabilizing base body and held in a fixed position relative to the ground-stabilizing base body.

Although specific embodiments have been described and illustrated, such embodiments should be considered illustrative only and not as limiting the invention as construed according to the accompanying claims.

What is claimed is:

1. A retaining wall system comprising:

a plurality of wall blocks positioned in a stack of wall blocks;

at least one tension link extending through each wall block of the plurality of wall blocks;

a filler material hardened around the at least one tension link and, in each wall block of the plurality of wall blocks, in at least one through-opening in the wall block between the wall block and a portion of the at least one tension link in the at least one through-opening;

at least one fastener applying, to the at least one tension link, a tension force within the filler material hardened in each wall block of the plurality of wall blocks;

at least one rigid member attached to a first wall block of the plurality of wall blocks; and a rigid stabilizing body attached to and extending transversely to the at least one rigid member;

wherein:

the plurality of wall blocks comprises the first wall block and a second wall block;

each wall block of the plurality of wall blocks has a respective front face and a respective rearward length from the respective front face;

the respective rearward length of the first wall block is greater than the respective rearward length of the second wall block; and the at least one rigid member is attached to a portion of the first wall block extending rearward from the second wall block.

2. The retaining wall system of claim 1, further comprising:

at least one ground-stabilizing base body supporting the plurality of wall blocks; and a fastening body under the at least one ground-stabilizing base body and attached to the at least one tension link;

wherein the fastening body is formed separately from the at least one ground-stabilizing base body.

3. The retaining wall system of claim 2, wherein, absent the tension force applied to the at least one tension link, the fastening body is movable relative to the at least one ground-stabilizing base body.

4. The retaining wall system of claim 2, further comprising a resilient body resiliently attaching the at least one tension link to the fastening body.

5. The retaining wall system of claim 4, wherein the resilient body comprises a coil spring.

6. The retaining wall system of claim 4, wherein the resilient body is within at least one wall block of the plurality of wall blocks.

7. The retaining wall system of claim 2, wherein the fastening body is a shear key extending downwardly from a lowermost surface of the at least one ground-stabilizing base body.

8. The retaining wall system of claim 2, wherein the at least one ground-stabilizing base body extends rearward farther than a rear side of the plurality of wall blocks.

9. The retaining wall system of claim 2, wherein the at least one ground-stabilizing base body comprises concrete.

10. The retaining wall system of claim 2, wherein the fastening body comprises concrete.

11. The retaining wall system of claim 1, wherein the at least one tension link comprises a coil rod.

12. The retaining wall system of claim 1, further comprising at least one ground-stabilizing base body supporting the plurality of wall blocks, wherein each tension link of the at least one tension link applies at least 15,000 pounds of the tension force to the at least one ground-stabilizing base body.

13. The retaining wall system of claim 1, further comprising at least one ground-stabilizing base body supporting the plurality of wall blocks, wherein each tension link of the at least one tension link applies at least 30,000 pounds of the tension force to the at least one ground-stabilizing base body.

14. The retaining wall system of claim 1, wherein the plurality of wall blocks comprise concrete.

15. The retaining wall system of claim 1, wherein at least one wall block of the plurality of wall blocks defines a groove in at least one surface of the at least one wall block, the retaining wall system further comprising at least one sealing material received in the groove of the at least one wall block.

16. The retaining wall system of claim 15, wherein the at least one sealing material comprises a rubber gasket.

17. The retaining wall system of claim 1, wherein the at least one through-opening of each wall block of the plurality of wall blocks is tapered.

18. The retaining wall system of claim 17, wherein in each wall block of the plurality of wall blocks, the at least one through-opening has a first width at a top side of the wall block and a second width at a bottom side of the wall block, the first width larger than the second width.

19. The retaining wall system of claim 17, wherein in each wall block of the plurality of wall blocks, the at least one through-opening has a first width at a top side of the wall block and a second width at a bottom side of the wall block, the second width larger than the first width.

20. The retaining wall system of claim 1, wherein the filler material fills the through-opening of each wall block of the plurality of wall blocks.

21. The retaining wall system of claim 1, wherein the at least one rigid member is attached to a top surface of the portion of the first wall block.

22. The retaining wall system of claim 1, wherein the at least one rigid member is attached to lateral surfaces of the portion of the first wall block.

23. The retaining wall system of claim 1, wherein the portion of the first wall block comprises a pair of rearward projections of the first wall block on opposite lateral sides of the first wall block.

24. The retaining wall system of claim 1, wherein the portion of the first wall block comprises a laterally extending shelf of the first wall block.

25. The retaining wall system of claim 1 wherein:

the at least one rigid member comprises a plurality of rigid members attached to the first wall block of the plurality of wall blocks; and the rigid stabilizing body is attached to and extends transversely to reach each rigid member of the plurality of rigid members.

26. The retaining wall system of claim 1, wherein the filler material comprises concrete.

27. The retaining wall system of claim 1, wherein the at least one fastener transfers at least some of the tension to an uppermost wall block of the plurality of wall blocks.

28. The retaining wall system of claim 27, wherein a top surface of the uppermost wall block of the plurality of wall blocks defines at least one recess, and the at least one fastener is in the at least one recess.

29. The retaining wall system of claim 1, wherein the tension stretches the at least one tension link within the filler material.

30. The retaining wall system of claim 1, wherein the tension stretches the at least one tension link along an entire length of the at least one tension link within the filler material.

31. The retaining wall system of claim 1, wherein at least some of the tension applied by the at least one fastener to the at least one tension link is independent of weight of components of the retaining wall system and independent of any external load on the retaining wall system.

32. A method of constructing a retaining wall system comprising a plurality of wall blocks positioned in a stack of wall blocks, the method comprising:

causing at least one fastener to maintain a tension force in each wall block of the plurality of wall blocks;

after causing the at least one fastener to maintain the tension force in each wall block of the plurality of wall blocks, in each wall block of the plurality of wall blocks, positioning, in at least one through-opening in the wall block between the wall block and a portion of at least one tension link in the at least one through-opening, a filler material that hardens around the at least one tension link, the at least one tension link extending through each wall block of the plurality of wall blocks; and causing the tension force to be maintained on the at least one tension link at least while the filler material hardens.

33. The method of claim 32, further comprising applying the tension force to the at least one tension link before the filler material hardens.

34. The method of claim 33, wherein causing the tension force to be applied to the at least one tension link comprises causing at least one ram to apply the tension force to the at least one tension link.

35. The method of claim 33, wherein applying the tension force to the at least one tension link comprises stretching the at least one tension link before the filler material hardens.

36. The method of claim 32, wherein the tension force is at least 15,000 pounds.

37. The method of claim 32, wherein the tension force is at least 30,000 pounds.

38. The method of claim 32, wherein positioning the filler material in the at least one through-opening in each wall block of the plurality of wall blocks comprises filling the at least one through-opening in each wall block of the plurality of wall blocks with the filler material.

39. The method of claim 32, wherein the at least one tension link comprises at least one coil rod.

40. The method of claim 32, wherein the filler material comprises concrete.

* * * * *